US006520626B1

(12) United States Patent
Murakami

(10) Patent No.: US 6,520,626 B1
(45) Date of Patent: Feb. 18, 2003

(54) LIQUID EJECTION HEAD, METHOD FOR PREVENTING ACCIDENTAL NON-EJECT USING THE EJECTION HEAD AND MANUFACTURING METHOD OF THE EJECTION HEAD

(75) Inventor: Shuichi Murakami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/493,273

(22) Filed: Jan. 28, 2000

(30) Foreign Application Priority Data

Jan. 29, 1999 (JP) ..... 11-022868
Jan. 29, 1999 (JP) ..... 11-022869
Jan. 14, 2000 (JP) ..... 2000-007182

(51) Int. Cl.[7] ..... B41J 2/05
(52) U.S. Cl. ..... 347/56; 347/61
(58) Field of Search ..... 347/56, 61, 62, 347/65

(56) References Cited

U.S. PATENT DOCUMENTS

| | | | | |
|---|---|---|---|---|
| 4,313,124 A | | 1/1982 | Hara | 346/140 |
| 4,345,262 A | | 8/1982 | Shirato et al. | 346/140 |
| 4,463,359 A | * | 7/1984 | Ayata et al. | 347/56 |
| 4,723,129 A | | 2/1988 | Endo et al. | 346/1.1 |
| 4,740,796 A | | 4/1988 | Endo et al. | 346/1.1 |
| 5,548,312 A | * | 8/1996 | Asai | 347/56 |
| 5,818,479 A | | 10/1998 | Reinecke et al. | 347/47 |

FOREIGN PATENT DOCUMENTS

| | | |
|---|---|---|
| EP | 0 317 300 | 5/1989 |
| EP | 0 549 244 | 6/1993 |
| EP | 0 718 103 | 6/1996 |
| EP | 0 835 759 | 4/1998 |
| EP | 0 842 776 | 5/1998 |
| JP | 54-56847 | 5/1979 |
| JP | 60-71260 | 4/1985 |
| JP | 4-39049 | 2/1992 |

OTHER PUBLICATIONS

Fourth International Symposium on Cationic Polymerization, Editor: J.P. Kennedy, John Wiley & Sons, New York. Journal of Polymer Science: No. 56,383–95, 1976.

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

The present invention provides a liquid ejection head that can stabilize the liquid ejecting direction, against various variation such as foaming variation under a high driving frequency, or proprietary variation for respective ejection opening in the manufacturing stage. This liquid ejection head includes an ejection opening portion provided with an ejection opening to eject liquid; a liquid passage to communicate with the ejection opening portion and to introduce liquid to the ejection opening portion; and an electrothermal converting element disposed at the liquid passage, for generating thermal energy to be used for ejecting liquid from the ejection opening; and causes liquid state change by applying thermal energy to the liquid, generates bubble, and eject liquid by the pressure of thus generated bubble, eject liquid in the volume reduction stage after the bubble has grown to its maximum volume, and is provided with a plurality of grooves distributed in respect of the ejection opening center and extending in the liquid ejecting direction.

45 Claims, 69 Drawing Sheets

LIQUID EJECTION HEAD, METHOD FOR PREVENTING ACCIDENTAL NON-EJECT USING THE EJECTION HEAD AND MANUFACTURING METHOD OF THE EJECTION HEAD

This application is based on Japanese Patent Application Nos. 11-022868 (1999) filed Jan. 29, 1999, 11-022869 (1999) filed Jan. 29, 1999, and 2000–7182 filed Jan. 14, 2000, the contents of which are incorporated hereinto by reference.

BACKGROUND OF THE INVENTION

1. Field of the Invention

The present invention relates to a liquid ejection head, a method for preventing accidental non-eject using the ejection head and a manufacturing method of the ejection head, and more particularly, a liquid ejection head for ejecting extremely minute liquid droplets.

2. Description of the Related Art

The ink-jet printing system is known as a system for ejecting liquid such as ink used currently. This ink-jet printing system includes a method using electrothermal converting element (heater) as eject energy generating element for ejecting ink droplet and a method using piezoelectric element, and both methods permit to control the ejection of the ink droplet by means of an electric signal.

For instance, the principle of an ink droplet ejection method using the electrothermal converting element consists in boiling ink instantly in the proximity of the electrothermal converting element by delivering an electric signal to the electrothermal converting element, and rapidly ejecting ink droplets by a sudden bubble growth caused by the phase change of the ink at that time. The principle of the ink droplet ejection method using the piezoelectric element consists in changing the piezoelectric element by delivering an electric signal to the piezoelectric element, and ejecting ink droplets by the pressure caused at the time of this displacement of the piezoelectric element.

A system for ejecting liquid by communicating formed bubbles with the atmosphere is known as a liquid ejection method using the electrothermal converting element. The practical application of this system is disclosed in European Patent Publication No. 0454155. The invention described in such patent publication is made by pursuing the cause of splash caused by bubble explosion or unstable droplet formation and concerns a liquid ejection method comprising the steps of generating a bubble in a liquid passage by a temperature elevation suddenly exceeding the core boiling by delivering thermal energy to the liquid passage and communicating the bubble with the atmosphere near the ejection opening of the liquid passage. In such a liquid ejection method of atmosphere communication from the viewpoint of uniformity during bubble growth and bubble communication with the atmosphere, a so-called side shooter structure liquid ejection head, wherein the ejection opening is disposed in a position opposed to the electrothermal converting element is preferable for stable liquid ejection.

BACKGROUND OF THE ART

In such an ink-jet printing system, a still higher image quality, a higher resolution and a higher printing speed are required.

However, in the high quality image formation using the side shooter structure liquid ejection head mentioned above, it was found that the communication property between a bubble and the atmosphere begins to affect droplet ejecting direction according to the volume decrease of droplet to be ejected. Particularly, when the ejected liquid volume is reduced to $20\times10^{-15}m^3$ or less, the trailing (liquid connecting the liquid passage with the main droplet of liquid droplet) and satellite droplet formed by this trailing affect the image quality, and moreover, atomized ink attaches to the surface to be recorded of the printing media and decreases the printing quality, creating a new problem.

The Applicant proposes an excellent ejecting method for resolving the new problem mentioned above using the liquid eject method by the atmosphere communication method. The method is excellent in that it allows one to achieve a high image quality printing with less ejection slippage, by ejecting liquid by communicating a bubble with the atmosphere for the first time in the bubble volume reduction stage, in the so-called side shooter structure liquid ejection head. The inventors have studied to achieve higher resolution and higher quality printing, and found that it is desirable to realize a constantly stable ejection by the ejection method mentioned above, against variable factors such as foaming variation under a high driving frequency, or proprietary variation of nozzles arising in the manufacturing stage. As the result of the empirical analysis of the liquid ejection method mentioned above, the inventors have newly found that in an ejection method wherein liquid is ejected in the defoaming step, it is important to stabilize the liquid movement against variable factors in the whole head arrangement, including not only the ejection opening surface, but also the ejection opening portion forming the ejection opening including the ejection opening surface, and further the eject means and the liquid passage.

The inventors did research on arrangements for suppressing slippage in the droplet ejecting direction, in particular those involving the ejection opening shape, and discovered Japanese Patent Application Laid-open No. 4-39049 (1992). The Patent Publication describes an arrangement wherein the opening section is petal-shaped, in a developer ejection apparatus having a opening section for ejecting developer, a means for ejecting developer from the opening section and a passage where developer flows. However, this Patent Application recognizes as problems that "an extremely unstable behavior occurs during the developer eject due to a distinct boundary between opening sections and non-opening sections of a circular nozzle", and that "a trajectory flexion occurs due to the entrainment by developer attached to the outer periphery of the circular nozzle at the moment when the developer is ejected". In other words, it only intends to make uniform the adhesiveness of the ejection opening surface, and does not satisfy the intent of the present invention mentioned above that consists in considering the cause of ejection slippage, including the ejection means and the liquid passage.

Especially, among liquid ejection heads of the side shooter type, in a composition wherein the liquid passage between the ejection opening and the heat resistance element is surrounded by a wall surface forming the passage sidewall except the direction toward the liquid chamber (refer to FIGS. 69–72), bubbles happen to stagnate for some reason in the corner of a volume surrounded by the wall surface forming the passage sidewall. As the result of absorption of the ejecting power at the moment of foaming by this bubble stagnation, liquid ejection may become unstable, ejection speed lower, ejection flow smaller and ejection direction deviated.

If the opening area of the ejection opening of the liquid ejection head is reduced, for realizing a higher image quality and a higher resolution as mentioned above, ejection may be obstructed by an ink droplet attached to the ejection opening surface for some reason. In particular, in the liquid ejection head using the atmosphere communication system mentioned above, a non-eject (called accidental non-eject hereinafter) occurs when the ejection opening is obstructed by an ink droplet, and a white line may appear during the image formation, because that ejection opening does not engage in the printing.

The Inventors have also examined in detail the phenomena mentioned above, and found that the accidental non-eject is a phenomenon of a single ejection opening, and once a non-eject state occurs, it is hard to recover from it if suction or other recovery means are not used.

Moreover, the inventors have obtained new findings that the whole head arrangement including not only the ejection opening surface, but also the ejection opening portion forming the ejection opening including the ejection opening surface, and further ejecting means and liquid passage is important, to such bubble stagnation or accidental non-eject, too.

SUMMARY OF THE INVENTION

The present invention, devised as the result of devoted study by the inventors has a main object to provide a liquid ejection head, allowing one to realize a globally excellent liquid ejection that can meet requirements such as still higher image quality, higher resolution and higher printing speed, by taking into consideration the whole head composition including the i ejection opening portion forming the ejection opening including the ejection opening surface, and further the ejection means and the liquid passage, and a manufacturing method of the head.

To be more specific, the first object of the present invention is to provide an excellent liquid head that can stabilize the liquid ejecting direction against variable factors such as foaming variation under a high driving frequency, or proprietary variations of nozzles arising in the manufacturing stage.

The second object of the present invention is to provide an excellent ejection head that can effectively prevent or control the aforementioned accidental non-eject, and a method of accidental non-eject prevention using the head.

The third object of the present invention is to provide an excellent ejection head that can stabilize the ejecting direction and effectively prevent or control the aforementioned accidental non-eject, while allowing for ejection opening variations arising in the manufacturing stage.

The fourth object of the present invention is to provide a liquid ejection head of complicated but easily formable shape, that can realize a single object, or combined complex objects mentioned above and a manufacturing method of the liquid ejection head.

The fifth object of the present invention is to provide a liquid ejection head that is rapid in meniscus vibration convergence, and excellent in refill performance, of the so-called side shooter type, among heads for ejecting liquid by generating bubbles in liquid droplets.

The sixth object of the present invention is to provide an excellent liquid ejection head that can suppress the ejection of unstable liquid due to bubble embracing, in the so-called side shooter type liquid ejection head, among heads for ejecting liquid by generating bubbles in liquid droplets.

The other objects of the present invention can be understood from the following description, and the present invention can attain any complex object by an arbitrary combination of the individual objects.

Concrete means of achieving various objects mentioned above can be understood from the following description.

A liquid ejection head according to the first aspect of the present invention is characterized in that a liquid ejection head, for causing liquid state change by applying thermal energy to a liquid, to generate bubbles, and for ejecting the liquid by the pressure of the thus generated bubbles, comprises:

- an ejection opening portion provided with an ejection opening to eject liquid;
- a liquid passage to communicate with the ejection opening portion and to lead liquid to the ejection opening portion; and
- a heat resistance element disposed at the liquid passage, for generating thermal energy to be used for ejecting liquid from the ejection opening; wherein
  - the liquid is ejected in the volume reduction stage after the bubbles have grown to maximum volume; and
  - a plurality of grooves, which are distributed around the center of the ejection opening and extend in the ejecting direction of the liquid, and are disposed at the ejection opening portion. Thereby, this composition allows one to achieve the first object and meet such requirements as still higher image quality, higher resolution and higher printing speed.

In the liquid ejection head according to the first aspect of the present invention, the liquid may well be ejected by communicating a bubble with the atmosphere for the first time in the bubble volume reduction stage, wherein the gravity center of a polygon defined by connecting center sections of mutually adjacent grooves may correspond approximately to the gravity center of a polygon defined by connecting base sections of the grooves, and six or more grooves may be provided. Top sections and base sections of the groove may constitute respectively a minute curved surface, and the angle defining the groove top section may be within a range from 30 degrees (included) to 90 degrees (included). A liquid chamber to supply the liquid passage with liquid may be disposed, the ejection opening may be disposed at a position opposed to the heat resistance element, and the liquid passage between the ejection opening and the heat resistance element may be surrounded by wall surfaces defining the sidewall of the passage except for the direction toward the liquid chamber. In this case, the top section of at least one of the plurality of groove may be disposed in the direction toward the liquid chamber, or disposed in the direction toward a corner section of a volume surrounded by the wall surfaces composing the passage sidewall. A plurality of grooves may be disposed substantially in line symmetry with respect to a line passing through the ejection opening center, from the liquid chamber to the ejection opening.

A liquid ejection head according to the second aspect of the present invention is characterized in that a liquid ejection head comprises:

- an ejection opening portion provided with an ejection opening to eject liquid;
- a liquid passage to communicate with the ejection opening portion and to lead liquid to the ejection opening portion; and
- an ejection energy generation means disposed at the liquid passage, and used for ejecting liquid from the ejection opening; wherein
  - grooves extending in the liquid ejecting direction are disposed at the ejection opening portion, for preventing droplets deposited on a face defining the ejection opening from obstructing the ejection opening; and the ejection opening portion is 7 $\mu$m or more in thickness, and the section of the groove at the ejection opening surface is 30 $\mu m^2$ or less. Thereby, this composition allows one to achieve the second object and meet the requirements such as still higher image quality, higher resolution and higher printing speed.

In the liquid ejection head according to the second aspect of the present invention, tops and bases of the groove may constitute respectively a minute curved surface. The angle defining the groove top may be within a range from 30 degrees (included) to 90 degrees (included). The liquid ejection head may comprise the plurality of grooves distributed in respect to the center of the ejection opening. In this case, the gravity center of a polygon defined by connecting center portions of mutually adjacent grooves may correspond approximately to the gravity center of a polygon defined by connecting bases of the grooves. The ejection energy generating element may be a heat resistance element for generating thermal energy, causing liquid state change by applying thermal energy to the liquid, generating a bubble, and ejecting the liquid by the pressure of the thus generated bubble, and the liquid may be ejected in the volume reduction stage after the bubbles have grown to maximum volume.

A liquid ejection head according to the third aspect of the present invention is characterized in that a liquid ejection head comprises:

an ejection opening portion provided with an ejection opening to eject liquid;

a liquid passage to communicate with the ejection opening portion and to lead liquid to the ejection opening portion; and an ejection energy generation means disposed at the liquid passage, and used for ejecting liquid from the ejection opening; wherein grooves extending in the liquid ejecting direction are disposed at the ejection opening portion, the groove being capable of generating a capillary force larger than the adhesive force due to the surface tension of liquid attached to the ejection opening surface. Thereby, this composition allows one to achieve the second object and meet such requirements as still higher image quality, higher resolution and higher printing speed.

In the liquid ejection head according to the third aspect of the present invention, the groove may be provided with a liquid retaining area to retain liquid temporarily. The ejection energy generating element may be a heat resistance element for generating thermal energy, causing liquid state change by applying thermal energy to the liquid, generating a bubble, and ejecting the liquid by the pressure of the thus generated bubble, and the liquid may be ejected in the volume reduction stage after the bubble has grown to its maximum volume. A plurality of the grooves may be distributed around the ejection opening center. In this case, the gravity center of a polygon defined by connecting center portions of mutually adjacent grooves corresponds approximately to the gravity center of a polygon defined by connecting bases of the grooves.

A liquid ejection head according to the fourth aspect of the present invention is characterized in that a liquid ejection head comprises:

an ejection opening portion provided with an ejection opening to eject liquid;

a liquid passage to communicate with the ejection opening portion and to introduce liquid to the ejection opening portion; and an ejection energy generation means disposed in the C liquid passage, and used for ejecting liquid from the ejection opening; wherein grooves extending in the liquid ejecting direction are disposed at the ejection opening portion; and in the ejection opening side end section of the groove, the area near the top of the groove is relatively convex in the liquid ejecting direction, compared to the other areas of the ejection opening surface.

In the liquid ejection head according to the fourth aspect of the present invention, the groove may be provided with a liquid retaining area to retain liquid temporarily. The gravity center of a polygon defined by connecting center portions of mutually adjacent grooves may correspond approximately to the gravity center of a polygon defined by connecting bases of the grooves. The adhesiveness of the ejected liquid to the surface over which the groove of the ejection opening portion extends may be relatively good compared to the adhesiveness of the liquid to the face forming the ejection opening. The ejection opening portion may be 7 $\mu$m or more in thickness, and the section of the groove at the ejection opening surface may be 30 $\mu m^2$ or less. A plurality of the grooves may be distributed in respect of the ejection opening center. In this case, the ejection energy generating element may be a heat resistance element for generating thermal energy, causing liquid state change by applying thermal energy to the liquid, generating a bubble, and ejecting the liquid by the pressure of the thus generated bubble, and the liquid may be ejected in the volume reduction stage after the bubble has grown to its maximum volume.

A method for preventing accidental non-eject due to liquid deposited on the ejection opening of a liquid ejection head according to the fifth aspect of the present invention is characterized by in that it comprises:

an ejection opening portion provided with an ejection opening to eject liquid;

a liquid passage to communicate with the ejection opening portion and to introduce liquid into the ejection opening portion; and an ejection energy generation means disposed at the liquid passage, and used for ejecting liquid from the ejection opening; wherein grooves extending in the liquid ejecting direction are disposed at the ejection opening portion; comprising steps of:

sucking liquid in the liquid passage into the groove, after the liquid is ejected from the ejection opening portion by the energy generation means;

taking liquid deposited on the face defining the ejection opening into the groove; and moving liquid deposited on the face defining the ejection opening to the liquid passage side without obstructing the ejection opening, by the contact, in the groove, of liquid in the liquid passage and liquid deposited on the face defining the ejection opening.

Thereby, this composition allows one to achieve the third object and meet such requirements such as still higher image quality, higher resolution and higher printing speed.

In the method for preventing accidental non-eject due to liquid deposited on the ejection opening of a liquid ejection head according to the fifth aspect of the present invention, the groove may be provided with a liquid retaining area to retain liquid temporarily, and the method may comprise the step of temporarily retaining liquid in the area. A plurality of the grooves may be distributed in respect of the ejection opening center.

A liquid ejection head according to the sixth aspect of the present invention is characterized in that a liquid ejection head comprises:

an ejection opening portion provided with an ejection opening to eject liquid;

a liquid passage to communicate with the ejection opening portion and to introduce liquid to the ejection opening portion; and an ejection energy generation means disposed at the liquid passage, and used for ejecting liquid from the ejection opening; wherein the ejection opening portion is formed by etching; and grooves extending in the liquid ejecting direction are disposed at the ejection opening portion. Thereby, this composition allows one to achieve the fourth object and meet such requirements as still higher image quality, higher resolution and higher printing speed.

In the liquid ejection head according to the sixth aspect of the present invention, the ejection opening portion may be 7 $\mu$m or more in thickness, and the section of the groove at the ejection opening surface may be 30 $\mu m^2$ or less. A minute protrusion section protruding from the groove topside to the base side, may be provided in the liquid passage side of the groove. The groove may be tapered, so that the opening section area of the section along the face having the ejection opening increases from the ejection opening side to the liquid passage side. Tops and bases of the groove may constitute respectively a minute curved surface. The ejection opening side end section of the groove, the area near the top of the groove may be relatively convex to the liquid ejecting direction, compared to the other areas of the ejection opening surface.

A manufacturing method of a liquid ejection head according to the seventh aspect of the present invention is characterized in that it comprises:

an ejection opening portion provided with an ejection opening to eject liquid;

a liquid passage to communicate with the ejection opening portion and to introduce liquid to the ejection opening portion; and an eject energy generation means disposed at the liquid passage, and used for ejecting liquid from the ejection opening;

wherein the method comprises an etching step for forming the ejection opening portion and grooves extending in the liquid ejecting direction by etching, using an ejection opening forming mask provided with a plurality of convex sections and concave section distributed in respect to the ejection opening center.

In the manufacturing method of a liquid ejection head according to the seventh aspect of the present invention, the manufacturing method of a liquid ejection head may further comprise steps of:

depositing a water-repellent layer on the surface of a member composing the ejection opening portion, before the etching step; and removing the water-repellent layer with the member composing the ejection opening portion according to the ejection opening configuration in the etching step. The manufacturing method of a liquid ejection head may further comprise a step of:

forming a minute protrusion section protruding from the groove topside to the base side, in the liquid passage side of the groove, in the etching step. The manufacturing method of a liquid ejection head may comprise a step of:

forming a tapered groove, so that the opening section area of the section along the face having the ejection opening increases from the ejection opening side to the liquid passage side, in the etching step. The manufacturing method of a liquid ejection head may comprise a step of:

forming, in the ejection opening side end section of the groove, the area near the top of the groove relatively convex to the liquid ejecting direction, compared to the other areas of the ejection opening surface, in the etching step.

A liquid ejection head according to the eighth aspect of the present invention is characterized in that it comprises:

an ejection opening portion provided with an ejection opening to eject liquid;

a liquid passage to communicate with the ejection opening portion and to introduce liquid to the ejection opening portion;

an ejection energy generation means disposed at the liquid passage, and used for ejecting liquid from the ejection opening; and a liquid chamber to supply the liquid passage with liquid, wherein state change of the liquid is caused by applying thermal energy to the liquid, a bubble is generated, and the liquid is ejected by the pressure of the thus generated bubble;

the liquid passage between the ejection opening and the heat resistance element is surrounded by wall surfaces defining the sidewall of the passage except for the direction toward the liquid chamber; and grooves having the top thereof in the direction toward the liquid chamber, and extending to the liquid ejecting direction are provided. Thereby, this composition allows one to achieve the fifth object and meet such requirements as still higher image quality, higher resolution and higher printing speed.

A liquid ejection head according to the ninth embodiment of the present invention is characterized in that a liquid ejection head comprises:

an ejection opening portion provided with an ejection opening to eject liquid;

a liquid passage to communicate with the ejection opening portion and to introduce liquid to the ejection opening portion;

an ejection energy generation means disposed at the liquid passage, and used for ejecting liquid from the ejection opening; and a liquid chamber to supply the liquid passage with liquid, wherein state change of the liquid is caused by applying thermal energy to the liquid, a bubble is generated, and the liquid is ejected by the pressure of the thus generated bubble;

the liquid passage between the ejection opening and the heat resistance element is surrounded by wall surfaces defining the sidewall of the passage except for the direction toward the liquid chamber; and grooves having the top thereof in the direction towards a corner portion of a volume surrounded by wall surfaces defining the sidewall of the passage, are provided. Thereby, this composition allows one to achieve the sixth object and meet such requirements as still higher image quality, higher resolution and higher printing speed.

The present invention can provide a liquid ejection head, allowing one to realize globally excellent liquid ejection that can meet requirements such as still higher image quality, higher resolution and higher printing speed, by taking into consideration the whole head composition including the ejection opening section forming the ejection opening including the ejection opening surface, and further the ejection means and the liquid passage, and a manufacturing method of the head.

To be more specific, the present invention can provide an excellent liquid head that can stabilize the liquid ejecting direction against variable factors such as foaming variation under a high driving frequency, or proprietary variations in respective nozzles arising in the manufacturing stage.

An excellent ejection head, that can effectively prevent or control accidental non-eject, and a method of accidental non-eject prevention using the head can be provided.

An excellent ejection head that can stabilize the ejecting direction and effectively prevent or control the aforementioned accidental non-eject, while allowing for ejection opening variations arising in the manufacturing stage can be provided.

A liquid ejection head of complicated but easily formable shape that can realize either a single object or the combined complex objects mentioned above, and a manufacturing method of the liquid ejection head, can be provided.

A liquid ejection head that is rapid in meniscus vibration convergence, and excellent in refill performance, in the so-called side shooter type liquid ejection head, among heads for ejecting liquid by generating bubbles in liquid droplets can be provided.

An excellent liquid ejection head that can suppress the eject of unstable liquid due to bubble embracing, in the so-called side shooter type liquid ejection head, among heads for ejecting liquid by generating bubble in the liquid droplet can be provided.

In the present invention, the "ejection opening" means the head surface opening area, and designates, in case of a plate where openings are formed for ejecting liquid (orifice plate, hereinafter), the opening area of the plate surface. Besides, the term "ejection opening center" is used to designate the center (gravity center) of geometry defined by the periphery of the head surface opening area.

In the present invention, the "ejection opening portion" indicates the whole tubular opening area including the ejection opening, of members forming the ejection opening, such as an opening section disposed on the orifice plate, and includes the ejection opening. In the present invention, the "liquid passage" excludes the aforementioned "ejection opening" except otherwise specified. In the present invention, an expression "liquid ejecting direction" may be used for convenience to designate the extension direction (thickness direction of the orifice plate for the head having an orifice plate) of the tubular sidewall forming the aforementioned "ejection opening portion".

Moreover, in the present invention, the "groove" designates a concave open portion formed by an area locally remote from the ejection opening center (called "groove top" hereinafter, in the present invention), and two areas locally near the ejection opening center adjacent to this area (called "groove base" hereinafter, in the present invention), and corresponds to the shape having its thickness component in the aforementioned "liquid ejecting direction". The term "groove center portion" is used to designate the center (gravity center) of geometry defined by connecting the "groove top" and two "groove bases" adjacent to the top.

BRIEF DESCRIPTION OF THE DRAWINGS

The preferred embodiments of the present invention now will be described in detail referring to the accompanying drawings wherein.

DETAILED DESCRIPTION OF PREFERRED EMBODIMENTS

Figure 1:
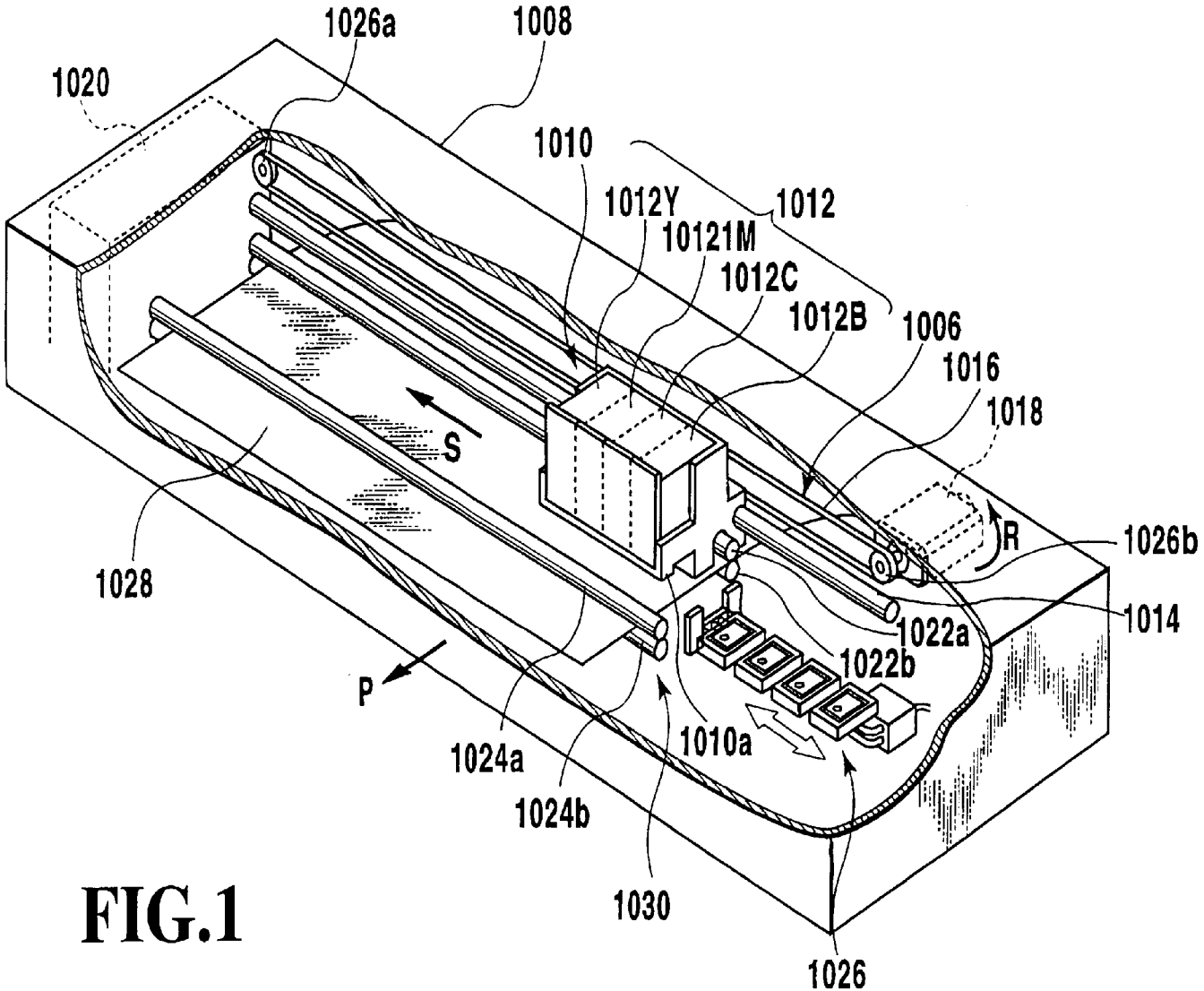
FIG. 1 is a schematic perspective view of the essential parts of an embodiment of an ink-jet printer that can carry the liquid ejection head of the present invention.

FIG. 1 is a schematic perspective view showing a liquid ejection head of the ejecting system according to the present invention wherein the bubble communicates with the atmosphere during the ejection and the essential parts of an embodiment of an ink-jet printer as liquid ejection apparatus using this head.

In FIG. 1, the ink-jet printer is composed of a transport device 1030 for intermittently transporting in a direction shown by the arrow P in FIG. 1 a paper 1028 as printing medium disposed longitudinally in a casing 1008, a printing section 1010 that moves reciprocally approximately parallel to a direction S substantially orthogonal to the transport direction P of the paper 1028 by the transport device 1030, and a scanning driving section 1006 as driving means for moving reciprocally the printing section 1010.

The transport device 1030 comprises a pair of roller units 1022*a* and 1022*b* disposed in opposition and approximately parallel to each other, a pair of roller units 1024*a* and 1024*b*, and a driving section 1020 for driving these respective roller units. When the driving section 1020 is active, this allows the intermittent transport of the paper 1028 pinched by the respective roller unit 1022*a* and 1022*b*, and roller unit 1024*a* and 1024*b* in the arrow P direction shown in FIG. 1.

The scanning driving section 1006 is composed of an electric motor 1018 for driving in the normal direction and in the reverse direction a belt 1016 wound around pulleys 1026*a* and 1026*b* arranged on the rotation shaft disposed in opposition with a predetermined interval, and a belt 1016 arranged approximately parallel to the roller units 1022*a* and 1022*b* and linked to a carriage member 1010*a* of the printing section 1010.

When the electric motor 1018 is active and the belt 1016 rotates in the arrow R direction in FIG. 1, the carriage member 1010*a* of the printing section 1010 will be moved by a predetermined displacement amount in the arrow S direction in FIG. 1. When the electric motor 1018 is active and the belt 1016 rotates in the opposite direction of the arrow R direction in FIG. 1, the carriage member 1010*a* of the printing section 1010 will be moved by a predetermined displacement amount in the opposite direction of the arrow S direction in FIG. 1. A recovery unit 1026 for performing the ejection recovery treatment of the printing section 1010 is disposed in opposition to the ink ejection array of the printing section 1010, at a position corresponding to the home position of the carriage member 1010*a*, on one end section of the scanning driving section 1006.

The printing section 1010 comprises ink-jet cartridges (individually called sometimes simply "cartridge", hereinafter) 1012Y, 1012M, 1012C, 1012B for each color, for example, for yellow, magenta, cyan, and black respectively, disposed detachably on the carriage member 1010*a*.

Figure 2:
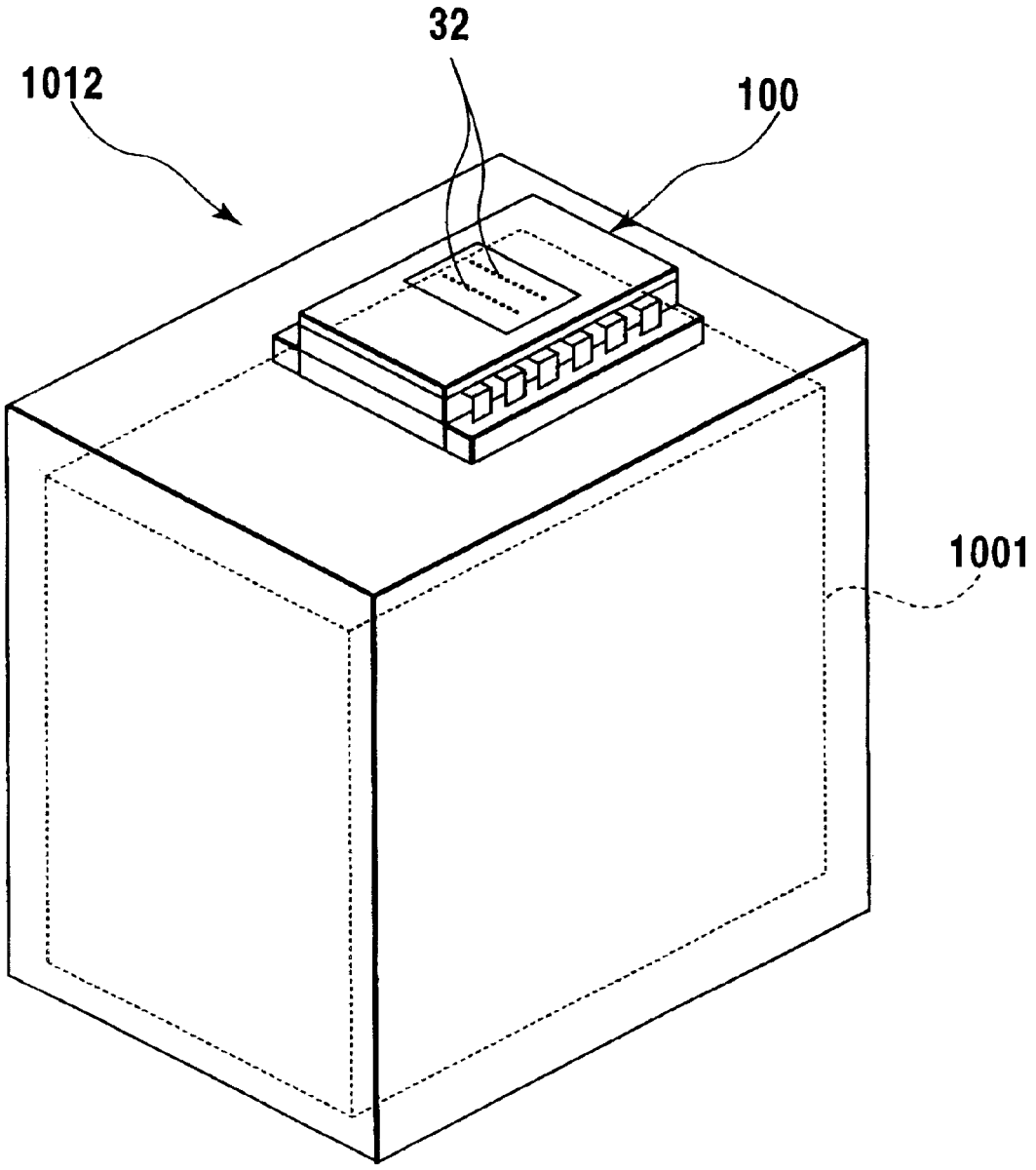
FIG. 2 is a schematic perspective view of an embodiment of an ink-jet cartridge provided with the liquid ejection head of the present invention.

FIG. 2 shows an embodiment of an ink-jet cartridge that can be attached on the aforementioned ink-jet printing apparatus. In this embodiment, the cartridge 1012 is of the serial type, and its essential part is composed of an ink-jet printing head 100 and a liquid tank 1001 for containing ink or other liquid. The ink-jet printing head 100 comprises a number of ejection openings 32 that are formed to eject liquid, and ink or other liquid is conducted to a common liquid chamber (refer to FIG. 3) of the liquid ejection head 100 from a liquid tank 1001 to a not-shown liquid supply passage. In this embodiment, the cartridge 1012 forms integrally the ink-jet printing head 100 and the liquid tank 1001, making it possible to supply the liquid tanks 1001 with liquid as necessary; however, a structure wherein the liquid tank 1001 is exchangeably mounted to this liquid ejection head 100 may well be adopted.

Many embodiments of the aforementioned liquid ejection head that can be attached on the ink-jet printer of such composition now will be explained in the following embodiments 1 to 5.

First Embodiment

Figure 3:
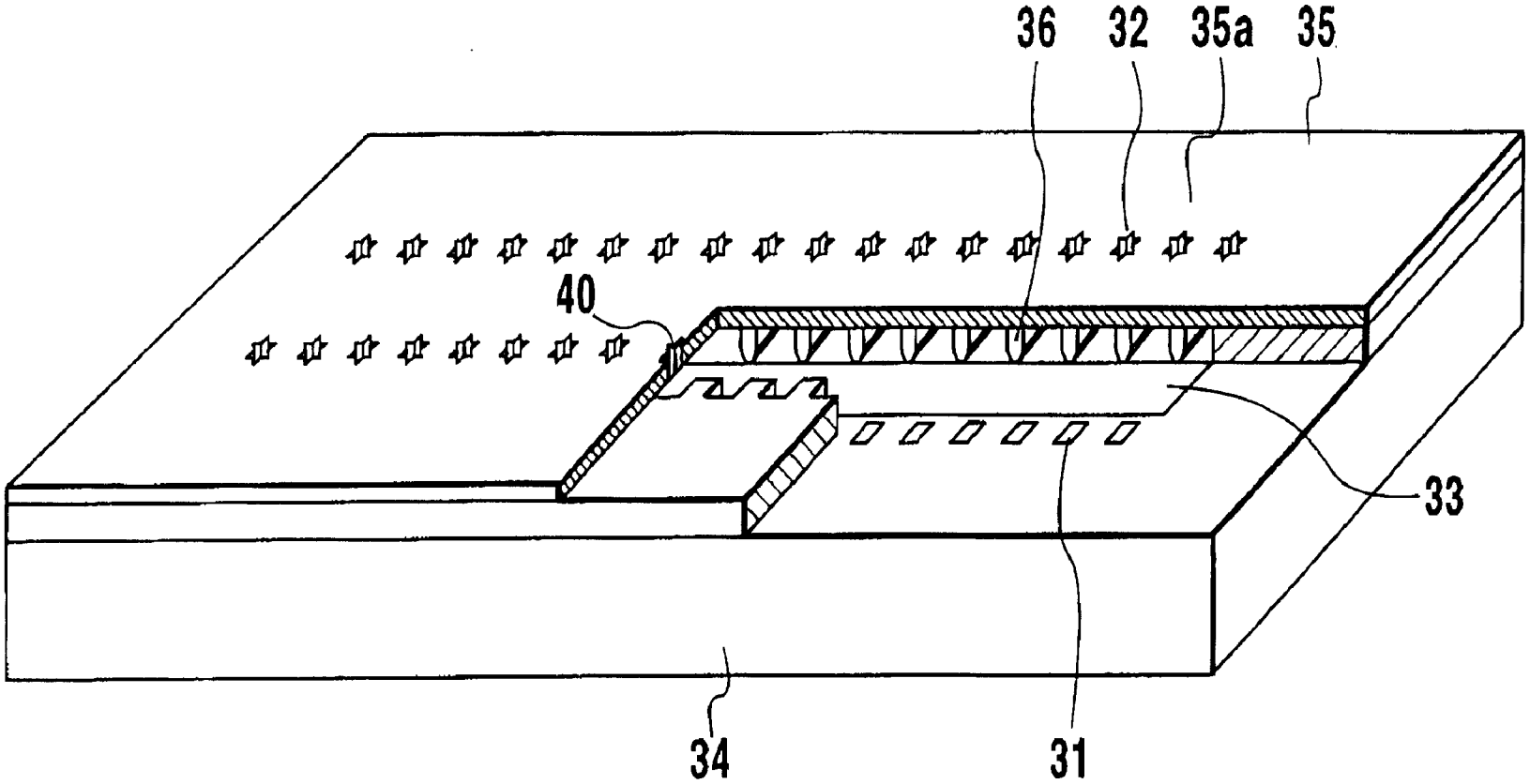
FIG. 3 is a schematic perspective view of the essential part of an embodiment of an ink-jet printer that can carry the liquid ejection head of the present invention.

FIG. 3 is a schematic perspective view of the essential part of an ink-jet printer showing a basic embodiment of the present invention, and FIGS. 4–7 are front views showing the shape of the ejection opening shown in FIG. 3. Electric wiring or the like for driving the electrothermal converting element will be omitted.

In the liquid ejection head of this embodiment, a substrate 34 made of glass, ceramic, plastic or metal or the like, as shown in FIG. 3 for example, is employed. The material of such substrate is not essential to the present invention, and is not especially specified, provided that it can function as a part of the passage composition member, and function as support of the material layer forming the ink ejection energy generating element and liquid passage ejection opening mentioned below. In this embodiment, a case wherein the silicon substrate (wafer) is used will be explained. In addition to the laser beam forming method, the ejection opening may be formed by a exposure apparatus such as MPA (Mirror projection Aligner) or others, for example, using a orifice plate (ejection opening plate) 35 mentioned below as photosensitive resin (refer to FIGS. 73–78).

In FIG. 3, 34 designates a substrate comprising an electrothermal converting element (called sometimes "heater", hereinafter) 31 and an ink supply port 33 composed of a long groove-shaped through-port as common liquid chamber, and respectively one row of heaters 31 as thermal energy generation means are arranged in zigzag fashion longitudinally on both sides of the ink supply port 33, the interval of electrothermal converting elements being 300 dpi. An ink passage wall 36 is disposed for forming an ink passage on this substrate 34. An ejection opening plate 35 provided with an ejection opening 32 is further disposed on this ink passage wall 36.

Though the ink passage wall 36 and the ejection opening plate 35 are shown as separate members in FIG. 3, the ink passage wall 36 and the ejection opening plate 35 can be formed as a single member by forming this ink passage wall 36 on the substrate by a process such as spin coating or the like. In this embodiment, the surface 35*a* side of the ejection opening plate 35 is finished so as to be water-repellent.

In this embodiment, a serial type head is used for printing with 1200 dpi by scanning in the arrow S direction in FIG. 1. Since the driving frequency is 10 kHz, a single ejection opening will eject ink with a minimum time interval of 100 $\mu$s.

Figure 4:
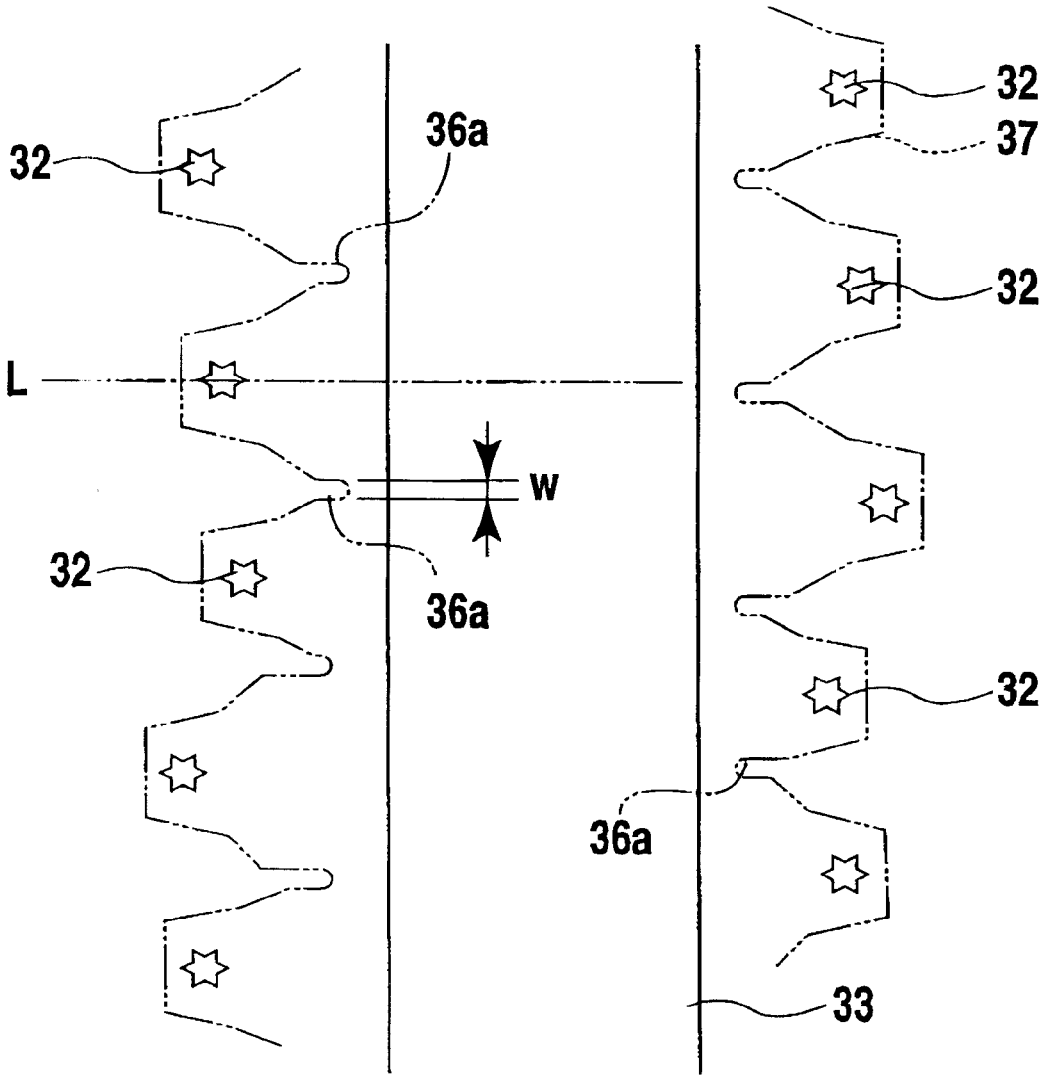
FIG. 4 is a conceptual drawing extracting a part of the liquid ejection head of the first embodiment of the present invention.
Figure 7:
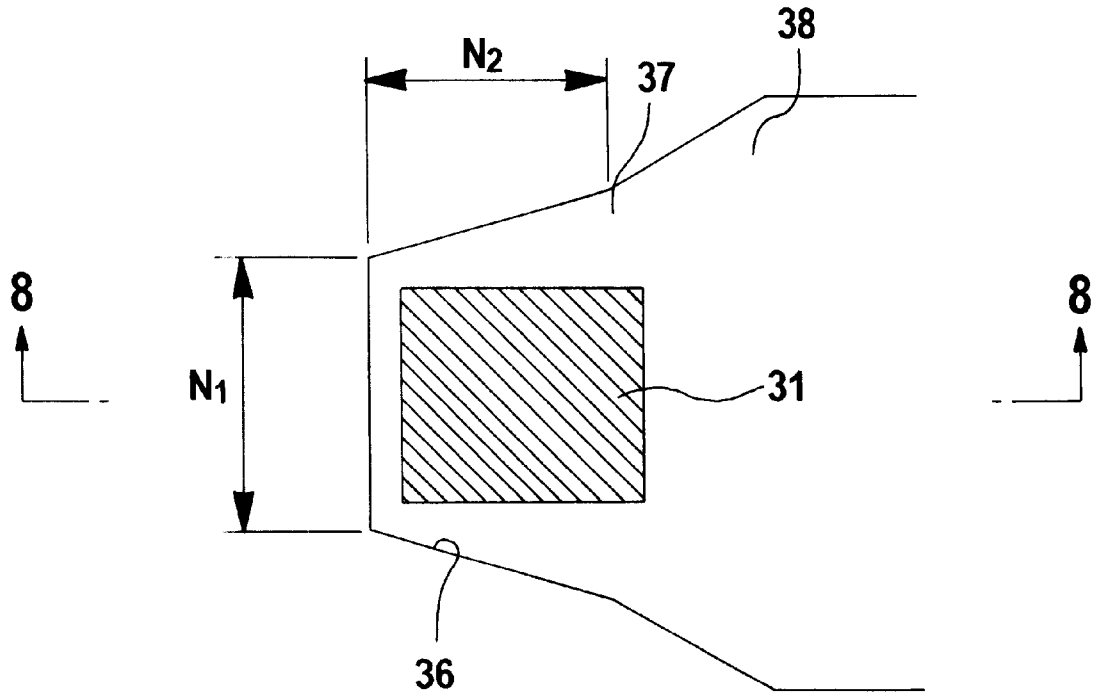
FIG. 7 is a typical view of the essential part in the embodiment shown in FIG. 4.

As shown in FIG. 4, the width of a partition 36*a* hydraulically isolating adjacent nozzles is equal to 14 $\mu$m. As shown in FIG. 7, for a bubble generation chamber 37 defined by the ink passage wall 36, $N_1$=33 $\mu$m, $N_2$=35 $\mu$m. The heater 31 is dimensioned to 30 $\mu$m×30 $\mu$m, the heater 5 resistance value 53 Ω, and the driving voltage 10.3 V. The ink passage wall 36 and the partition 36*a* are 12 $\mu$m high, and the ejection opening plate 11 $\mu$m thick. For printing inks, those having a viscosity of 2.5 cp at surface tensions of 30, 35, 40, 45 dyn/cm, are preferred.

Of the sections of the ejection opening 40 provided on the ejection opening plate including the ejection opening 32, the shape of the section cut in a direction crossing with the ink ejecting direction (thickness direction of the orifice plate 35) is approximately star-shaped, and composed substantially of 6 convex sections 32 a having an obtuse angle, and 6 concave sections 32*b* disposed alternately between these convex sections 32*a* and having an acute angle. In other words, 6 grooves 41 are defined in the thickness direction (liquid ejecting direction) of the orifice plate shown in FIG. 3, taking the concave section 32*b* corresponding to an area locally remote form the center O of the ejection opening as its top, and the convex section 32*a* corresponding to an area locally near the center O of the ejection opening adjacent to this area as its base.

Figure 5:
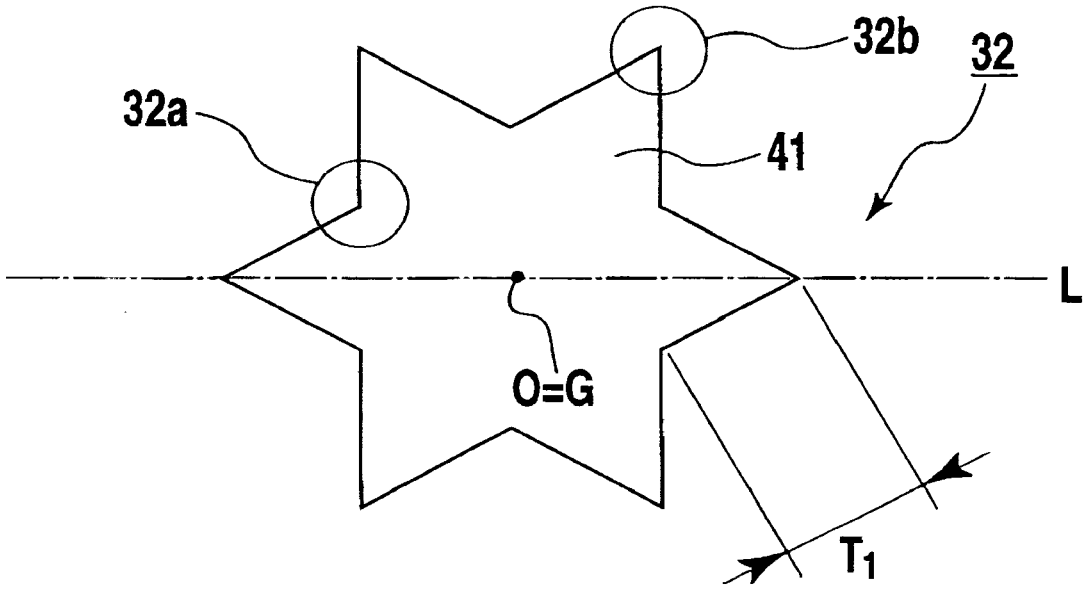
FIG. 5 is an enlarged view of a part of the liquid ejection head shown in FIG. 4.

In this embodiment, the section of the ejection opening 40 cut in the direction crossing its thickness direction has a shape composed of two equilateral triangles, 27 $\mu$m each side, rotated by 60 degrees, and $T_1$ shown in FIG. 5 is equal to 8 $\mu$m. All angles of convex sections 32*a* are equal to 120 degrees, while all angles of concave sections 32*b* equal 60 degrees. Therefore, the center O of the ejection opening will accord with the gravity center G of a polygon defined by connecting the center portions of mutually adjacent grooves (center (gravity center) of a geometry defined by connecting the groove top and two bases adjacent to the top). In this embodiment, the opening area of the ejection opening 32 is 400 $\mu m^2$, and the groove section opening area (area of the geometry defined by connecting the groove top and two bases adjacent to the top) is about 33 $\mu m^2$ per groove.

The liquid ejecting operation by the ink-jet printing head of this embodiment according to the aforementioned arrangement now will be explained referring to FIGS. 8–15.

Figure 8:
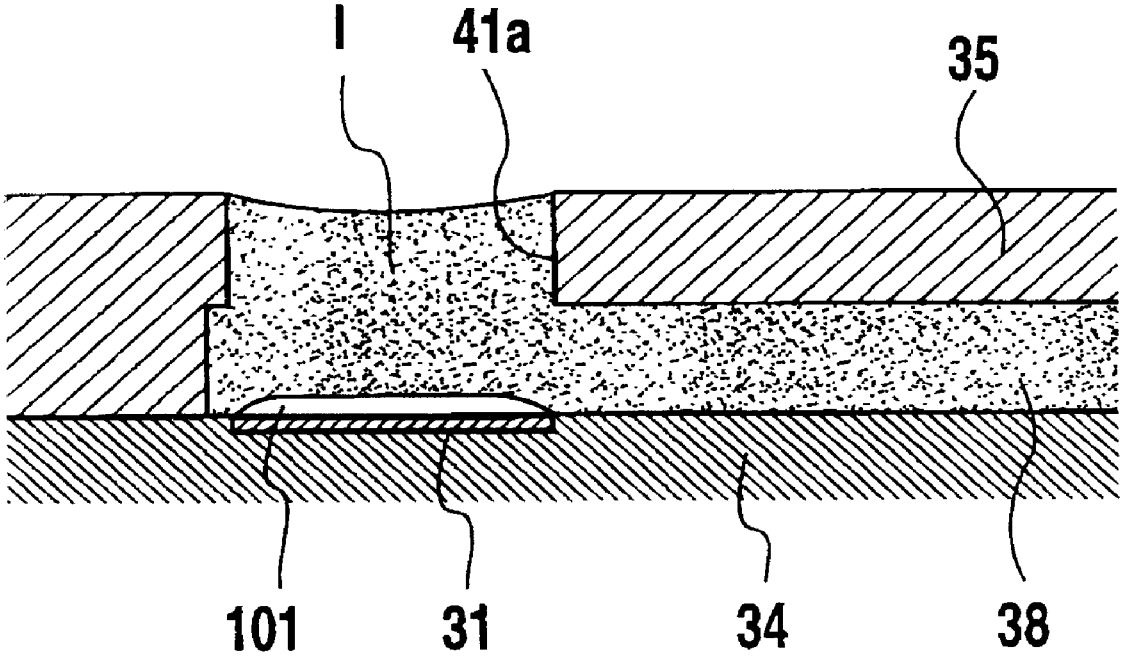
FIG. 8, corresponding to the shape of the cross section 8—8 in FIG. 7, is a schematic cross section for chronically illustrating the liquid ejecting operation of the liquid ejection head according to the first embodiment of the present invention with FIGS. 9–15.
Figure 9:
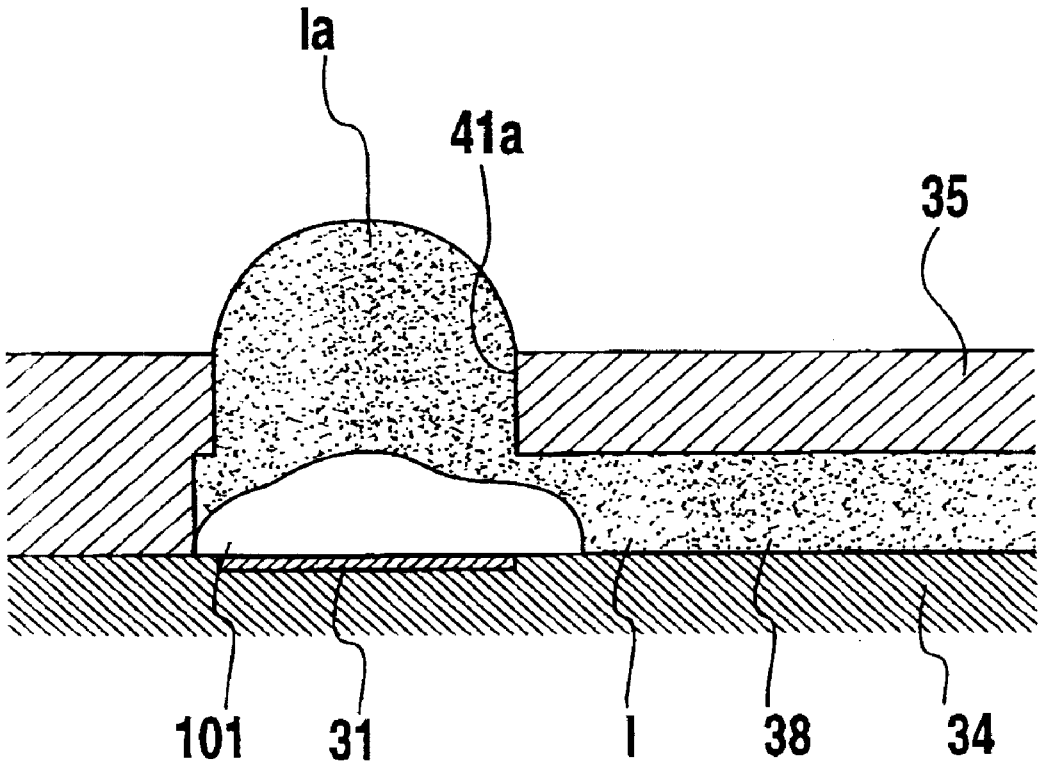
FIG. 9, corresponding to the shape of the cross section 8—8 in FIG. 7, is a schematic cross section for chronically illustrating the liquid ejecting operation of the liquid ejection head according to the first embodiment of the present invention with FIGS. 8 and 10–15.

FIGS. 8–15 are cross sections for illustrating the liquid ejecting operation of the liquid ejection head according to the first embodiment of the present invention, and correspond to the cross section 8—8 of the bubble generation chamber 37 shown in FIG. 7. In this cross-section, the end section in the thickness direction of the orifice plate of the ejection opening portion 40 corresponds to the top 41*a* of the groove 41. FIG. 8 shows a state wherein a film shape bubble is generated on the heater, and FIG. 9 shows the state about 1 $\mu$s after FIG. 8, FIG. 10 about 2 $\mu$s after FIG. 8, FIG. 11 about 3 $\mu$s after FIG. 8, FIG. 12 about 4 $\mu$s after FIG. 8, FIG. 13 about 5 $\mu$s after FIG. 8, FIG. 14 about 6 $\mu$s after FIG. 8, and FIG. 15 about 7 $\mu$s after FIG. 8 respectively. In the following, "eject," "fall" or "shoot", "drop" do not mean "fall in the gravity direction," but refer to movement towards the electrothermal converting element, independently of the head mounting direction.

Figure 10:
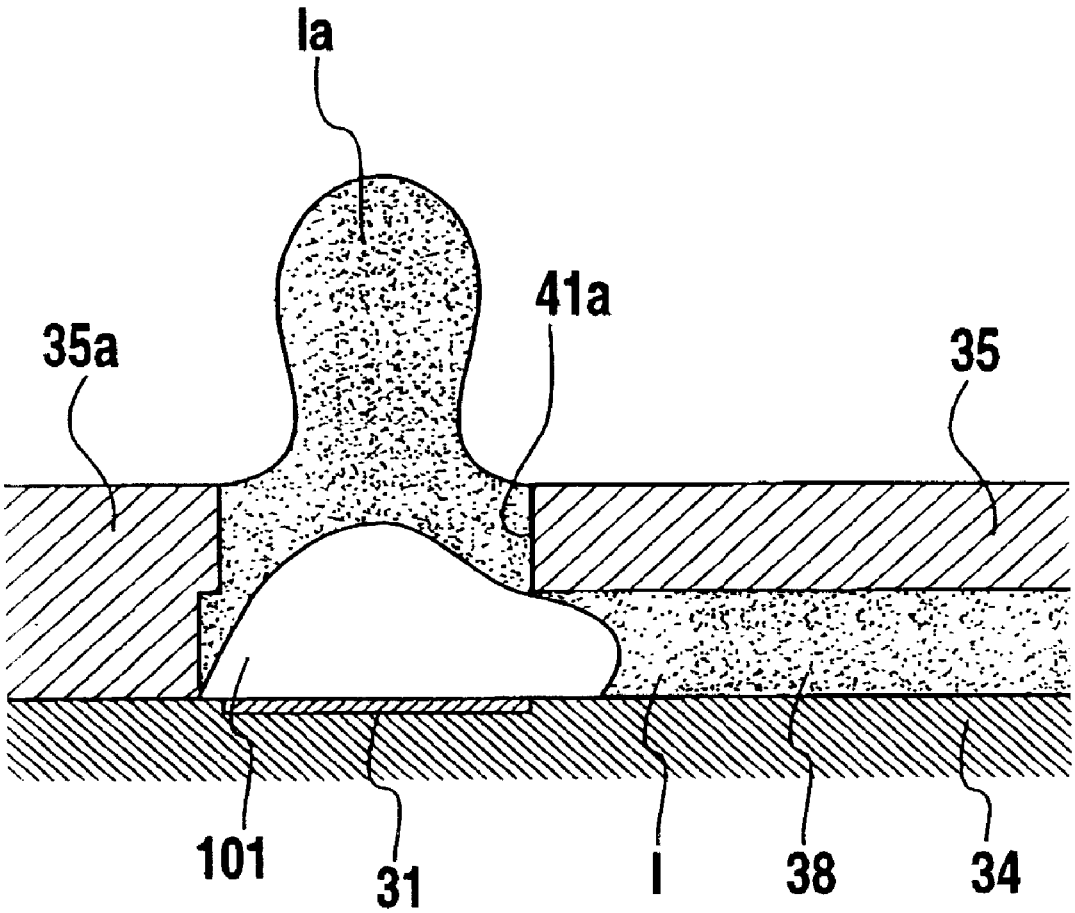
FIG. 10, corresponding to the shape of the cross section 8—8 in FIG. 7, is a schematic cross section for chronically illustrating the liquid ejecting operation of the liquid ejection head according to the first embodiment of the present invention with FIGS. 8, 9 and 11–15.
Figure 11:
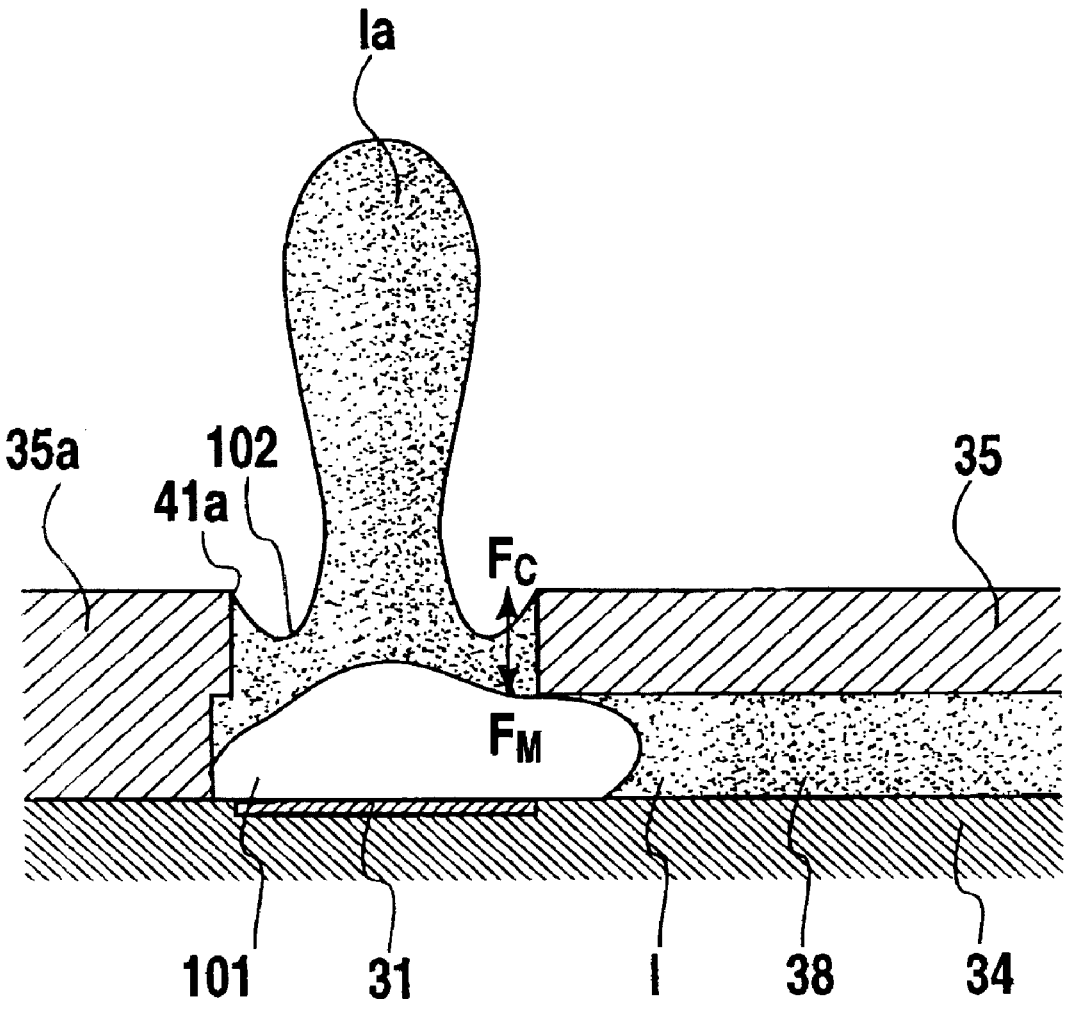
FIG. 11, corresponding to the shape of the cross section 8—8 in FIG. 7, is a schematic cross section for chronically illustrating the liquid ejecting operation of the liquid ejection head according to the first embodiment of the present invention with FIGS. 8–10 and 12–15.

First, as shown in FIG. 8, a bubble 101 is produced in a liquid passage 38 on a heater 31 when the heater is supplied with electricity following a printing signal or the like, and grows suddenly by volume expansion within about 2 9 s as shown in FIGS. 9 and 10. The height of the bubble 101 at maximum volume exceeds the ejection opening surface 35*a*, but at that time, the bubble pressure decreases up to some tenths or some hundredths of the atmospheric pressure. Next, about 2 $\mu$s after the generation of the bubble 101, the volume of the bubble 101 changes to decrease from its maximum, and substantially, the formation of a meniscus 102 starts. This meniscus 102 also retracts towards the heater 31 side, or falls as shown in FIG. 11. In this embodiment, wherein the ejection opening portion has a plurality of distributed grooves 41, the capillary force acts in a direction $F_C$ opposite to the meniscus retrogression direction $F_M$ in the portion of the groove 41. As the result, even when some variation of the state of the bubble 101 is observed, the shape of the meniscus and a main liquid droplet (called sometimes "liquid" or "ink", hereinafter) $I_a$ during the meniscus retrogression, will be corrected to become approximately symmetric to the ejection opening center.

Figure 12:
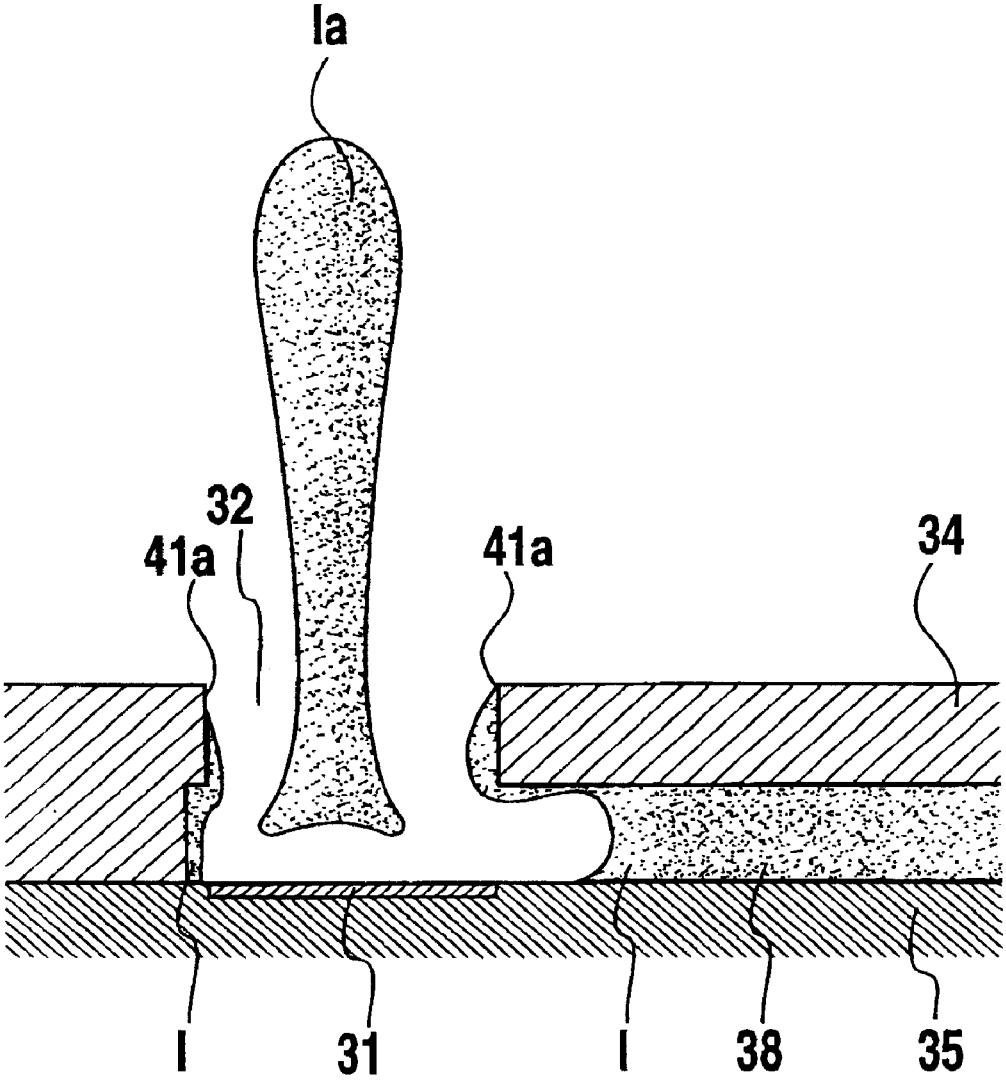
FIG. 12, corresponding to the shape of the cross section 8—8 in FIG. 7, is a schematic cross section for chronically illustrating the liquid ejecting operation of the liquid ejection head according to the first embodiment of the present invention with FIGS. 8–11 and 13–15.
Figure 13:
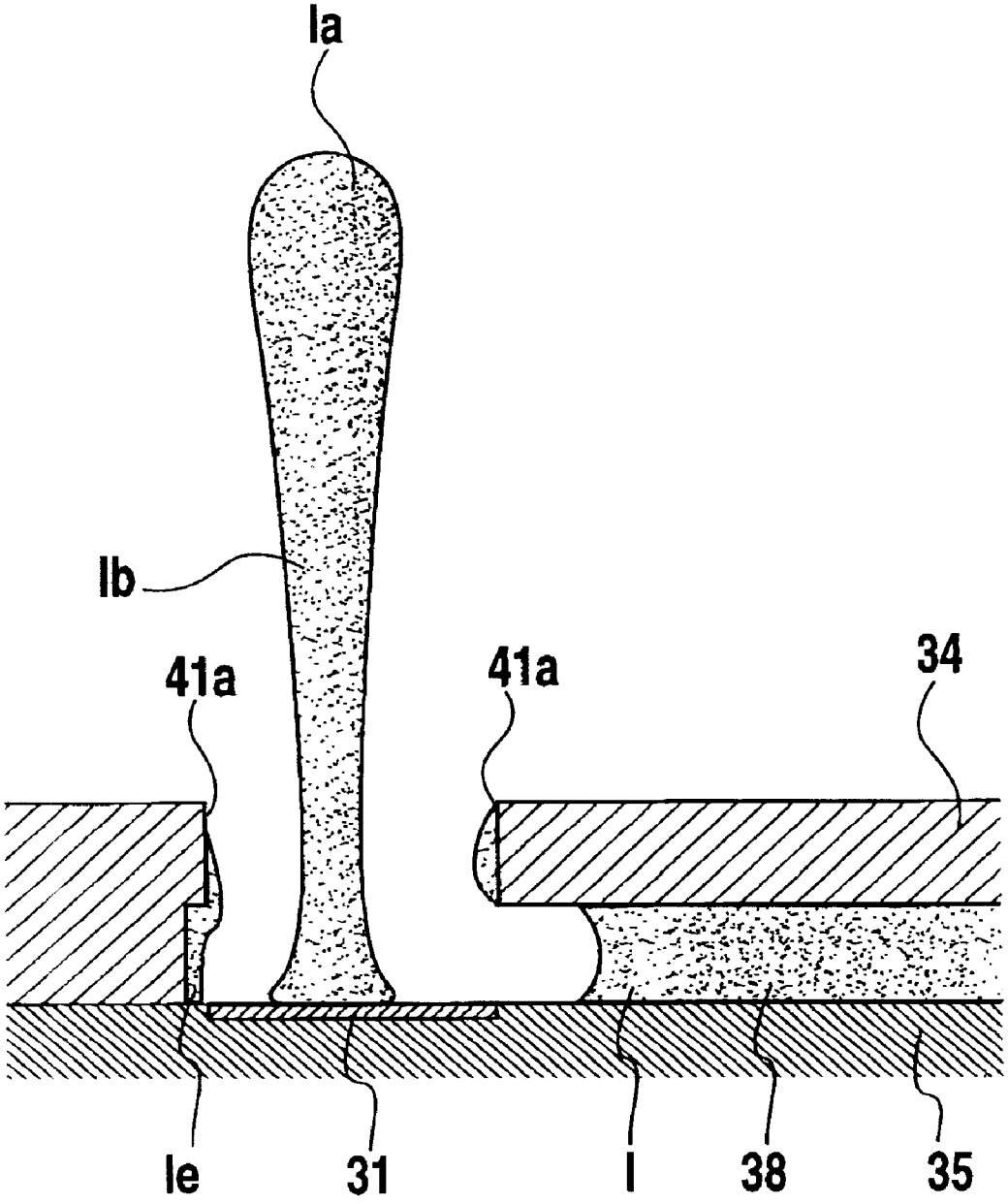
FIG. 13, corresponding to the shape of the cross section 8—8 in FIG. 7, is a schematic cross section for chronically illustrating the liquid ejecting operation of the liquid ejection head according to the first embodiment of the present invention with FIGS. 8–12, 14 and 15.
Figure 14:
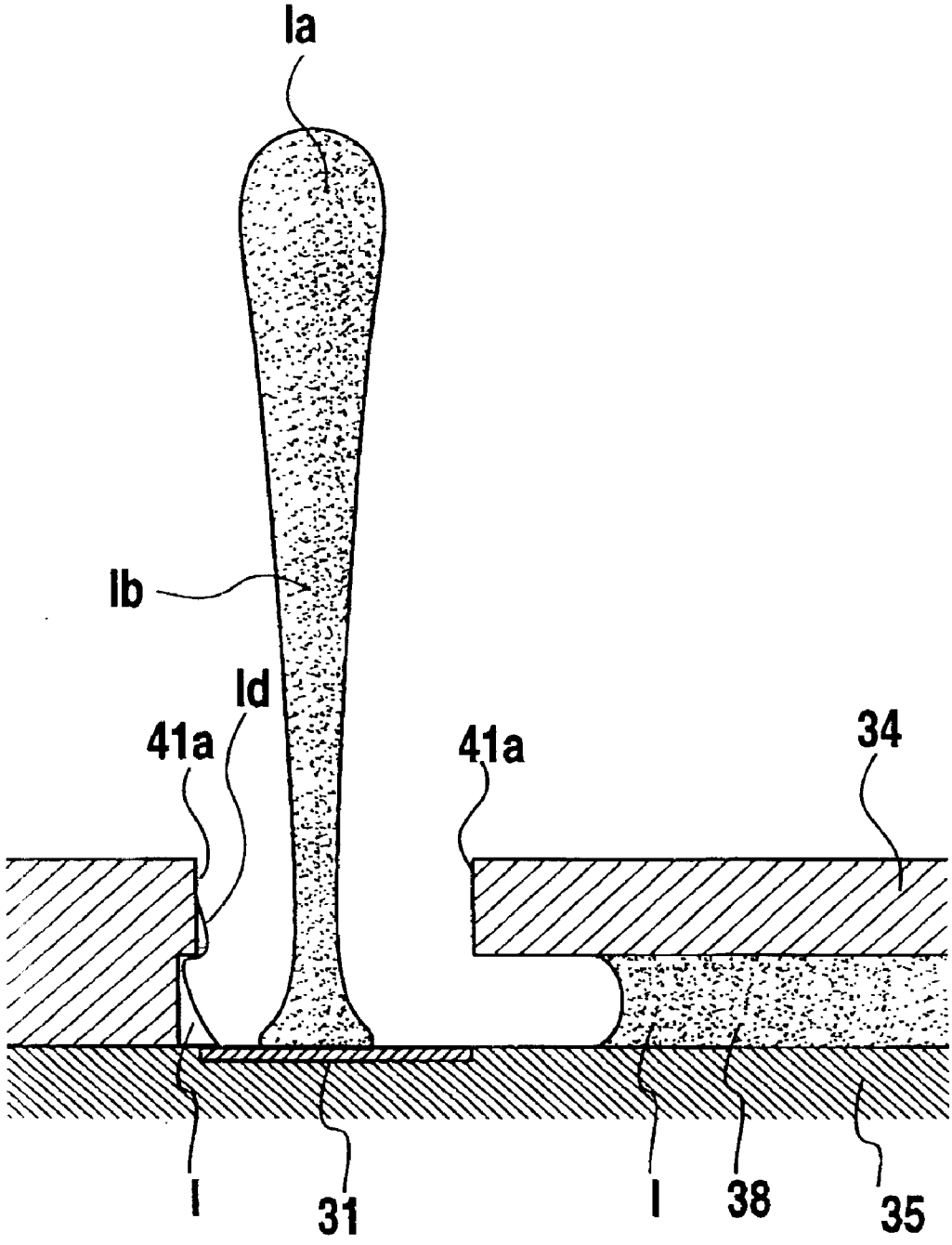
FIG. 14, corresponding to the shape of the cross section 8—8 in FIG. 7, is a schematic cross section for chronically illustrating the liquid ejecting operation of the liquid ejection head according to the first embodiment of the present invention with FIGS. 8–13 and 15.
Figure 15:
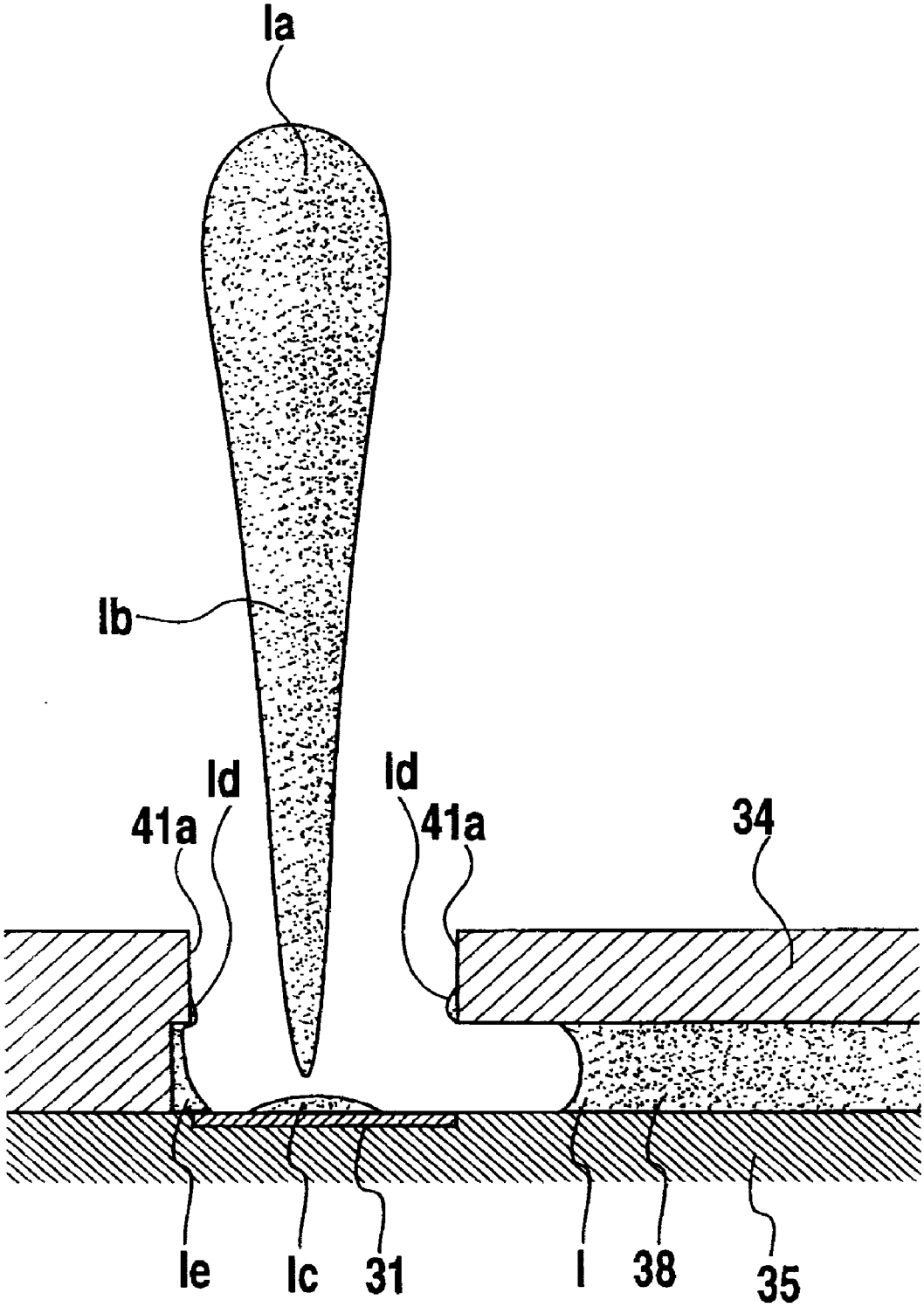
FIG. 15, corresponding to the shape of the cross section 8—8 in FIG. 7, is a schematic cross section for chronically illustrating the liquid ejecting operation of the liquid ejection head according to the first embodiment of the present invention with FIGS. 8–14.
Figure 16:
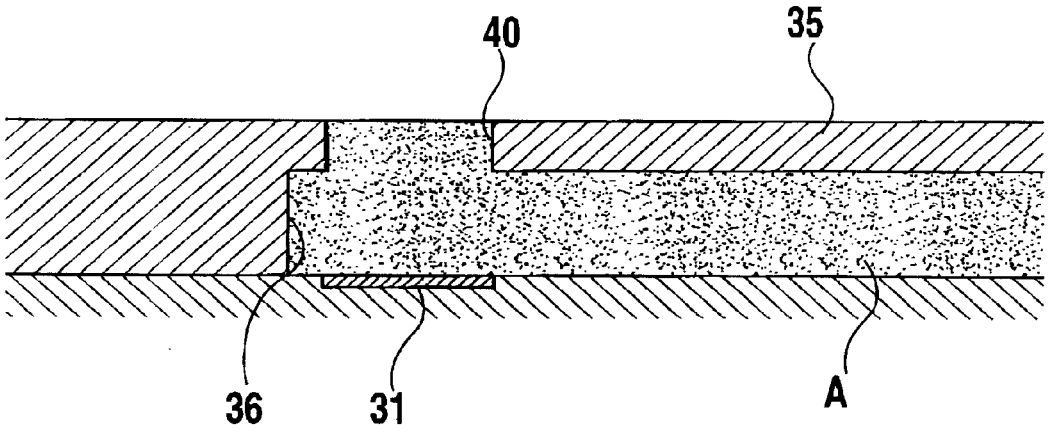
FIG.16 PRIOR ART
FIG. 16 is a schematic cross section for illustrating the accidental non-ejecting operation of the liquid ejection head according to the prior art with FIGS. 17–21.
Figure 17:
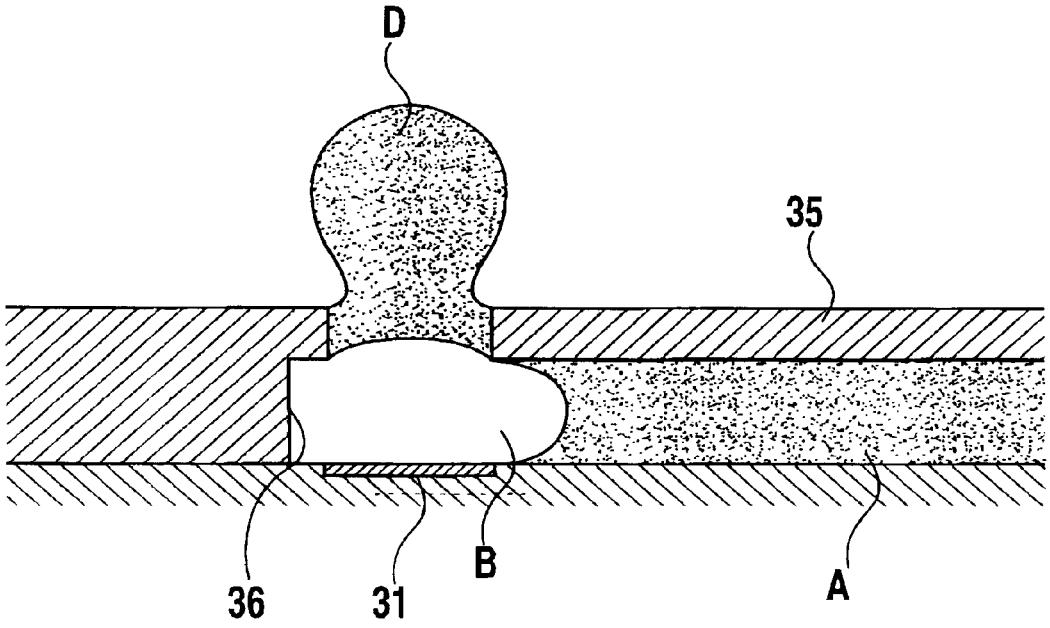
FIG.17 PRIOR ART
FIG. 17 is a schematic cross section for illustrating the accidental non-ejecting operation of the liquid ejection head according to the prior art with FIGS. 16 and 18–21.
Figure 18:
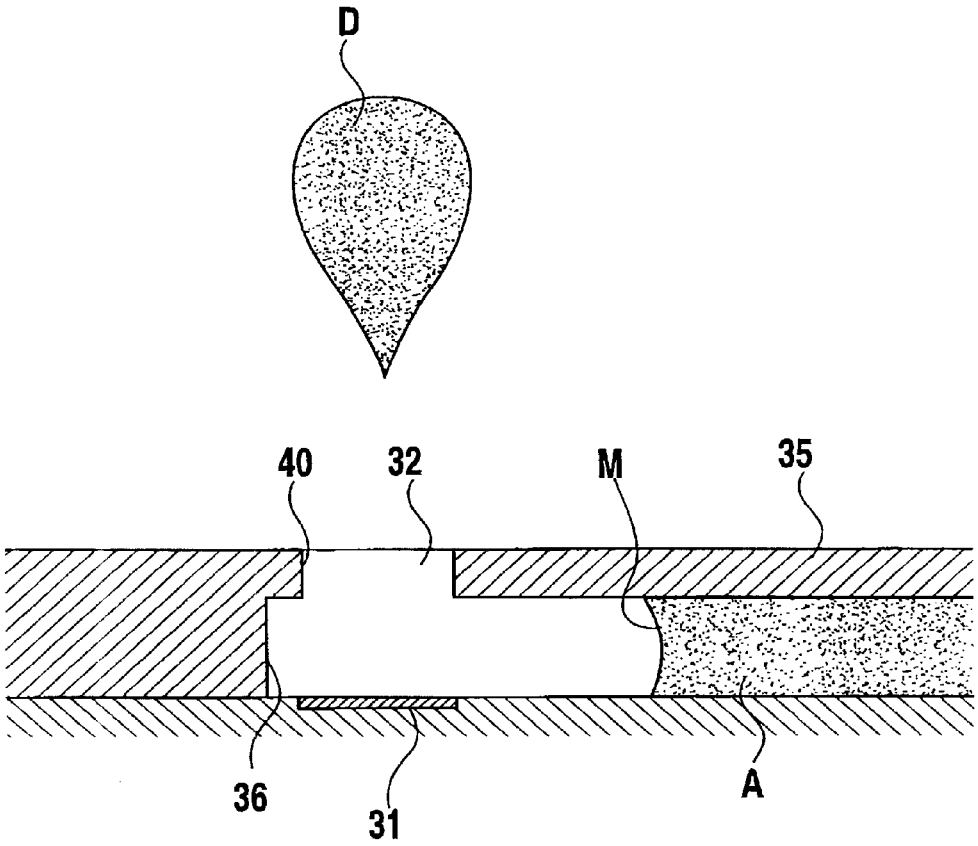
FIG.18 PRIOR ART
FIG. 18 is a schematic cross section for illustrating the accidental non-ejecting operation of the liquid ejection head according to the prior art with FIGS. 16, 17 and 19–21.

In this embodiment, the falling speed of this meniscus 102 being higher than the contraction speed of the bubble 101, the bubble 101 communicates with the atmosphere near the lower face of the ejection opening 0 about 4 9 s after the bubble generation as shown in FIG. 12. At this time, liquid (ink) near the central axis of the ejection opening 32 drops towards the heater 31. This is because the liquid (ink) $I_a$ brought back to the heater 31 side by the negative pressure of the bubble 101 before communicating with the atmosphere maintains its speed towards the heater 31 face by inertia even after the communication between the bubble 101 and the atmosphere has been effected. The liquid (ink) that has dropped toward the heater 31 side reaches the heater 31 surface about 5 $\mu$s after the bubble 101 generation as shown in FIG. 13, and extends covering the surface of the heater 31 as shown in FIG. 14. The liquid that has extended covering the surface of the heater 31 has a horizontal vector along the heater 31 surface, but a vector crossing the heater 31 surface, for example the vertical vector, disappears, and the liquid tends to remain on the heater 31 surface, with liquid trailing down from above it, namely liquid keeping the ejecting direction velocity vector. Thereafter, when liquid $I_b$ between the liquid extended over the heater 31 surface and the liquid (main liquid droplet) thereon becomes thinner, the liquid $I_b$ breaks at the center of the heater 31 surface about 7 $\mu$s after the bubble 101 generation, and the main liquid droplet $I_a$ keeping the ejecting direction velocity vector separates from the liquid $I_c$ extended over the heater 31 surface. The separation position is in the liquid passage 38, and preferably on the electrothermal converting element 31 side rather than on the ejection opening 32 side. The main liquid droplet $I_a$ is ejected from the center portion of the ejection opening 32 without ejecting direction deviation, nor ejection slippage, and hits the predetermined position on the printing surface of a printing media. The liquid $I_c$ extended over the heater 31 surface that would have conventionally been rejected as satellite droplets following the main liquid droplet, remains on the heater 31 surface and is not ejected. Such suppression of satellite droplet ejection allows one to prevent splashing that would easily occur due to satellite droplet ejection, and to reliably prevent surface pollution of the printing media in the form of fog.

The difference in hitting accuracy was examined for the liquid eject-printing head according to the aforementioned first embodiment of the present invention, and the printing head of the conventional ejection opening shape. The ejection opening shape of the conventional embodiment is a circle of 22.5 $\mu$m in diameter and a square of 20 $\mu$m each side. The printing pattern is 50% zigzag pattern, and 1 pass is recorded vertically on a printing medium of size A3. In case where the distance from the ejection opening to the paper is 1.6 mm, for the conventional printing head, the deviation from the ideal hitting position was 4.5 $\mu$m for the circular case, and 4.6 $\mu$m for the square shape case, while in this embodiment, it was reduced to 3.5 $\mu$m, improving the hitting accuracy.

The liquid ejection head of this embodiment, during liquid ejection in the volume reduction stage after the bubble has grown to its maximum volume, which embodiment has a plurality of grooves distributed in respect of the ejection opening center, allows one to stabilize the main liquid droplet direction during the eject. As the result, a liquid ejection head of high hitting accuracy, without slippage in the ejecting direction, can be supplied. Additionally, a high-speed high-resolution printing can be realized, by the capacity to perform a stable ejection against foaming variation under a high driving frequency.

Especially, as it can prevent mist from generating during droplet ejection through bubble communication with the atmosphere, by ejecting liquid through bubble communication with the atmosphere for the first time at the bubble volume reduction stage, the state where droplets deposited on the ejection opening surface cause an accidental non-eject mentioned below may also be suppressed.

The accidental non-eject prevention effect of the liquid ejection head according to this embodiment now will be explained referring to FIGS. 16–26.

Figure 19:
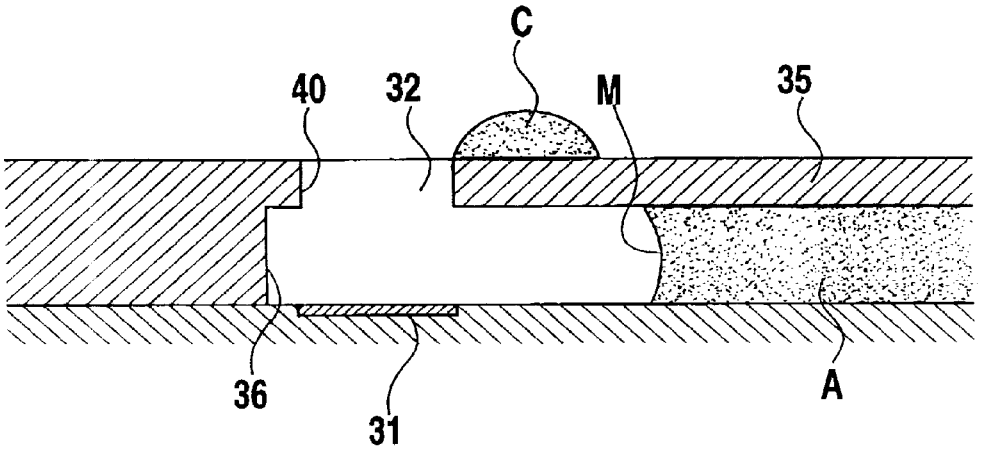
FIG.19 PRIOR ART
FIG. 19 is a schematic cross section for illustrating the accidental non-ejecting operation of the liquid ejection head according to the prior art with FIGS. 16–18, 20 and 21.
Figure 20:
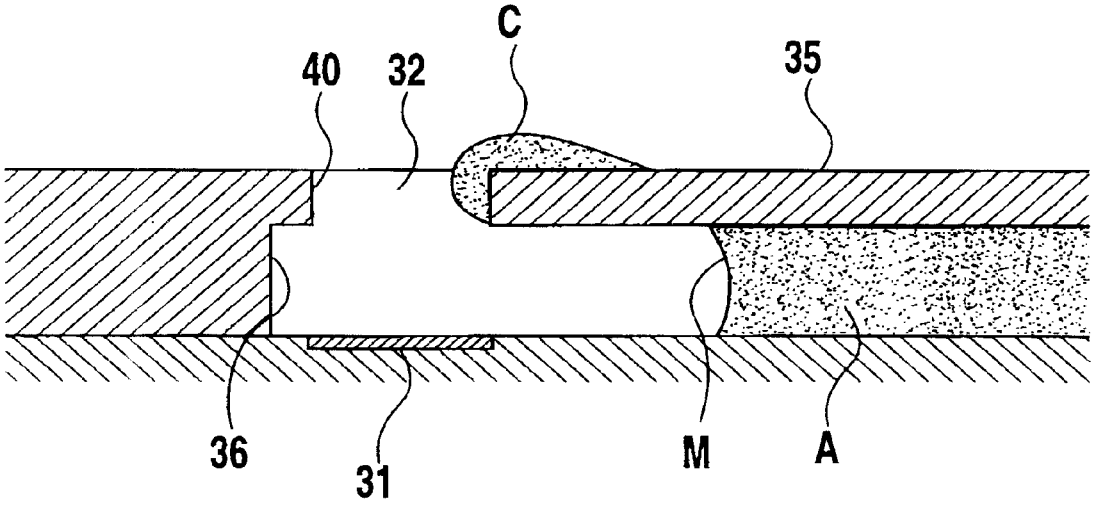
FIG.20 PRIOR ART
FIG. 20 is a schematic cross section for illustrating the accidental non-ejecting operation of the liquid ejection head according to the prior art with FIGS. 16–19 and 21.
Figure 21:
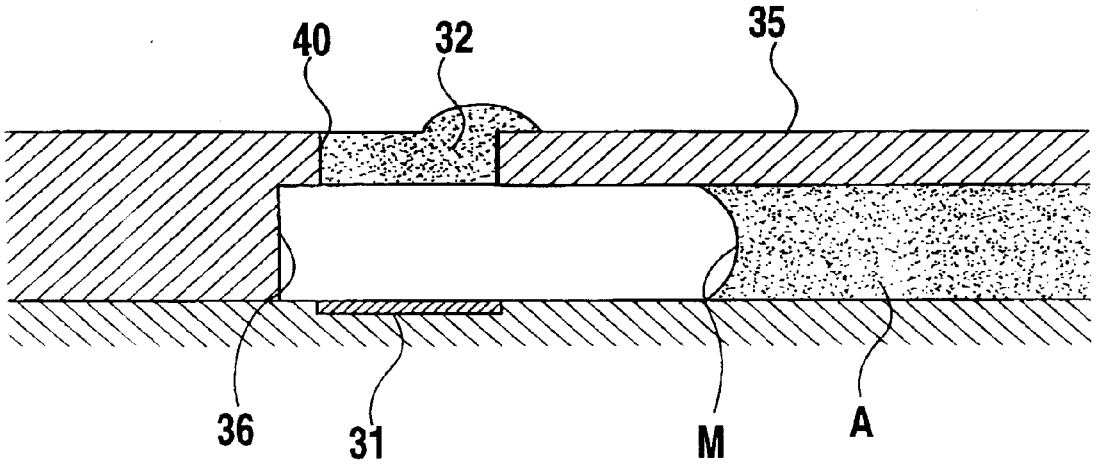
FIG.21 PRIOR ART
FIG. 21 is a schematic cross section for illustrating the accidental non-ejecting operation of the liquid ejection head according to the prior art with FIGS. 16–20.
Figure 22:
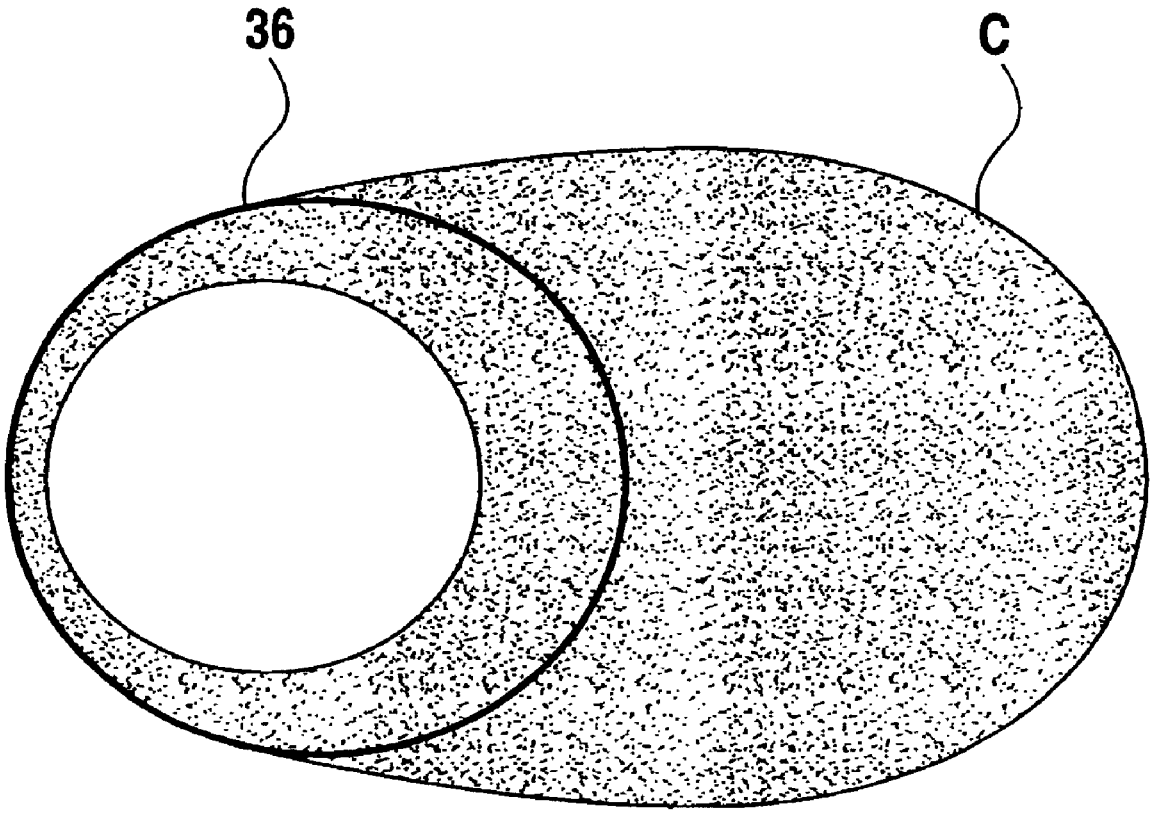
FIG. 22 is a typical view of the state of the ejection opening surface shown in FIG. 20.

FIGS. 16–26 are illustrative drawings for illustrating a so-called accidental non-eject state. This accidental non-eject is a phenomenon that may occur especially in the ejecting system wherein liquid is ejected through bubble communication with the atmosphere. In this system, as shown in FIGS. 16–21, ink A is foamed to generate a bubble B and eject an ink droplet D, leaving no ink A on the top face of the heater 31 (refer to FIGS.16–18). In the case where ink A is absent, or insufficient for droplet formation, on the top face of the heater 31 immediately after the ejection, if a meniscus M retrogresses and ink C adhering near the ejection opening portion 40 as shown in FIG. 19, before ink A be not refilled, ink C may move, as shown in FIGS. 20 and 22, top face view thereof, to cover the ejection opening outer periphery section and the adhering ink C may obstruct the ejection opening 32 (refer to FIG. 21). In this case, the adhering ink C cannot be trailed to the ink A side, nor can the obstruction of the ejection opening 32 by the adhering ink C be corrected by ejecting ink A on the heater 31.

Therefore, the obstruction of the ejection opening 32 can not be corrected except by waiting for the bubble B remaining in the bubble generation chamber 37 to be resolved into ink A, or by removing the obstruction due to the adhering ink C by means of recovery measures, or the like. The occurrence of accidental non-eject was examined for the printing head of the aforementioned conventional ejection opening shape, and the printing head according to the embodiment of the present invention. The results shown in Table 1 are obtained with 50% printing pattern and 1 pass printing on a vertical printing medium of size A3. Numerals in the table are the numbers of ejection openings where non-eject occurred. Non-eject has occurred with several ejection openings per plate for the conventional head, while there was no non-ejection for the ejection opening shape of this embodiment.

TABLE 1

| | Ink surface tension (dyn/cm) | | | |
|---|---|---|---|---|
| Ejection opening | 30 | 35 | 40 | 45 |
| Square | 14 | 11 | 11 | 12 |
| Circular | 7 | 4 | 5 | 4 |
| 1st Embodiment | 0 | 0 | 0 | 0 |

One of reasons why the accidental non-eject does not occur is believed to be the fact that, in the liquid ejection head of the present invention, when adhering ink E approaches the ejection opening 32 from the ejection opening surface (orifice plate surface 35*a*), the adhering ink E movement is suppressed by the meniscus force of the concave section 32*b*, namely groove 41. This phenomenon now will be explained further in detail referring to FIGS. 23–26. FIGS. 23–26 are illustrative drawings for illustrating in a timewise manner the state when adhering ink E approaches the ejection opening from the front surface, the suffix A indicates the ejection opening surface, while the suffix B indicated the cross section of the ejection opening portion. Ink in the liquid passage 38 is not shown in FIGS. 23–26 to illustrate mainly the effect of the shape of the ejection opening portion.

Figure 23A:
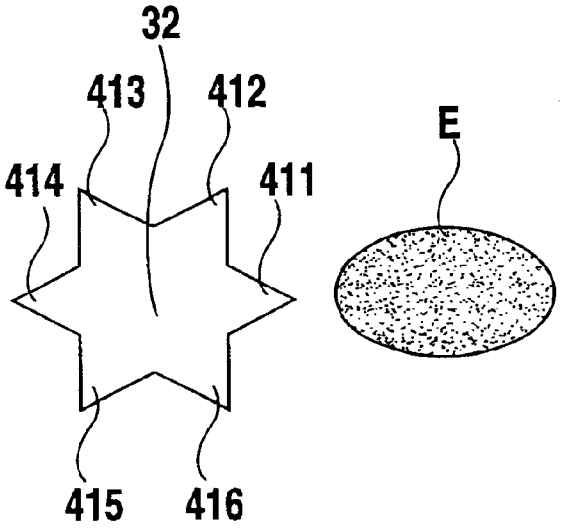
FIG. 23A is a typical view for chronically illustrating the movement of liquid droplets deposited on the ejection opening surface of the liquid ejection head according to the present invention with FIGS. 24–26.
Figure 23B:
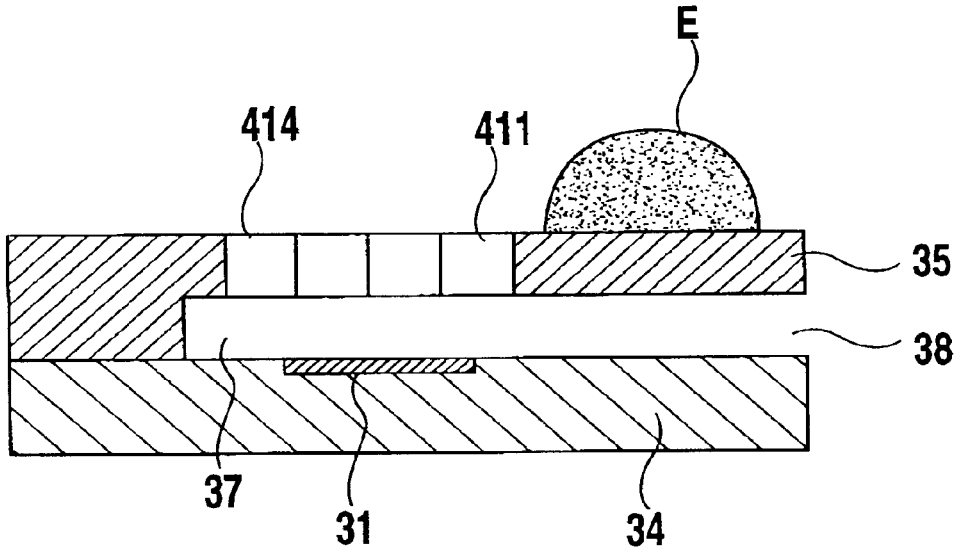
FIG. 23B is a schematic cross section thereof.
Figure 24A:
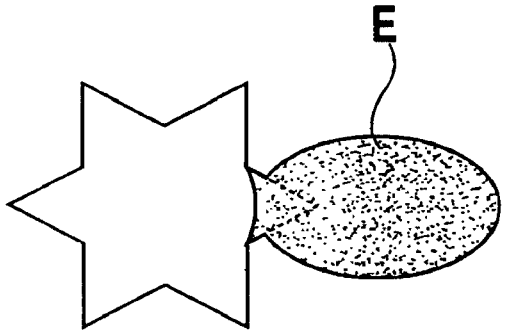
FIG. 24A is a typical view for chronically illustrating the movement of liquid droplets deposited on the ejection opening surface of the liquid ejection head according to the present invention with FIGS. 23, 25 and 26.
Figure 24B:
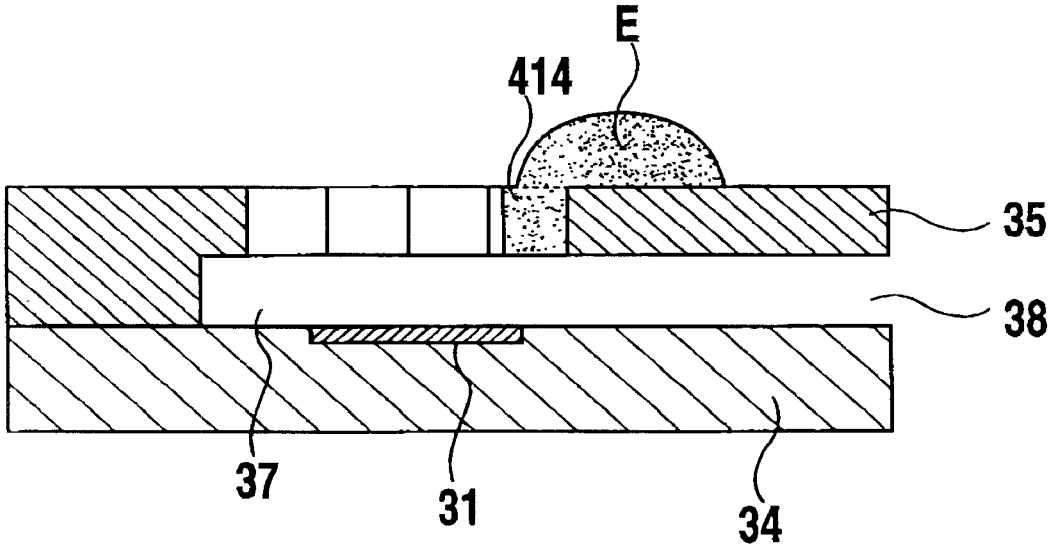
FIG. 24B is a schematic cross section thereof.
Figure 25A:
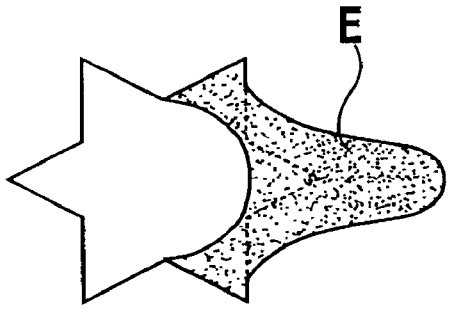
FIG. 25A is a typical view for chronically illustrating the movement of liquid droplet deposited on the ejection opening surface of the liquid ejection head according to the present invention with FIGS. 23, 24 and 26.
Figure 25B:
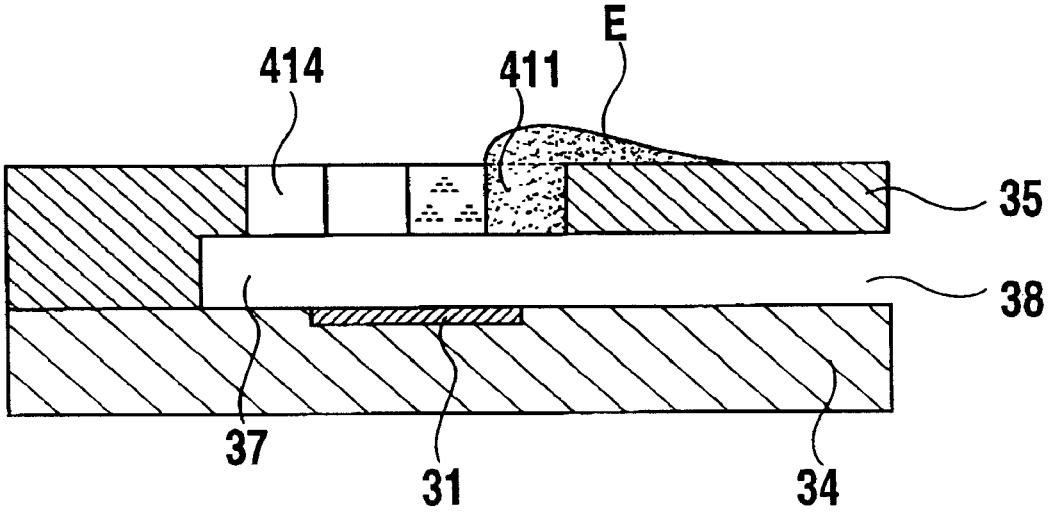
FIG. 25B is a schematic cross section thereof.
Figure 26A:
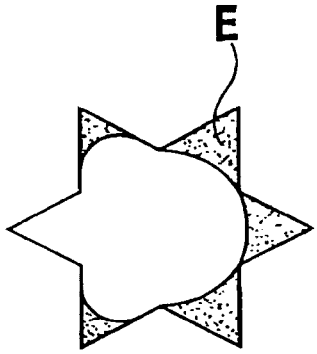
FIG. 26A is a typical view for chronically illustrating the movement of liquid droplet deposited on the ejection opening surface of the liquid ejection head according to the present invention with FIGS. 23–25.
Figure 26B:
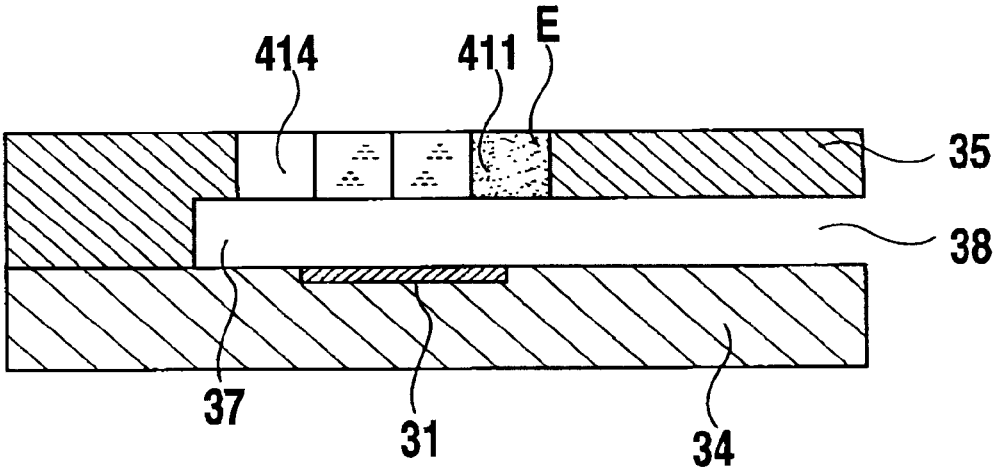
FIG. 26B is a schematic cross section thereof.

When adhering ink E (free ink) shown in FIGS. 23A and 23B tends to obstruct the ejection opening 32 for any reason, a part of the free ink is trailed into the groove section 411 with which the free ink E first came into contact as shown in FIGS. 24A and 24B. Thereafter, when the free ink E tends to move to cover the outer peripheral section of the ejection opening, as shown in FIGS. 25A and 25B, a part of free ink is trailed into the groove section also for the adjacent groove sections 412 and 416. Thereafter, when the free ink E further tends to move to cover the outer peripheral section of the ejection opening, as shown in FIGS. 26A and 26B, a part of the free ink is trailed into the groove section also for the groove sections 413 and 415 and, as a result, free ink E will not cover the outer peripheral section of the ejection opening. FIGS. 26A and 26B show the state where the free ink E is broken on the ejection opening surface without covering the outer peripheral section of the ejection opening.

The free ink is taken into the groove provided at the ejection opening portion, the free ink E movement is suppressed and the ejection opening surface is not obstructed with free ink. As the result, the accidental non-eject can be prevented effectively.

Figure 6:
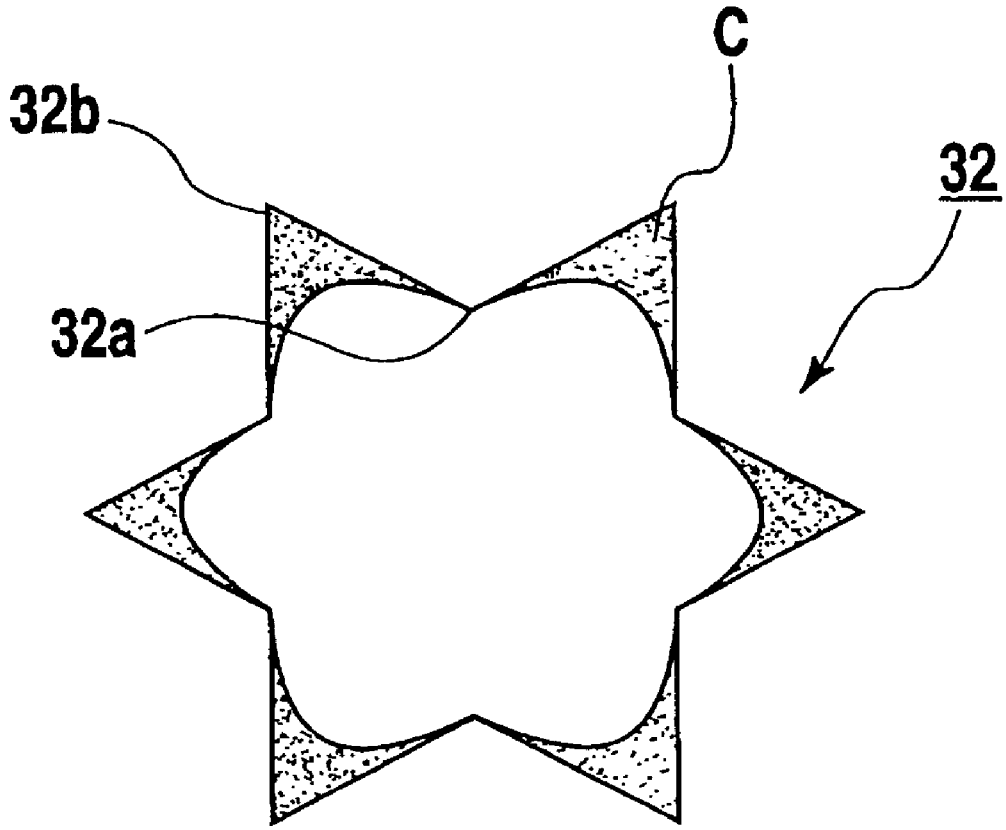
FIG. 6 is a typical view showing ink deposition state of a part of the liquid ejection head shown in FIG. 5.

Though FIGS. 23–26 schematically illustrate the function of the groove provided the ejection opening portion for the free ink E Actually, ink may remain in the groove section (ink remaining portions are hatched), as shown in FIG. 6 viewed from the ejection opening surface, by the ink $I_d$ attached to the groove section during the ejection step shown in FIGS. 8–15. As this remaining ink assists the action of the free ink E to enter the groove, by the contact with the free ink E when the free ink E tends to enter the groove, the existence of such ink is preferable for deploying the aforementioned effect.

Ink $I_c$ or $I_e$ remaining in the liquid passage in FIGS. 8–15, previously in contact with ink $I_d$ in the groove, does not allow the ink $I_d$ in the groove to be lifted up by the free ink E on the ejection opening surface, when the free ink E penetrates into the groove and communicates with the ink $I_d$ in the groove, but it facilitate the movement of the free ink E into the liquid passage. Similarly, though the refilled ink is not shown in FIGS. 23–26, such ink, being previously in contact with the ink $I_d$ in the groove, has the effect of facilitating movement of the free ink E into the liquid passage.

In this embodiment, as shown in FIGS. 4 and 5, six (6) grooves are disposed symmetrically with respect to the line L passing through the ejection opening center, from the liquid chamber (ink supply port) to the ejection opening. Such symmetrical disposition of grooves with respect to the liquid passage is desirable for further stabilization of the droplet ejecting direction. The top section of at least one of several grooves is disposed in the direction toward the liquid chamber. Such an arrangement is more desirable from the viewpoint of surer refill acceleration.

Second Embodiment

Figure 27:
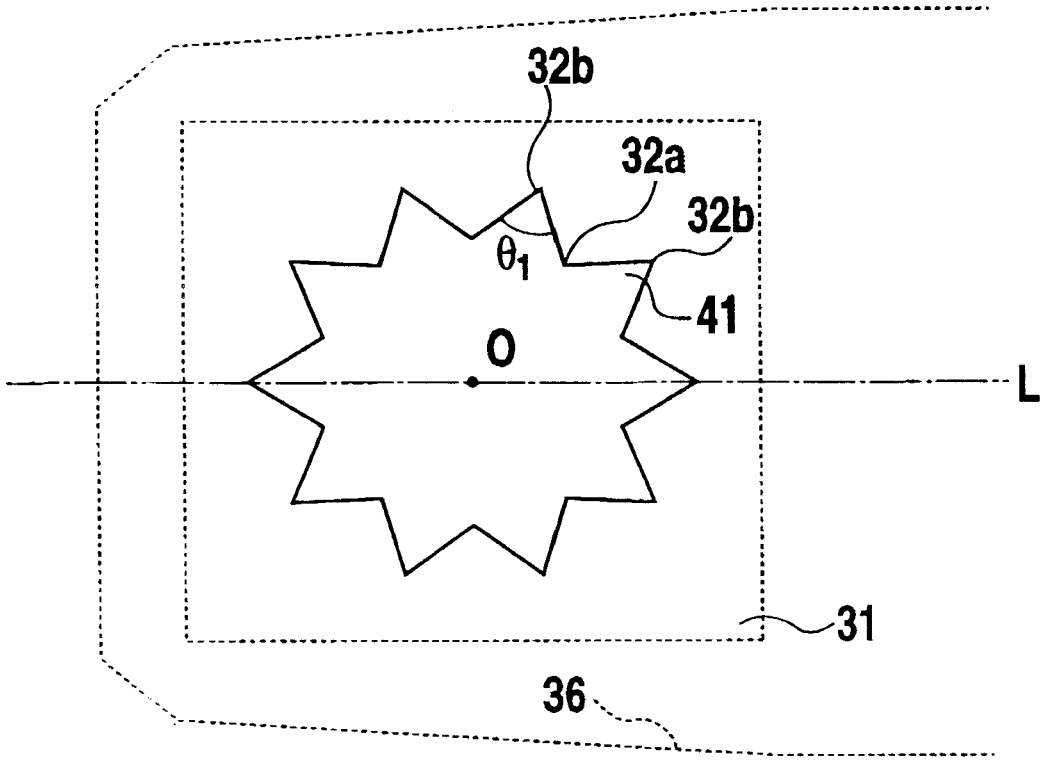
FIG. 27 is a conceptual drawing extracting and enlarging a part of the liquid ejection head of the second embodiment of the present invention.
Figure 28:
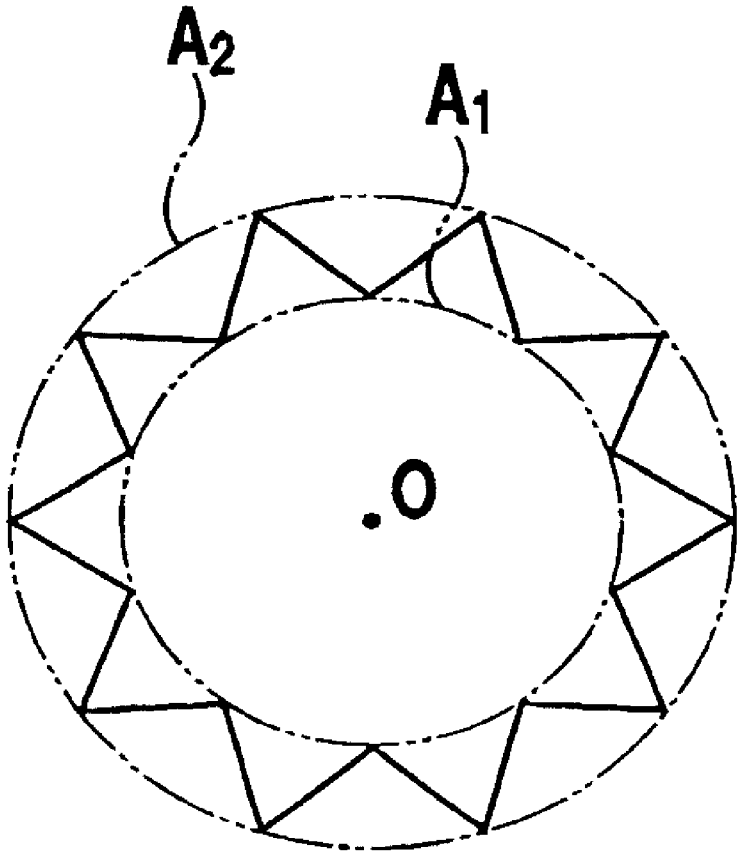
FIG. 28 is a typical view illustrating an inscribed circle and a circumscribed circle of the liquid ejection head shown in FIG. 27.
Figure 29:
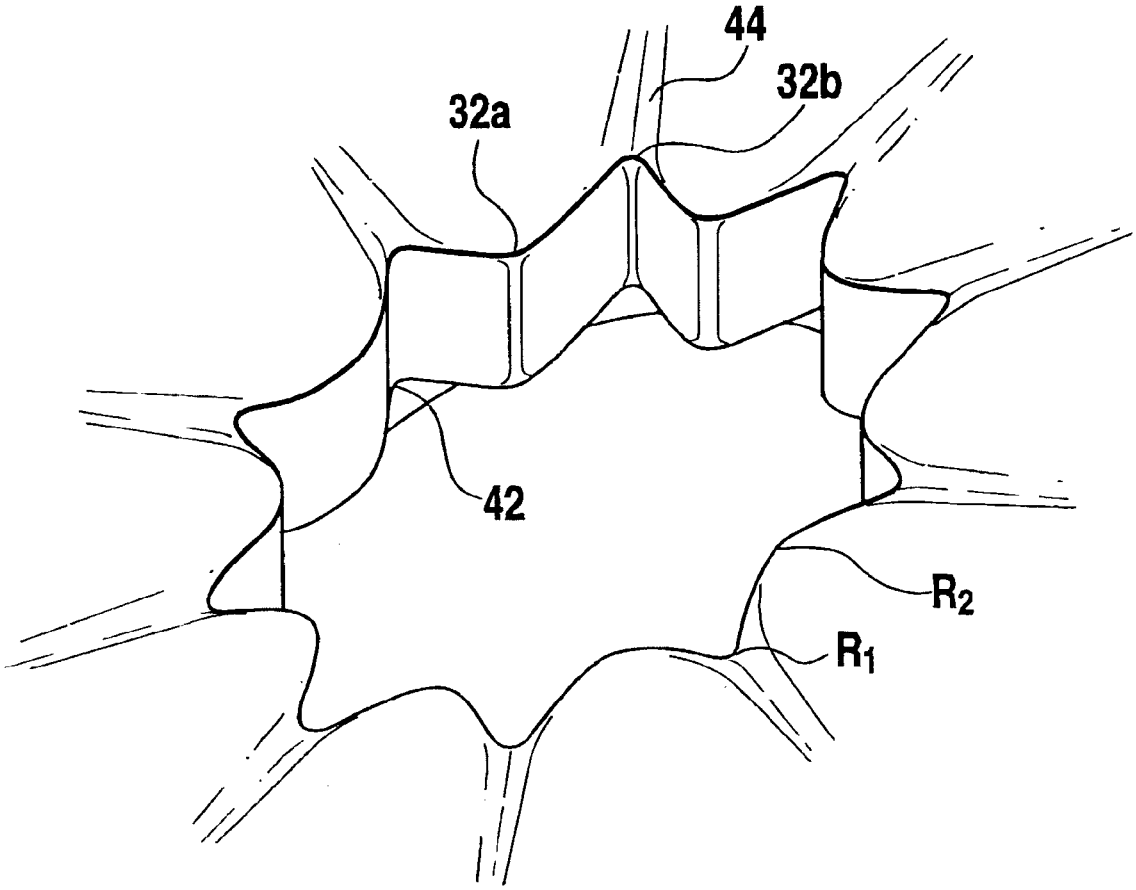
FIG. 29 is a perspective view of the ejection opening show in FIG. 27.

FIGS. 27–29 are illustrative drawings showing the essential part of the ejection opening of the liquid ejection head according to a second embodiment of the present invention. The composition of the liquid ejection head being similar to the aforementioned first embodiment, it will be omitted. This embodiment is different from the aforementioned first embodiment in the shape of the ejection opening and the ejection opening portion provided at the orifice port.

In this embodiment, as obviously shown in the typical view of FIG. 27, ten (10) grooves 41 are defined by ten (10) concave sections 32*b* respectively having mutually and substantially equal angles $\theta_1$, and ten (10) convex sections 32*a* formed therebetween. In this embodiment, as shown in FIG. 28, the diameter of an inscribed circle $A_1$ of the ejection opening defined by connecting the ejection opening inner sides of the convex section 32*a* is 13.4 $\mu$m, and the diameter of a circumscribed circle A2 of the ejection opening defined by connecting the portions most remote from the ejection opening (groove top) of the concave section 32*b* is 17.4 cm. The thickness of the orifice plate is 11 $\mu$m, as in the aforementioned first embodiment, and the opening area at the groove ejection opening surface is about 5 $\mu m^2$ per unit.

In FIG. 27, the broken line indicates the electrothermal converting element 31 and the ink passage wall 36, and in this embodiment also, similarly to the aforementioned first embodiment, these ten (10) grooves are disposed substantially symmetrically respect to the line L passing through the ejection opening center, from the liquid chamber (ink supply port) to the ejection opening.

In this embodiment, as the orifice plate is made of photosensitive resin, the corner portions of the convex section 32*a* and the concave section 32*b* have minute curved surfaces $R_1$ and $R_2$, as shown in the perspective view of FIG. 29. A small protrusion 42 is provided at the heat resistance element side end section of the ejection opening portion 41.

The manufacturing method of the liquid ejection head according to this embodiment now will be explained referring to FIGS. 73–78. FIGS. 73–78 are cross sections, arranged in the process order of the manufacturing method of the aforementioned liquid ejection head.

Figure 73:
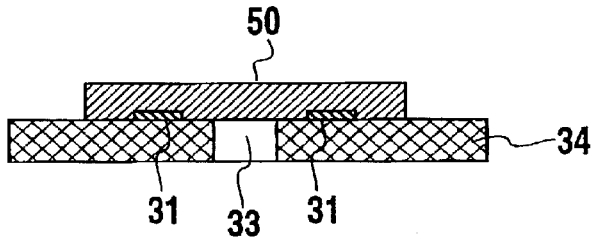
FIG. 73 is an illustrative view showing an embodiment of a manufacturing method of the printing head shown in FIG. 3, with FIGS. 74–78.

Firstly, a substrate 34 made of glass, ceramic, plastic or metal or the like, as shown in FIG. 73 for example, is prepared. Such substrate 34 can be used without restriction to the shape or material thereof, provided that it can function as a part of the passage composition member, and function as support of the material layer forming the ink ejection energy generating elements and the liquid passage ejection opening mentioned below. On the substrate, a desired number of ink ejection energy generating elements 31 such as electrothermal converting elements or piezoelectric elements or the like are disposed. Such an ink ejection energy generating element 31 supplies the ink with ejecting energy for ejecting printing liquid droplets and printing. When the electrothermal converting element is used as the ink ejection energy generating element 31 for example, this element heats the printing liquid in the proximity thereof, and causes a state change in the printing liquid, to generate ejection energy. When the piezoelectric element is used, the mechanical vibration of this element generates ejection energy. A control signal input electrode (not shown) is connected to these elements 31 to operate these elements. In general, various functional layers such as protection layers are deposited in order to improve the life of these ejection energy generating elements, and obviously, these functional layers may well be provided in the present invention.

FIG. 73 illustrates an embodiment wherein an opening section (ink supply port) 33 for ink supply is provided beforehand on the substrate 34 to supply the substrate 34 with ink from the rear. Any methods for forming the opening section 33 can be used, provided that it includes a means capable of forming a hole in the substrate 34. For example, it may well be formed by a drill or other mechanical means, or laser or other optical energy may well be used. A register pattern of the like may be formed on the substrate 34 to perform etching optically.

Next, as shown in FIG. 73, an ink passage forming section 50 is formed on the substrate 34 with soluble resin in such a way as to cover the ink ejection energy generating element 31. As the most general means, forming with photosensitive material can be used; however, it also can be formed using means such as screen printing method. If photosensitive material is used, as the ink passage forming section is soluble, a positive type resist, or soluble transformation type negative type resist, can be used.

Concerning the resist layer forming method, when a substrate on which an ink supply port is provided is used, it is preferable to dissolve the photosensitive material in a convenient solvent, apply it on a film such as PET (polyethylene terephthalate), dry it to create a dry film, and form by laminating. As the aforementioned dry film, vinylketone based degradable highly polymerized compounds such as polymethylisopropylketone, polyvinylketone or the like may preferably be used. This is because these compounds retain their properties (coating property) as highly polymerized compounds before optical irradiation, and can be laminated easily on the ink supply port 33.

Alternatively, the ink supply port 33 may be filled with filler that can be removed afterward, to form a coating by ordinary methods of spin coating or roll coating.

Figure 74:
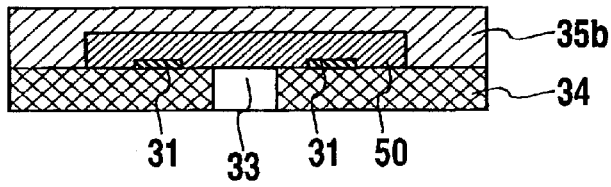
FIG. 74 is an illustrative view showing an embodiment of a manufacturing method of the printing head shown in FIG. 3, with FIGS. 73 and 75–78.

Once the ink passage is formed on the patterned soluble ink passage forming section 50, as shown in FIG. 74, an additional ejection opening plate forming layer 35*b* is formed by ordinary methods of spin coating, roll coating or the like. In the process wherein the ejection opening plate forming layer 35*b* is formed, such properties as the ability not to cause deformation of the soluble ink passage forming section or others are required. In other words, when the ejection opening plate forming layer 35*b* is dissolved in a solvent and formed on the soluble ink passage forming section 50 by spin coating, roll coating or the like, it is necessary to choose a solvent that will not dissolve the soluble ink passage forming section 50.

The ejection opening plate forming layer 35*b* will be explained. As ejection opening plate forming layer 35*b*, a photosensitive one is preferable, because it can form the ink ejection opening easily by lithography with a high precision. For such a photosensitive ejection opening plate forming layer 35*b*, high mechanical resistance as a structural material, adhesion to the substrate 34, ink resistance, and resolution for patterning the ink ejection opening fine pattern are required. It is found that cation polymer hardened material of epoxy resin presents excellent resistance, adhesion, and ink resistance as a structural material, and that if the epoxy resin is solid at the ambient temperature, it presents an excellent patterning property.

Having a reticulation density (high Tg) higher than the material hardened with the usual acid anhydride or amine, the cation polymer hardened material of epoxy resin presents excellent properties as a structural material. The use of epoxy resin solid at the ambient temperature, allows one to suppress the diffusion of polymerization initiation species generated from the cation polymerization initiator by the optical irradiation, and to obtain an excellent patterning precision and form.

In the process of forming a coating resin layer on the soluble resin layer, it is preferable to dissolved the coating resin that is solid at the ambient temperature, and to carry out formation by a spin coating method.

The use of a spin coating method, which is a thin film coating technique, permits the formation of the ejection opening plate forming layer 35*b* uniformly with a good accuracy, to shorten the distance (OH distance) between the ink ejection energy generating element 31 and the orifice, and to achieve minute droplet eject easily.

When the aforementioned so-called negative type photosensitive material is used as coating resin, usually reflection from the substrate face and scum (development scum) occur. However, in the present invention, as the ejection opening pattern is formed on the ink passage made of soluble resin, the effect of reflection from the substrate can be neglected, and the scum produced during the development does not have an adverse effect, as it is lifted off during the process for washing out soluble resin which forms the ink passage mentioned hereinafter.

Solid epoxy resins used for the present invention include those reaction products of bisphenol A and epichlorohydrin having molecular weight equal to or greater than 900, reaction products of bromo-bisphenol A and epichlorohydrin, reaction products of phenol novolak or o-cresol novolak and epichlorohydrin, multisensitive epoxy resins having oxycyclohexane eject in Japanese Patent Application Laid-open Nos. 60-161973 (1985), 63-221121 (1988), 64-9216 (1989) and 2-140219 (1990), or the like; however, obviously, the present invention is not limited to these compounds.

Light cation polymerization initiators for hardening the epoxy resins include aromatic iodized salts, aromatic sulfonium salts (refer to J. POYMER SCI: Symposium No. 56, 383–395 (1976)) or SP-150, SP-170 or the like marketed by ASAHI DENKAKOGYO KABUSHIKI KAISHA.

The aforementioned light cation polymerization initiators, used with reducer and heat, can accelerate cation polymerization (the reticulation density increases compared to the light cation polymerization alone). However, when light cation polymerization initiators are used with a reducer, it is necessary to select a reducer to obtain a so-called redox type initiator system that does not react at the ambient temperature and reacts at or over a certain temperature (preferably at or over 60° C.). For such reducer, copper compounds, especially copper triflate (copper (II) trifluoromethane sulfonate) are most convenient. Besides, reducers such as ascorbic acid are also useful. In addition, if a higher reticulation density (high Tg) is required for a increased number of openings (high speed printing), or for use of non-neutral ink (improvement of pigment water resistance) or the like, the reticulation density can be increased through a post-processing wherein the coating resin layer is immersed and heated by using the aforementioned reducer as solvent after the development step of the aforementioned coating resin layer as mentioned hereinafter.

It is possible to add conveniently additives or the like to the composition as necessary. For example, a plasticizer is added to reduce the epoxy resin elastic modulus, or a silane-coupling agent is added to increase further the adhesion to the substrate, or the like.

Figure 75:
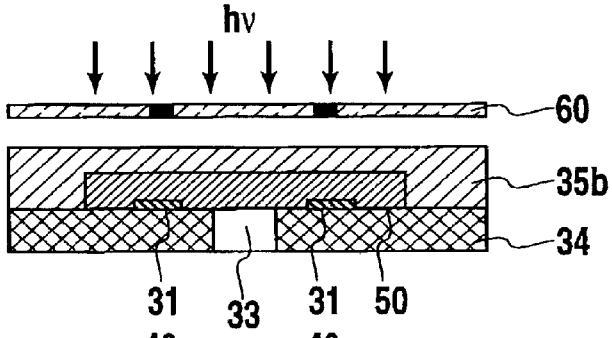
FIG. 75 is an illustrative view showing an embodiment of a manufacturing method of the printing head shown in FIG. 3, with FIGS. 73, 74 and 76–78.

Next, the pattern exposure through a mask 60 is performed on the photosensitive ejection opening plate forming layer 35*b* composed of the compounds, as shown in FIG. 75. The photosensitive ejection opening plate forming layer 35*b* being of a negative type, the portion to form ink ejection opening is covered with a mask (not shown; portions to be connected electrically are also masked).

The pattern exposure may be selected conveniently from among deep-UV light, electronic beam, X-ray or the like, according to the photosensitive area of the light cation polymerization initiator to be used.

These processes up to this stage, can all provide excellent results from the point of view of registration using the conventional lithography technique, allowing one to increase the accuracy by far, compared to the method consisting in preparing the orifice plate separately and applying it to the substrate. The photosensitive ejection opening plate forming layer 35*b* after such pattern exposure can be heat-treated to accelerate the reaction as necessary. As mentioned above, using the photosensitive coating resin layer that is composed of epoxy resin which is solid at the ambient temperature allows one to suppress the diffusion of polymerization initiation species generated by the optical irradiation, and to obtain an excellent patterning precision and form.

Figure 76:
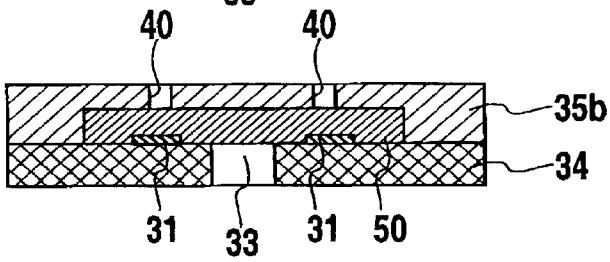
FIG. 76 is an illustrative view showing an embodiment of a manufacturing method of the printing head shown in FIG. 3, with FIGS. 73–75, 77 and 78.
Figure 77:
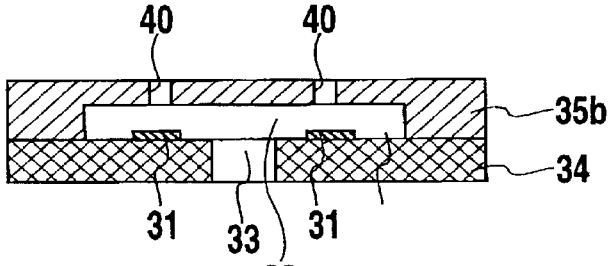
FIG. 77 is an illustrative view showing an embodiment of a manufacturing method of the printing head shown in FIG. 3, with FIGS. 73–76 and 78.

Next, the pattern exposed photosensitive ejection opening plate forming layer 35*b* is developed using an appropriate solvent, to form the ejection opening portion 40 as shown in FIG. 76. When a non-exposed photosensitive coating resin layer is developed, it is also possible to develop a soluble ink passage forming section 50 forming the ink passage. However, in general, as a plurality of heads of identical or different mode are disposed on the substrate 34, and used as ink-jet liquid ejection head after the cutting process, it is also possible to leave ink passage forming section 50 forming the ink passage 38 (ink passage forming section 50 remaining in the liquid chamber prevents cutting refuse from entering), by selectively developing only the photosensitive ejection opening plate forming layer 35*b* as shown in FIG. 76, and to develop the ink passage forming section 50 after the cutting process, as the countermeasure for the cutting refuse (refer to FIG. 77). In this case, the scum (development scum) produced by the development of the photosensitive ejection opening plate forming layer 35*b* is eluted with the soluble ink passage forming section 50, leaving no scum in the nozzle.

As mentioned above, when it is necessary to increase the reticulation density, the photosensitive ejection opening plate forming layer 35*b* on which the ink passage 38 and the ejection opening portion 40 are formed is immersed in a reducer-containing solution and heated to achieve its post-hardening. This allows one to further increase the reticulation density of the photosensitive ejection opening plate forming layer 35*b*, and the adhesion to the substrate and the ink resistance are greatly improved. Obviously, this immersion into a copper-ion-containing solution and heating process may well be performed immediately after the photosensitive ejection opening plate forming layer 35*b* is pattern exposed, and developed to form the ejection opening portion 40, and thereafter, the soluble ink passage forming section 50 may be eluted.

Alternatively, in this immersion and heating process, the immersion and the heating can be performed, or the heating treatment may equally well be performed after the immersion.

As for reducers, any substance having reduction function may be useful, however, in particular, copper-ion-containing compounds such as copper triflate, copper acetate and copper benzoate are effective. Among the compounds, the copper triflate is especially effective. Other than those aforementioned, ascorbic acid is also useful.

Figure 78:
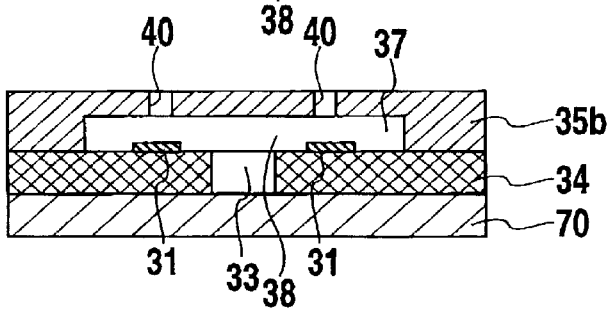
FIG. 78 is an illustrative view showing an embodiment of a manufacturing method of the printing head shown in FIG. 3, with FIGS. 73–77.

To the thus-formed ink passage and the substrate on which the ink is formed, electric connections (not shown) are formed for driving an ink supplying member 70 and the ink eject energy generating element 31 to form the ink-jet liquid ejection head (refer to FIG. 78).

Though the ejection opening portion 40 is formed by lithography in this embodiment of manufacturing, the present invention is not limited to this, but the ejection opening portion 40 may also be formed by oxygen plasma dry etching or excimer laser, by exchanging masks. When the ejection opening portion 40 is formed by dry etching or excimer laser, as the substrate protected by the ink passage forming section would not be damaged by laser or plasma, it becomes possible to provide a high-precision and reliable head. When the ejection opening portion 40 is formed by dry etching, excimer laser, or the like, in addition to the photosensitive ejection opening plate forming layer 35*b*, thermosetting ones can also be applied.

Figure 30:
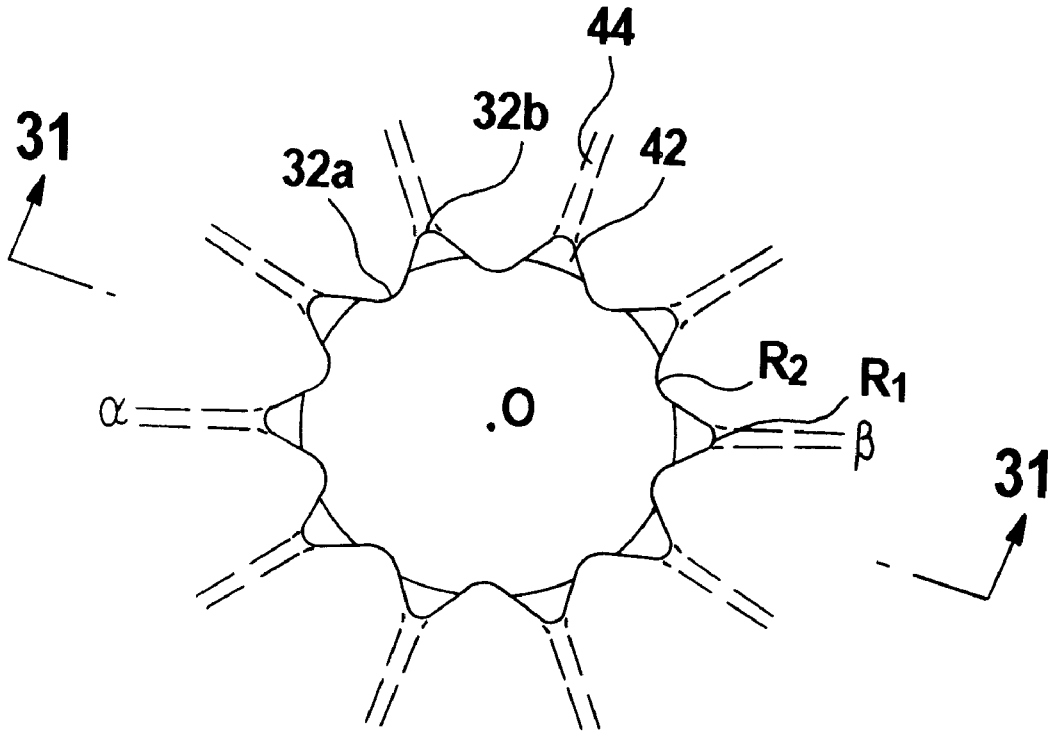
FIG. 30 is an enlarged view of an ejection opening of the liquid ejection head according to a second embodiment of the present invention.
Figure 31:
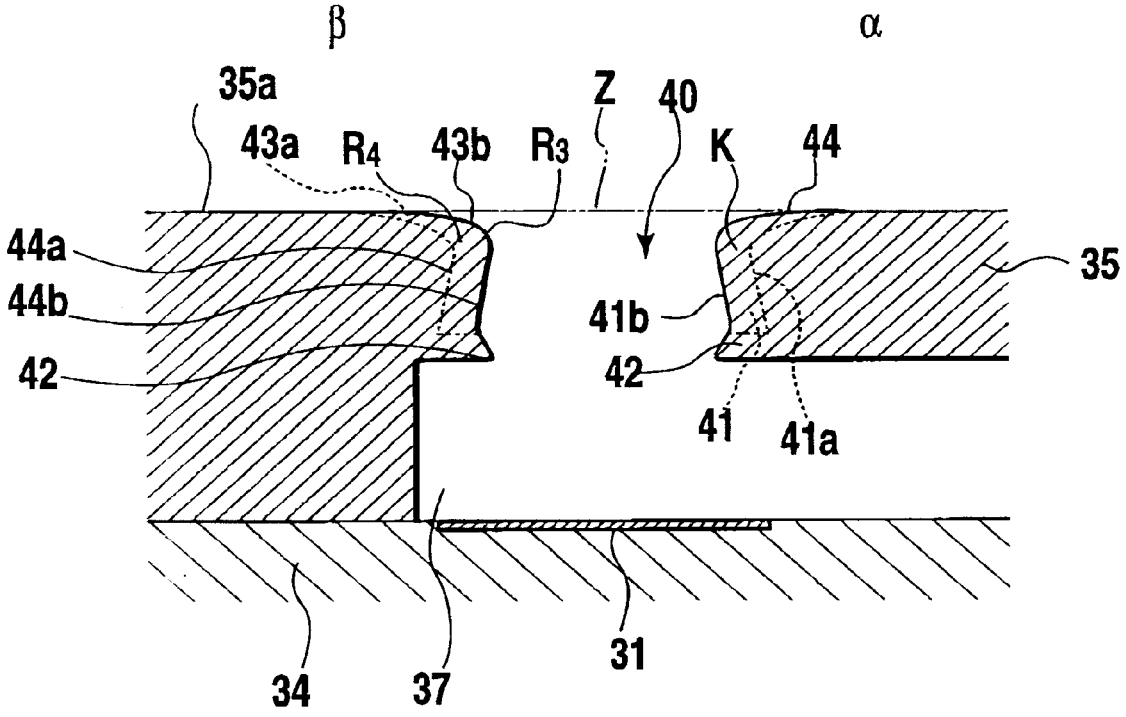
FIG. 31 shows a cross section 31—31 in FIG. 30.
Figure 32:
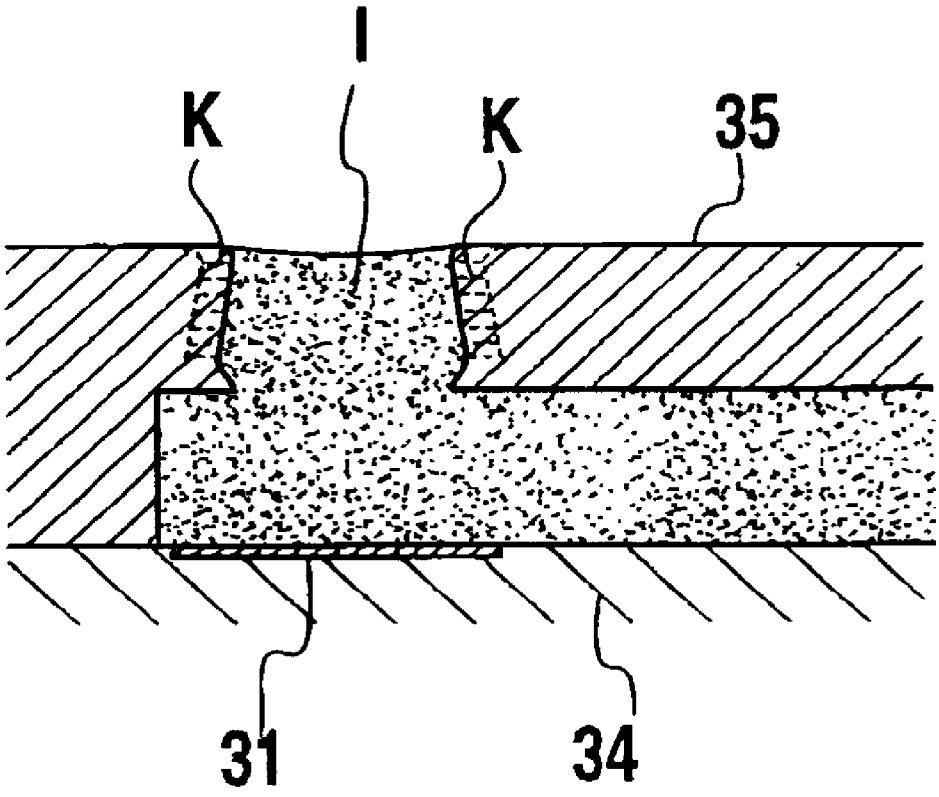
FIG. 32 is a schematic cross section for chronically illustrating the liquid ejecting operation of the liquid ejection head according to the second embodiment of the present invention with FIGS. 33–39.
Figure 33:
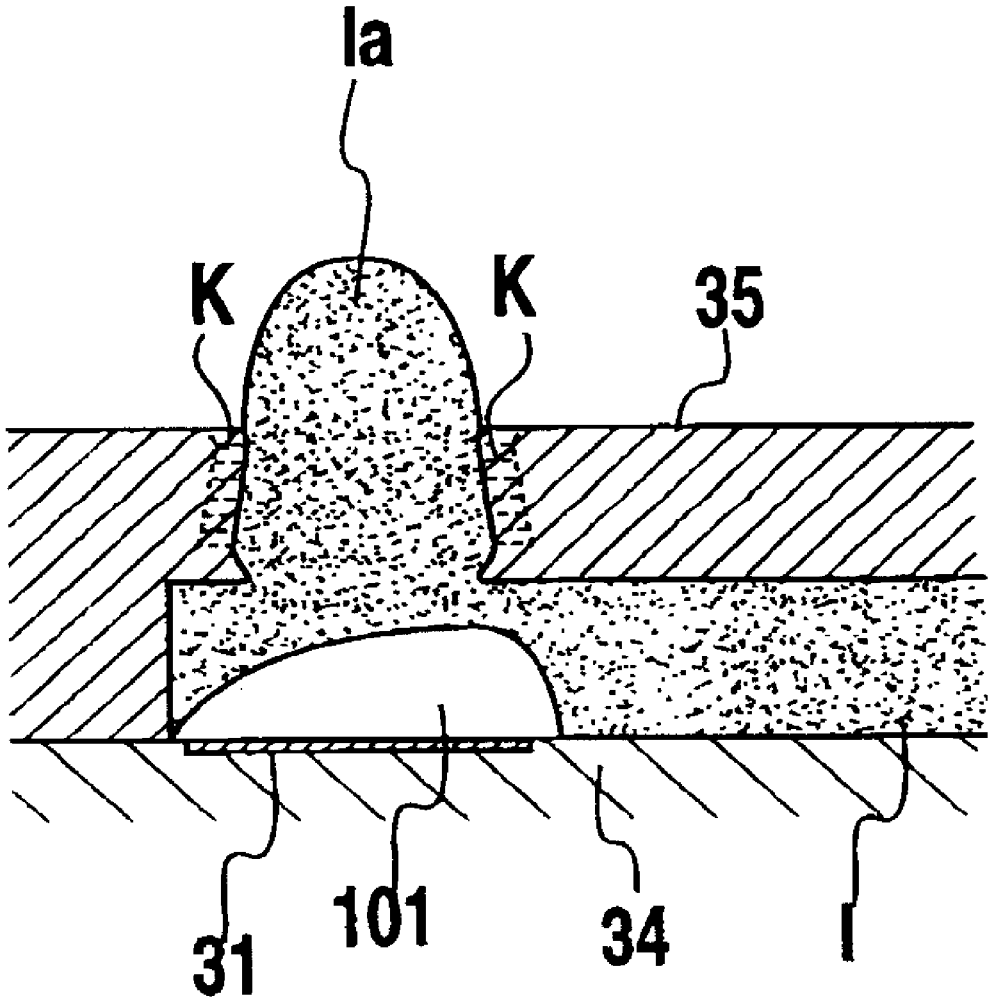
FIG. 33 is a schematic cross section for chronically illustrating the liquid ejecting operation of the liquid ejection head according to the second embodiment of the present invention with FIGS. 32 and 34–39.
Figure 34:
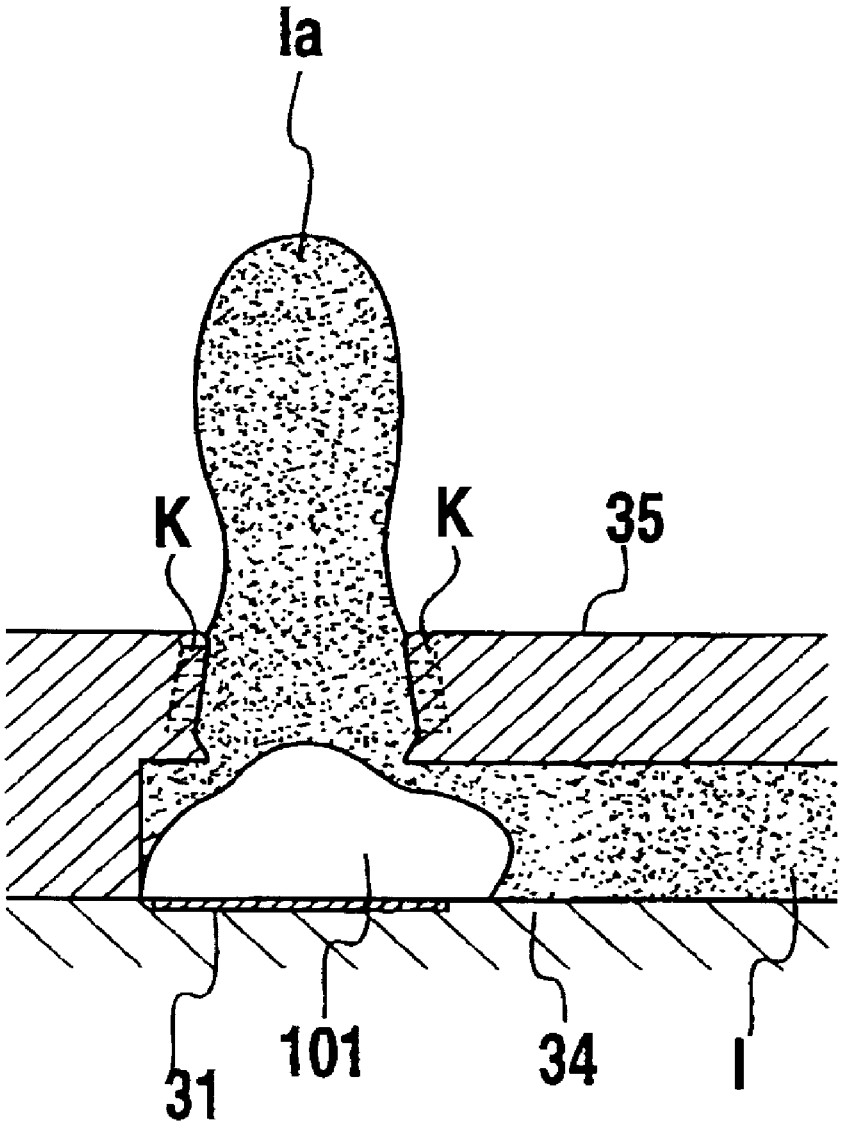
FIG. 34 is a schematic cross section for chronically illustrating the liquid ejecting operation of the liquid ejection head according to the second embodiment of the present invention with FIGS. 32, 33 and 35–39.
Figure 35:
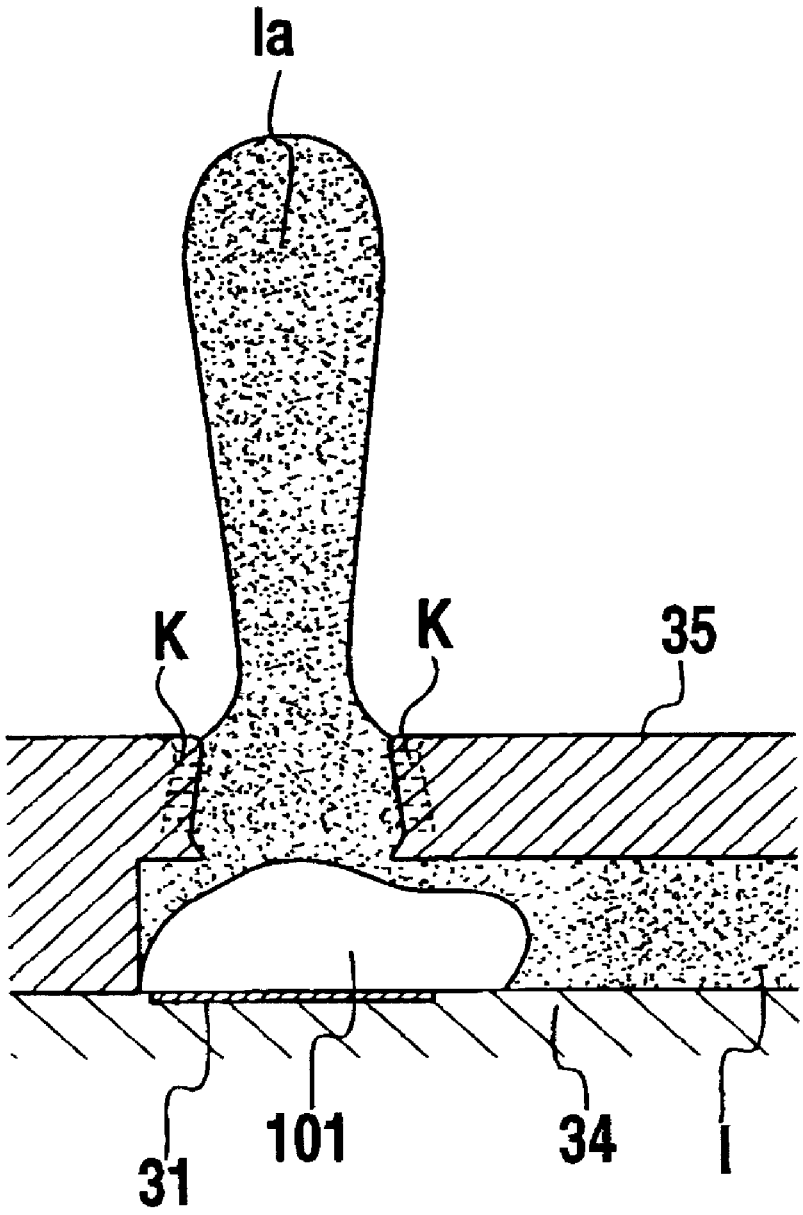
FIG. 35 is a schematic cross section for chronically illustrating the liquid ejecting operation of the liquid ejection head according to the second embodiment of the present invention with FIGS. 32–34 and 36–39.
Figure 36:
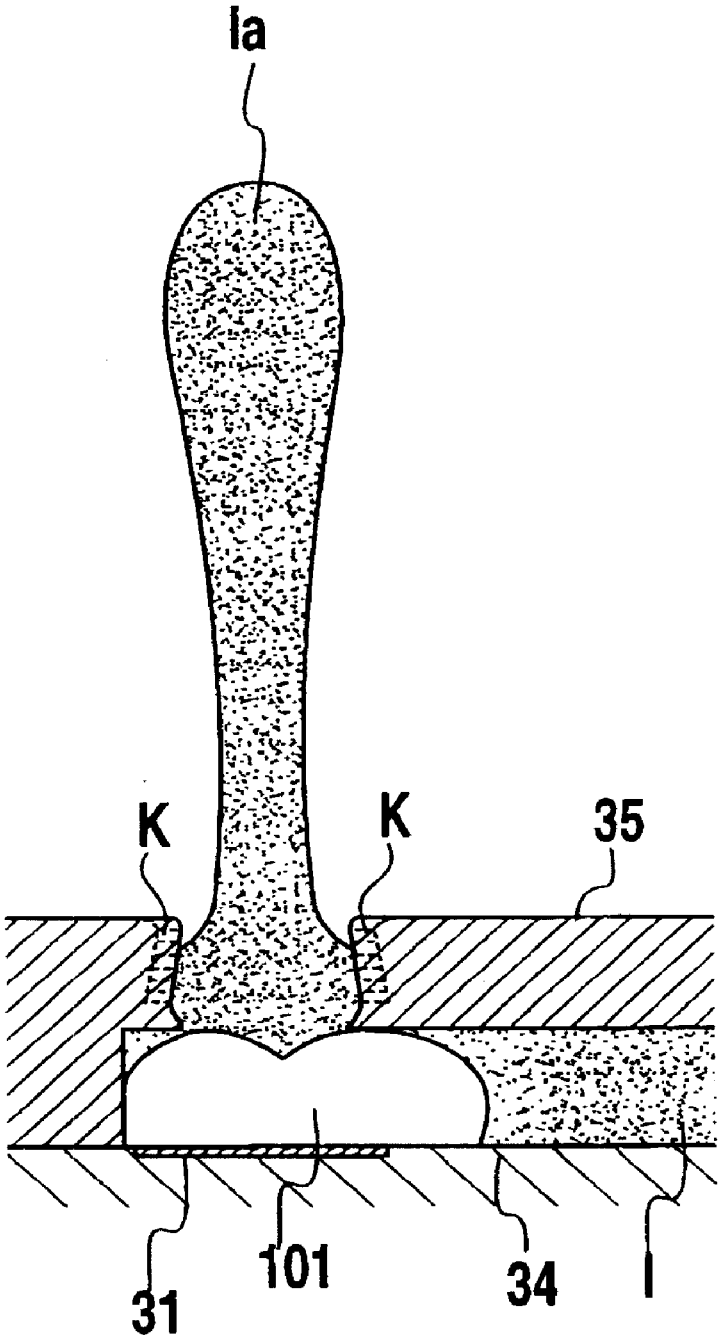
FIG. 36 is a schematic cross section for chronically illustrating the liquid ejecting operation of the liquid ejection head according to the second embodiment of the present invention with FIGS. 32–35 and 37–39.

However, as the printing head of this embodiment is manufactured through the manufacturing processes shown in FIGS. 73–78, an ejection opening portion having a plurality of grooves comprising the aforementioned minute curved surfaces $R_1$ and $R_2$ and a minute protrusion section 42 can be formed easily as shown in the ejection opening surface drawing of FIG. 30, and in FIG. 31, the cross section 31—31 of FIG. 30. The groove of the section can be formed easily by the pattern exposure shown in FIG. 75 and the development shown in FIG. 76.

In the aforementioned manufacturing process, the minute protrusion section is formed during the process for forming the aforementioned ejection opening, as parts of these resins fuse with each other in the interface area of the material of the ink passage forming section 50 and the ejection opening plate forming layer 35*b* forming the orifice plate.

As shown in FIG. 31, the cross section 31—31 (cross section cut in a plane passing the opposed convex section 32*a* of the ejection opening) of FIG. 30, the top 41*a* and the base 41*b* forming the groove 41 have respectively a taper 44*a* and 44*b* in the orifice plate thickness direction, and the opening area in the ejection opening portion is slightly larger than the rest of the opening. (The solid line in the drawing indicates the convex section 32*a* (groove base 41*b*), while the broken line in the drawing indicates the concave section 32*b* (groove top 41*a*). The taper 44*a*, 44*b*, and the minute protrusion section 42 define an ink retaining area K in the groove to retain ink temporarily. This taper 44*a*, 44*b* is also formed in the aforementioned ejection opening process.

The convex section 32*a* and the concave section 32*b* of this embodiment form respectively the minute curved surfaces R1 and R2 in the direction shown in FIG. 30 respectively, but also they form respectively minute curved surfaces R3 and R4 in the cross section shown in FIG. 31. As clearly shown in the perspective view of FIG. 29, in the surface forming the ejection opening 32, the area forming the convex section 32*a* is relatively convex to the liquid ejecting direction with respect to the area forming the concave section 32*b*. That is in the cross section shown in FIG. 31, though every convex section 32*a* and concave section 32*b* is provided with a minute slant section 43*a*, 43*b* disposed radially from the ejection opening center, as the minute curved face inclination of the others is different, a minute recess section 44 is formed radially from the top 41 of the groove formed consequently by the concave section 32*b*. The cross section of the minute recess section 44 is approximately U-shaped. They are formed simultaneously in the process of forming the ejection opening (FIGS. 74 and 75). If there is a deformation on the ejection opening surface 35*a*, the groove can be defined as a shape having its thickness component in the "liquid ejecting direction" by an area locally remote from the ejection opening center, and two areas locally near the ejection opening center adjacent to this area, in the projection of the ejection opening surface on a projection plane, by projecting the ejection opening surface onto the plane Z in contact with the ejection opening surface shown in FIG. 31.

These shapes of this embodiment can be easily formed by the manufacturing method shown in the aforementioned FIGS. 73–78. In spite of such complicated shape, an arrangement can be realized wherein the adhesiveness of the ejected liquid to the surface over which the ejection opening portion groove extends is relatively good compared to the liquid adhesiveness to the face forming the ejection opening, by applying in advance water repellent finishing to the ejection opening surface 35*a* (for instance, water repellent agent application to the resin layer surface, after the formation of this resin layer composing the orifice plate, in FIG. 74) before the ejection opening formation process (FIGS. 75 and 76).

The liquid ejecting operation of the liquid ejection head according to this embodiment will now be explained using FIGS. 32–39. FIGS. 32–39 are illustrative drawings for illustrating in at timewise manner the liquid ejecting operation, in the same section as FIG. 31. In this embodiment, as in the first embodiment, the main liquid droplet direction during the ejection can be also stabilized by a plurality of grooves dispersed about the ejection opening center, during the liquid ejection at the bubble volume reduction stage after it has grown to its maximum volume. As a result, a liquid ejection head of high hitting accuracy without ejecting direction slippage can be achieved. In addition, high speed and high-resolution printing can be realized by virtue of the fact that the ejection can be stabilized in spite of foaming variation under a high driving frequency.

In this embodiment, as in the first embodiment, as it is possible to prevent mist from being generated during droplet ejection through the bubble communication with the atmosphere, by ejecting liquid through bubble communication with the atmosphere for the first time at the bubble volume reduction stage, the state where droplets deposited on the ejection opening surface cause an accidental non-eject mentioned below may also be suppressed.

Figure 37:
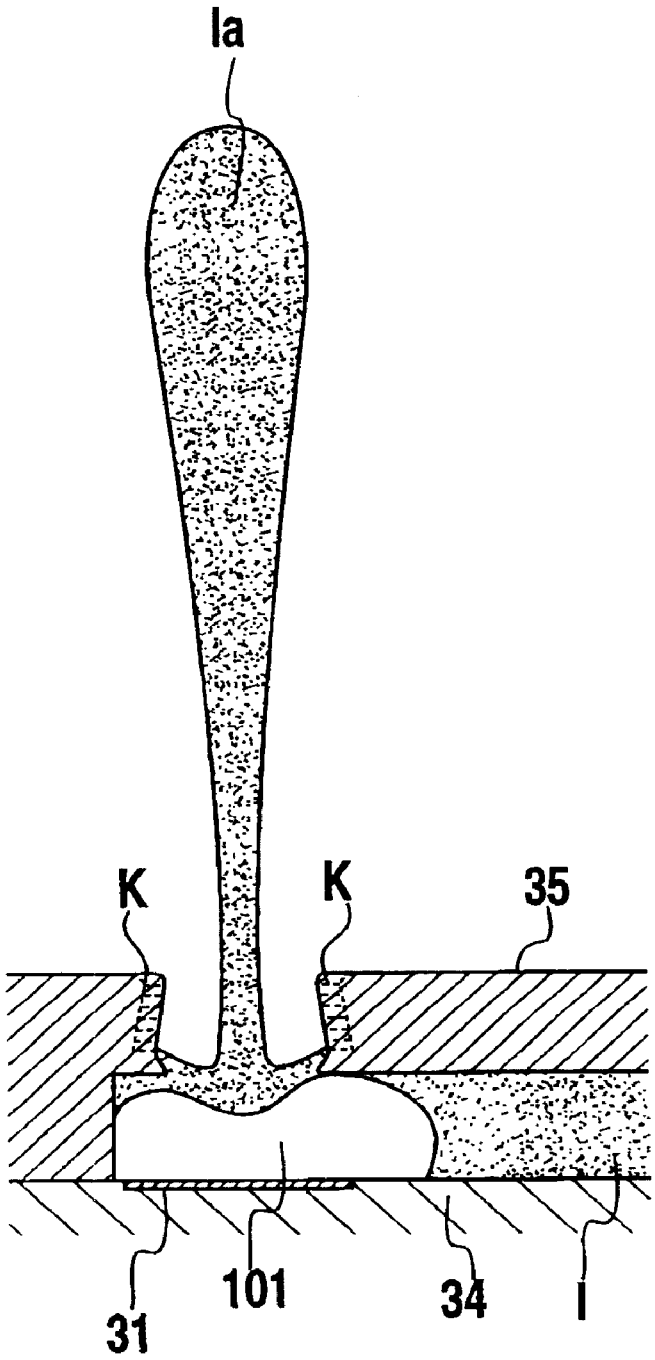
FIG. 37 is a schematic cross section for chronically illustrating the liquid ejecting operation of the liquid ejection head according to the second embodiment of the present invention with FIGS. 32–36, 38 and 39.
Figure 38:
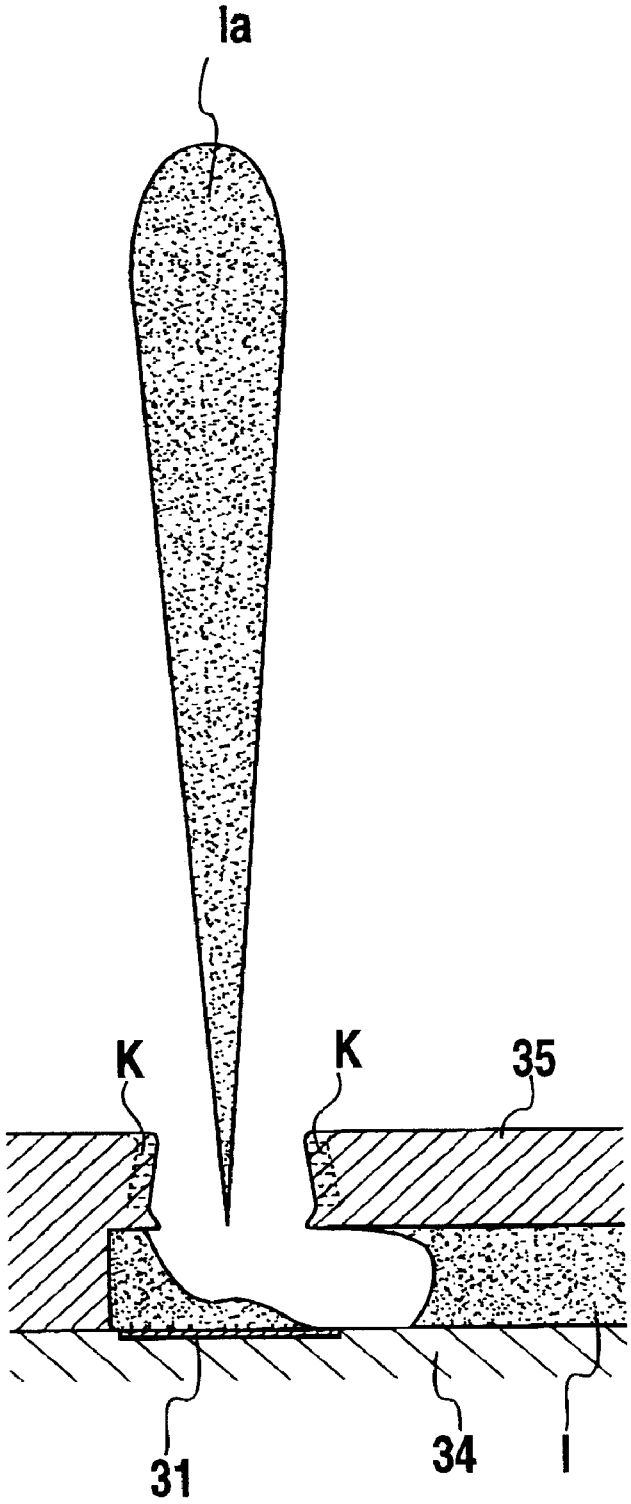
FIG. 38 is a schematic cross section for chronically illustrating the liquid ejecting operation of the liquid ejection head according to the second embodiment of the present invention with FIGS. 32–37 and 39.
Figure 39:
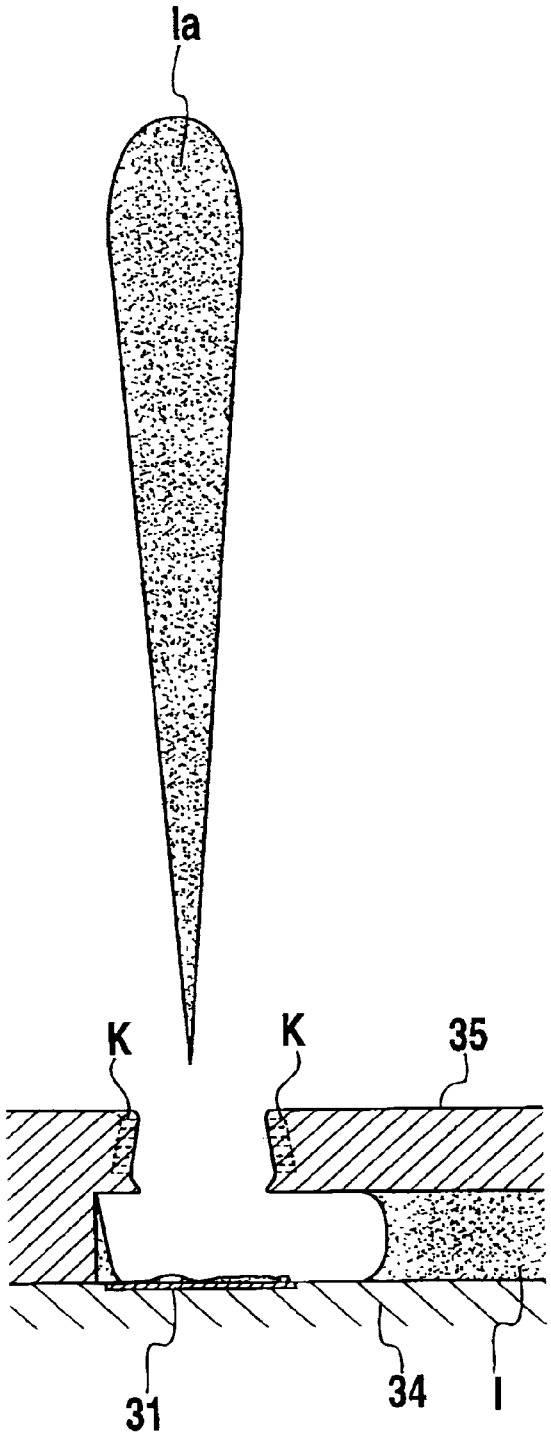
FIG. 39 is a schematic cross section for chronically illustrating the liquid ejecting operation of the liquid ejection head according to the second embodiment of the present invention with FIGS. 32–38.

In this embodiment, at the ink retaining area K disposed in the groove section, the capillary force acts strongly, allowing stabilization of the main liquid droplet ejecting direction in the liquid eject step shown in FIGS. 37 and 38. In the ejecting system for ejecting liquid through bubble communication with the atmosphere for the first time at the bubble volume reduction stage, the ink in the groove after the communication will also be prevented from interfering with the bubble by the capillary force acting during the bubble communication with the atmosphere. Ink is also prevented from interfering with the bubble as mentioned below, by the disposition of at least one of the tops of a plurality of grooves, in the direction toward the corner, of the bubble generation chamber as a volume surrounded by wall surfaces forming the passage sidewalls.

FIGS. 40–45 are illustrative drawings for illustrating in timewise manner ink refill conditions, and are cross sections add into FIGS. 32–39.

Figure 40:
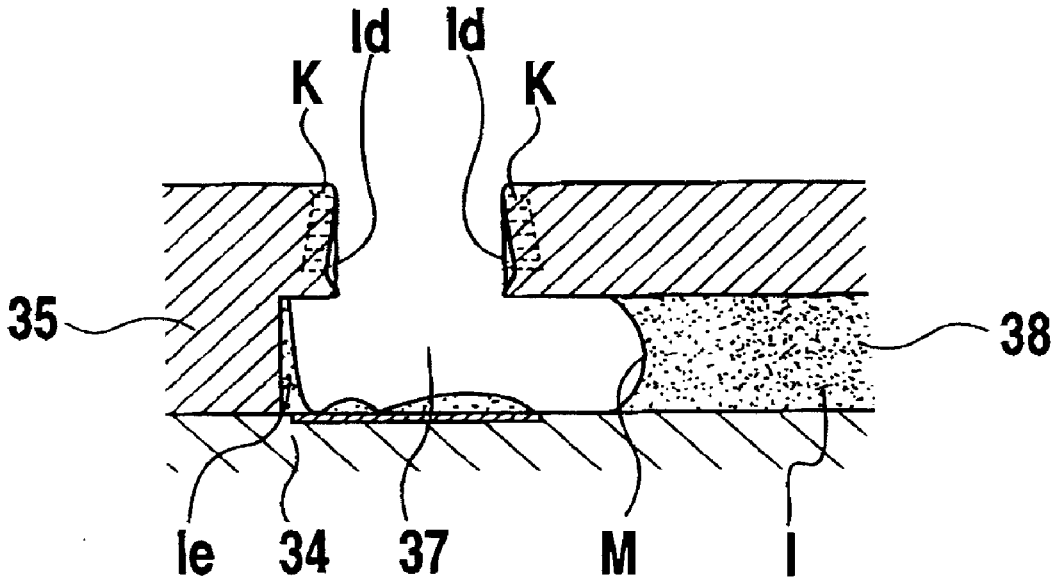
FIG. 40 is a schematic cross section for chronically illustrating the operation after the liquid ejection of the liquid ejection head according to the second embodiment of the present invention with FIGS. 41–45.
Figure 41:
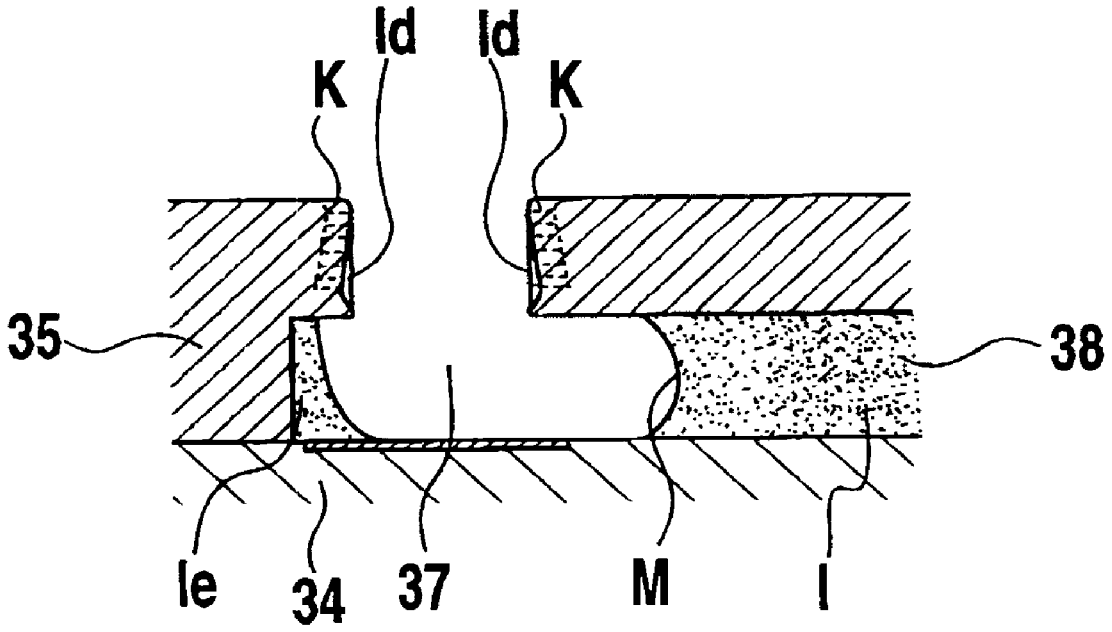
FIG. 41 is a schematic cross section for chronically illustrating the operation after the liquid ejection of the liquid ejection head according to the second embodiment of the present invention with FIGS. 40 and 42–45.
Figure 42:
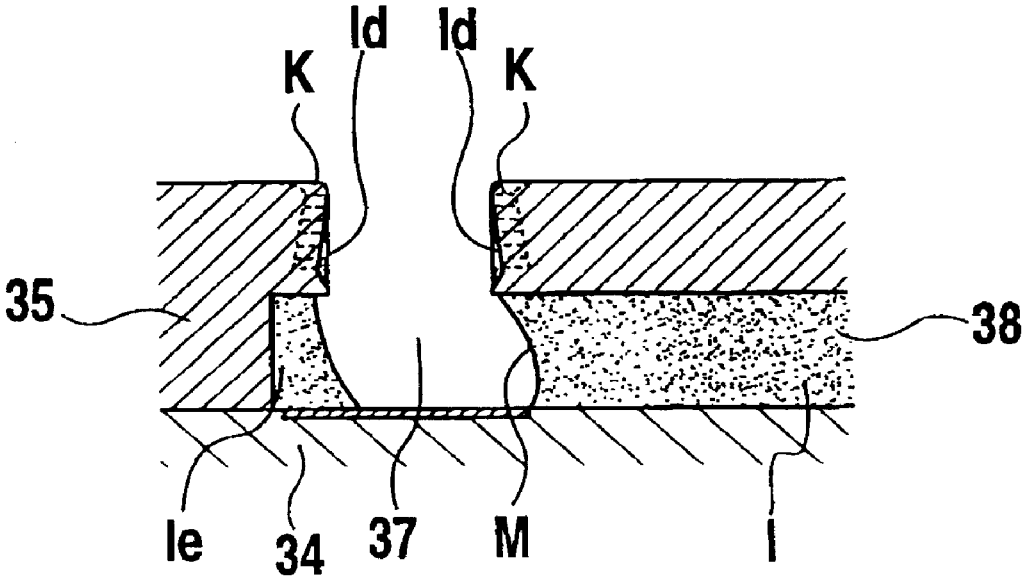
FIG. 42 is a schematic cross section for chronically illustrating the operation after the liquid ejection of the liquid ejection head according to the second embodiment of the present invention with FIGS. 40, 41 and 43–45.
Figure 43:
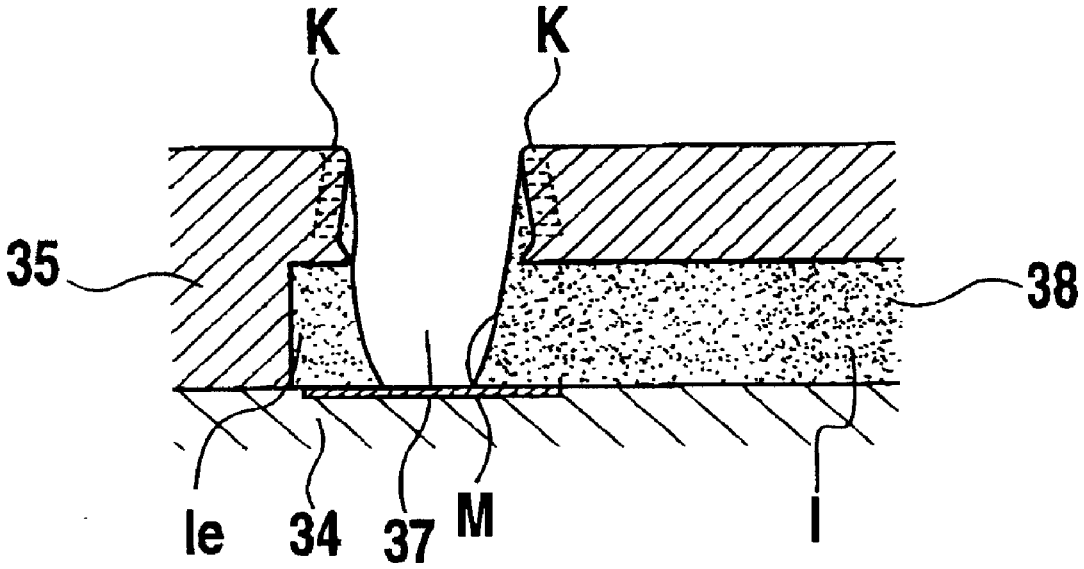
FIG. 43 is a schematic cross section for chronically illustrating the operation after the liquid ejection of the liquid ejection head according to the second embodiment of the present invention with FIGS. 40–42, 44 and 45.
Figure 44:
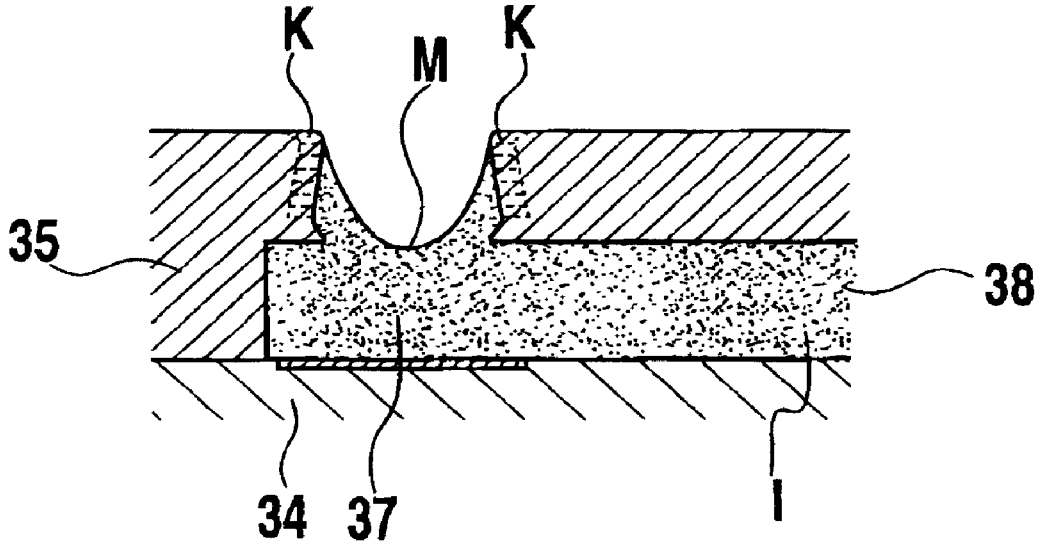
FIG. 44 is a schematic cross section for chronically illustrating the operation after the liquid ejection of the liquid ejection head according to the second embodiment of the present invention with FIGS. 40–43 and 45.
Figure 45:
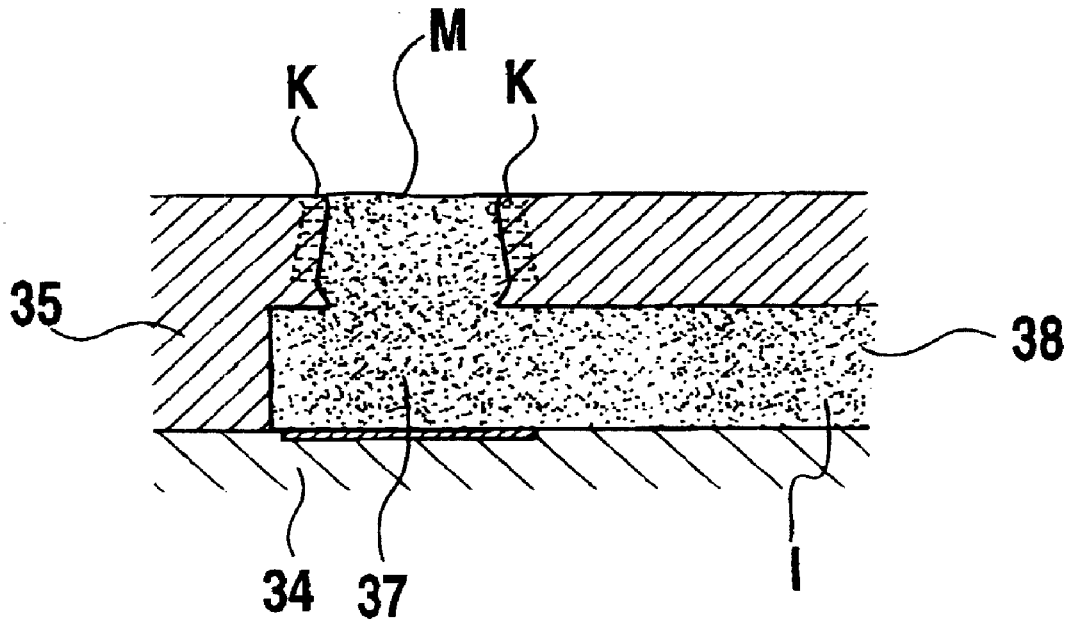
FIG. 45 is a schematic cross section for chronically illustrating the operation after the liquid ejection of the liquid ejection head according to the second embodiment of the present invention with FIGS. 40–44.

FIG. 40 shows the state 10 $\mu$s after the formation of a membrane-shaped bubble on the heater, and the following drawings show the state every 10 $\mu$s up to FIG. 45. In FIG. 40, the liquid passage 38 is supplied with ink I from the ink supply port (not shown), and the meniscus M thereof is formed in the ink passage. At this moment, the ink retaining area K retains ink $I_d$, while ink $I_e$ remains in the corner of the bubble generation chamber 37. In FIGS. 41 and 42, the meniscus of ink I moves toward the ejection opening, but still remains in the liquid passage 38. Ink $I_e$ in the corner communicates with ink $I_d$ in the ink retaining area K, and grows, gathering ink near the corner (ink passing from the side section not shown). In FIG. 42, ink $I_d$ in the ink retaining area K of the liquid passage side communicates with ink I in the liquid passage. Thereafter, as shown in FIGS. 43–45, ink in the liquid passage communicates with ink $I_d$ in the ink retaining area K and ink $I_e$ in the corner to form a meniscus M at the ejection opening. In this embodiment, as a plurality of grooves are disposed, the capillary force is produced by the infiltration of ink I from the liquid passage into the groove, and moreover, during the formation of the meniscus M at the ejection opening (refer to FIGS. 43–45), the groove capillary force can facilitate the formation of meniscus M at the ejection opening. In this embodiment, as ink I ink $I_d$ is retained beforehand in the ink retaining area K of the groove section, ink $I_e$ in the groove and ink I in the liquid passage communicate easily, allowing the meniscus formation to accelerate.

In order to assure such refill acceleration, it is preferable to dispose one of the grooves extending in the liquid ejecting direction, so that its top is in the direction toward the liquid chamber (ink supply port).

As regards the aforementioned unevenness on the ejection opening surface, it should be noted that a plurality of minute recess sections are distributed on the outer circumference of the ejection opening, and so even if the ejection opening surface has been formed slightly slant-wise to the substrate during manufacture, its effect may be attenuated by the presence of the minute irregularities on the ejection opening outer circumference, and a substantially even meniscus can be formed on the ejection opening portion. Contrarily, if the height from the substrate surface is slightly different at $\alpha$ and $\beta$ in the section shown in FIG. 31, and the ejection opening outer circumference shape is circular and free of the aforementioned minute irregularities, meniscus formation will be largely influence by the height difference at $\alpha$ and $\beta$, and as a result, the liquid droplet ejecting direction will be slanted with respect to the substrate. For the shape according to this embodiment, the minute recess sections 44 which have approximately U-shaped cross section absorb the height difference from the substrate at $\alpha$ and $\beta$. Consequently, even when the head includes such a manufacturing variation, the meniscus formation would not be so different from that of a normal head, suppressing, as the result, the inclination of the droplet ejecting direction with respect to the substrate. The distributed disposition of a plurality of minute irregularities around the ejection opening outer circumference, has the effect of attenuating the influence of ejection opening height difference arising in the manufacturing stage on the ejection direction.

The prevention of accidental non-eject, in this embodiment, now will be explained referring to FIGS. 46–52.

Figure 46:
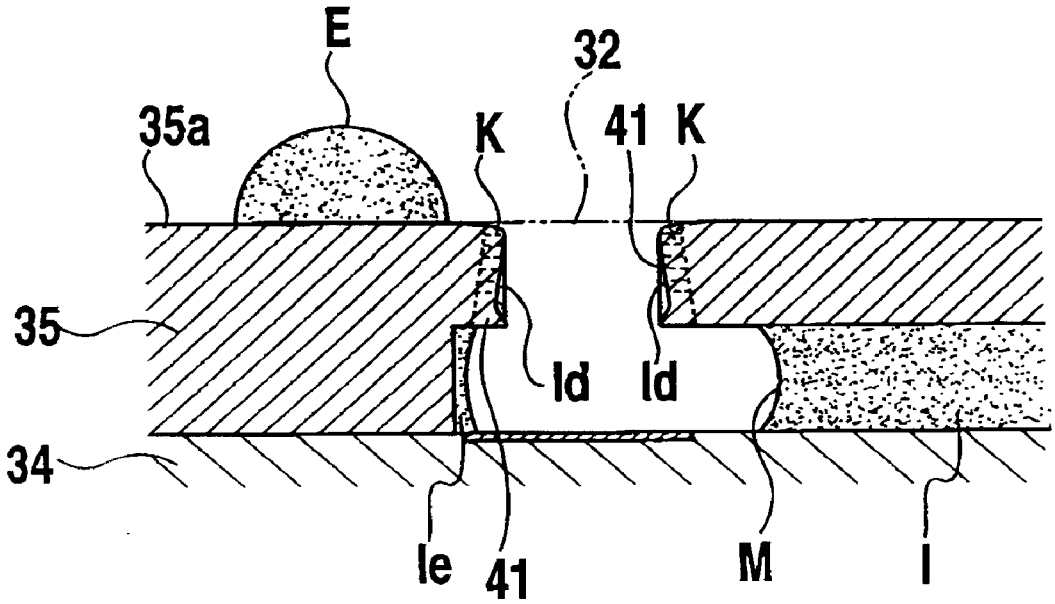
FIG. 46 is a schematic cross section for chronically illustrating the movement of a liquid droplet deposited on the ejection opening surface of the liquid ejection head according to the second embodiment of the present invention with FIGS. 47–50.

FIGS. 46–50 are schematic cross sections for chronically illustrating in a timewise manner the movement of ink E deposited on the ejection opening surface during refill of ink I. In FIG. 46, showing the state after liquid ejection, the liquid passage 38 is supplied with ink I from the ink supply port (not shown), but its meniscus is formed in the ink passage. At this time, the ink retaining area K retains ink $I_d$, while ink $I_e$ remains in the corner of the bubble generation chamber 37.

Figure 47:
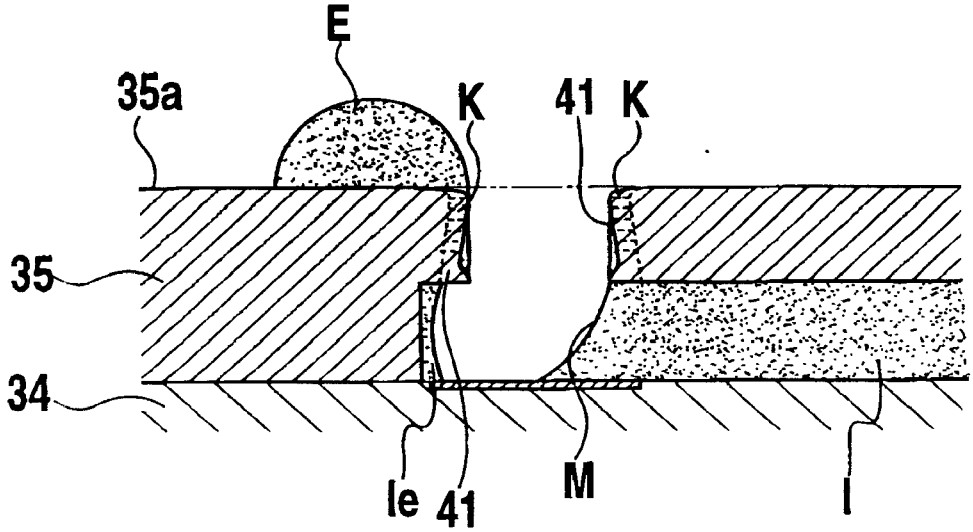
FIG. 47 is a schematic cross section for chronically illustrating the movement of a liquid droplet deposited on the ejection opening surface of the liquid ejection head according to the second embodiment of the present invention with FIGS. 46 and 48–50.

In FIG. 46, when free ink E tends to obstruct the ejection opening for some reason, first it communicates with ink $I_d$ in the ink retaining area K as shown in FIG. 47. Ink I communicates with ink $I_d$ in the ink retaining area K to form meniscus M including the groove section. As the ejection opening surface 35*a* has a water repellent finish, the adhesiveness is different at the ejection opening portion and the ejection opening surface. This has an effect of accelerating the entrapment of ink E into the groove 41.

As ink $I_d$ is retained in the ink retaining area K, ink $I_d$ in the groove can communicate easily with ink E on the ejection opening surface. In this embodiment, the minute curved surfaces $R_3$ and $R_4$ shown in FIGS. 29 and 31, minute slant surfaces 43*a* and 43*b* formed to lower the ejection opening side, and the minute recess section 44 formed to make the groove top height relatively lower than the base, or other structures function synergistically as structures that respectively speed the movement of free ink into the groove. Therefore, ink E moves easily into the groove, compared to the first embodiment, which lacks such an arrangement.

Figure 48:
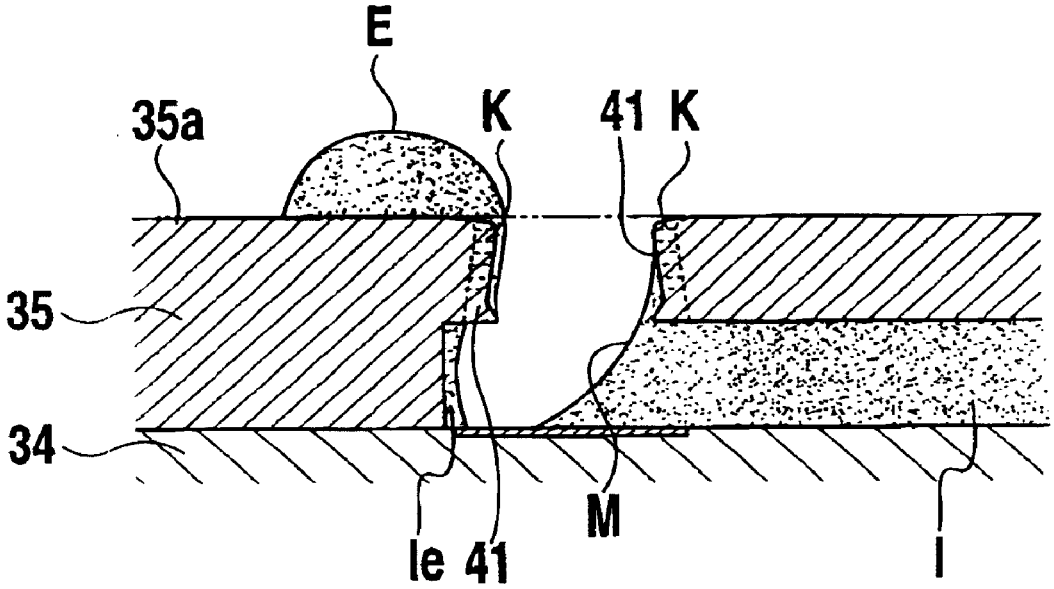
FIG. 48 is a schematic cross section for chronically illustrating the movement of a liquid droplet deposited on the ejection opening surface of the liquid ejection head according to the second embodiment of the present invention with FIGS. 46, 47, 49 and 50.
Figure 49:
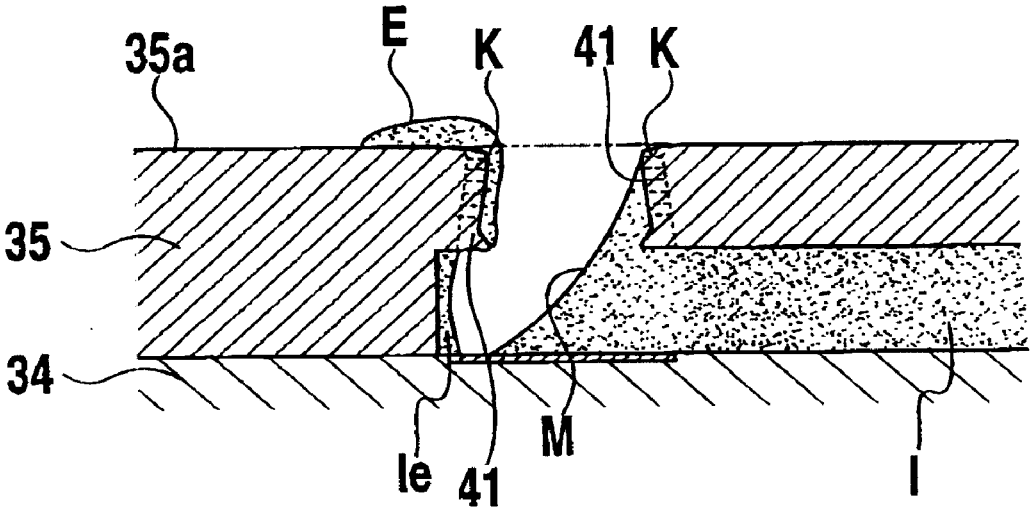
FIG. 49 is a schematic cross section for chronically illustrating the movement of a liquid droplet deposited on the ejection opening surface of the liquid ejection head according to the second embodiment of the present invention with FIGS. 46–48 and 50.
Figure 50:
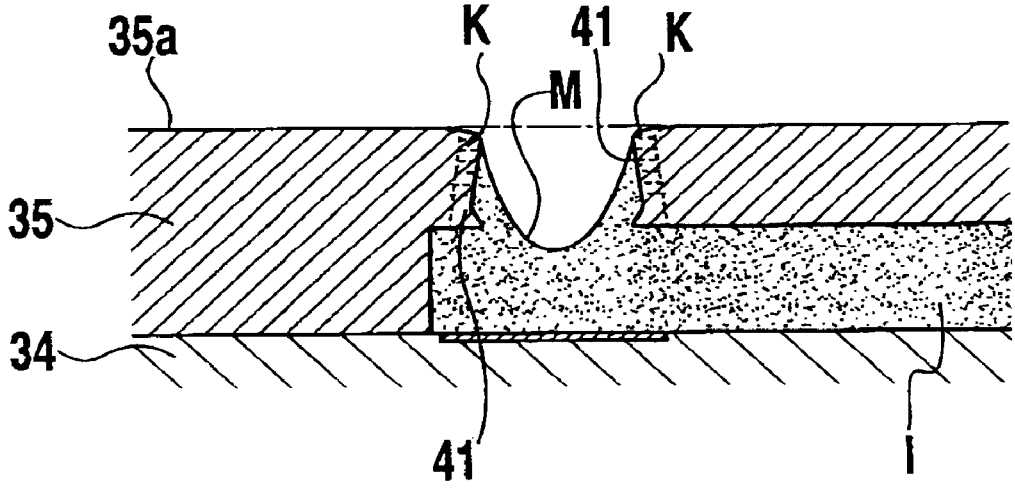
FIG. 50 is a schematic cross section for chronically illustrating the movement of a liquid droplet deposited on the ejection opening surface of the liquid ejection head according to the second embodiment of the present invention with FIGS. 46–49.
Figure 51:
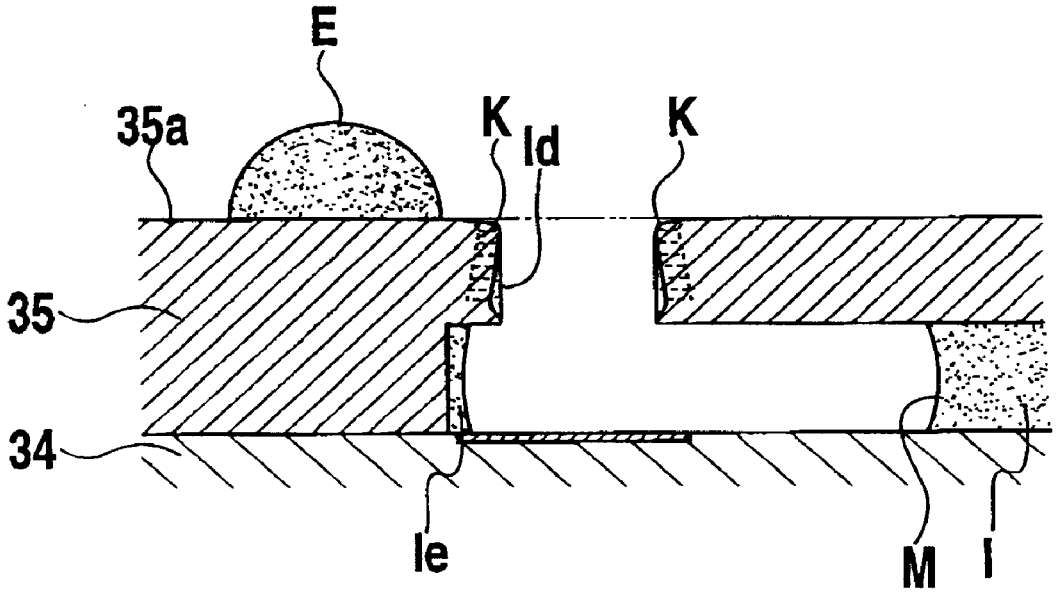
FIG. 51 is a schematic cross section for illustrating the movement of a liquid droplet deposited on the ejection opening surface of the liquid ejection head according to the present invention with FIG. 52.

Thereafter, free ink infiltrated into the groove further moves to the liquid passage side, by communicating with ink $I_e$ or the like in the bubble generation chamber, as shown in FIGS. 48 and 50. As shown in FIG. 50, free ink E then communicates with ink I and is taken into the ejection opening portion without obstructing the ejection opening.

Figure 52:
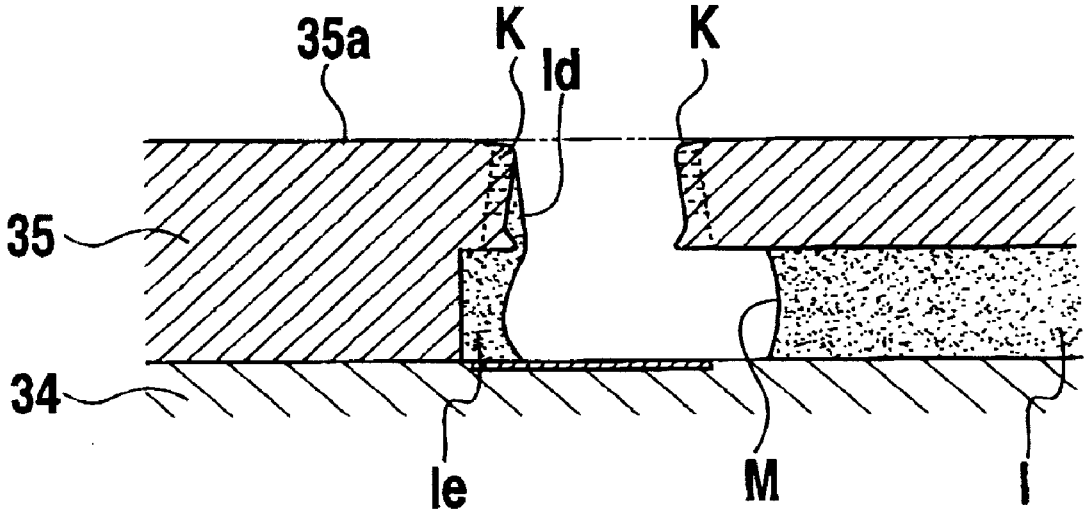
FIG. 52 is a schematic cross section for illustrating the movement of a liquid droplet deposited on the ejection opening surface of the liquid ejection head according to the present invention with FIG. 51.

According to the ink refill timing in the liquid passage, free ink E may be taken into the ejection opening portion by communicating only with ink $I_e$ in the bubble generation chamber as shown in FIG. 52. In this case, as the ejection opening will not be obstructed with free ink, accidental non-ejection can be also avoided.

In both cases, liquid in the liquid passage (including the bubble generation chamber) is sucked into the groove; on the other hand, liquid deposited on the ejection opening surface is taken into the groove, and the inks come into contact in the groove, moving liquid deposited on the ejection opening surface into the ejection opening portion, and preventing liquid deposited on the ejection opening surface from obstructing the ejection opening.

Though the ink retaining area K is formed by a minute protrusion section 42 and tapered sections 44*a*, 44*b* in the aforementioned embodiment, other methods also may provide the aforementioned effect, provided that ink (liquid) can be retained. In the aforementioned embodiments, there is always ink in the ink retaining area K; however, actually, even when there is no ink in the first stage of the aforementioned process, free ink can be taken into the groove without covering the ejection opening portion, by the groove effect ejection of the first embodiment. That is, in this embodiment, non-ejection can be also prevented by the groove effect ejection of the first embodiment, referring to FIGS. 23–26.

By deploying desired capillary force by means of the groove section, a droplet attached to the face having the ejection opening is prevented from obstructing the ejection opening. In other words, this desired capillary force should preferably be larger than the adhesion due to the surface tension of the liquid attached to the ejection opening surface. According to experiments by the inventors, to be more specific, the groove opening area is preferably equal to or less than 30 $\mu m^2$ per unit, and the groove length equal to or greater than 7 $\mu m$.

Though its description was omitted for the first embodiment, among the effects described in detail in this embodiment, such as the effect of different adhesiveness of the liquid on the ejection opening portion and the ejection opening surface, due to the water repellent finishing of the ejection opening surface, the aforementioned effects can be expected for arrangements similar to those of the first embodiment.

Third Embodiment

Figure 53:
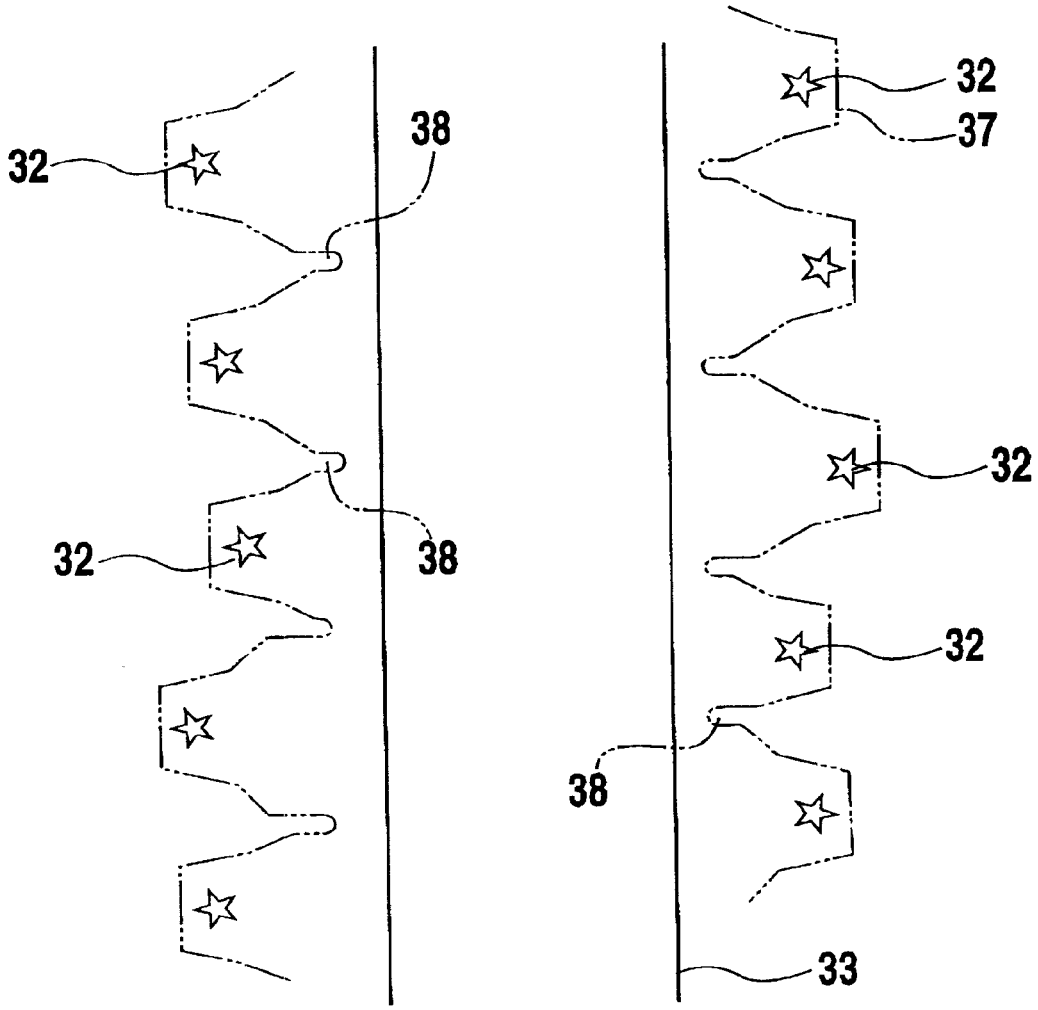
FIG. 53 is a conceptual drawing extracting and showing a part of the liquid ejection head according to a third embodiment of the present invention.
Figure 54:
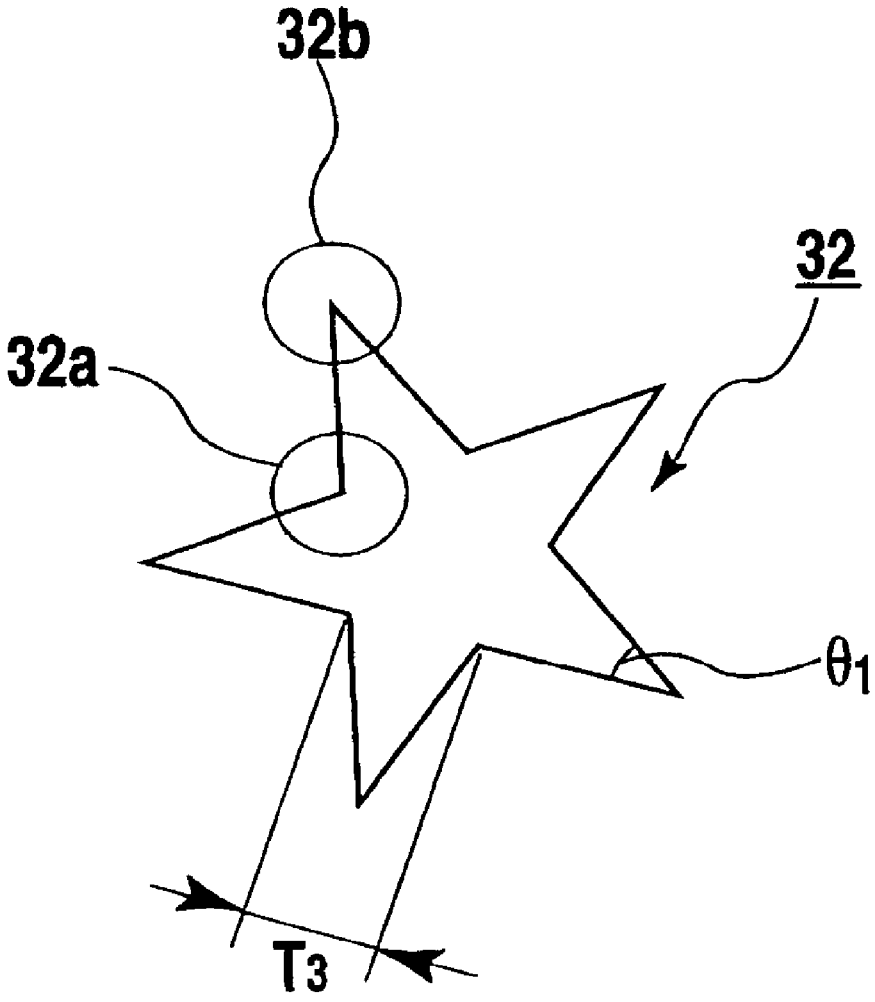
FIG. 54 is an enlarged view of the ejection opening shown in FIG. 53.

FIGS. 53 and 54 are illustrative drawings showing the essential part the ejection opening portion of the liquid ejection head according to a third embodiment of the present invention. The composition of the liquid ejection printing head will be omitted for those portions which are similar to those of the aforementioned first and second embodiments. In this embodiment, the shape of the ejection opening portion disposed on the orifice plate is different from that of the aforementioned first embodiment.

The composition of the liquid eject printing head of this embodiment is the same as that of the aforementioned first embodiment, and printing ink may be used which has a viscosity of 2.5 cp and surface tension values of 30, 35, 40, 45 dyn/cm. The dimensions of the ejection opening are $T_3$=8 μm, and $\theta_3$=30 degrees (FIG. 54). The ejection opening 32 area is about 400 $\mu m^2$.

The occurrence of accidental non-ejection was compared for both the printing head according to this embodiment of the aforementioned composition and the printing head of the conventional ejection opening shape.

The ejection opening shape of the conventional embodiment is a circle 22.5 μm in diameter and a square 20 μm on each side. The printing pattern is 50% zigzag pattern, and 1 pass is recorded on a longitudinal printing medium of size A3. In the results shown in Table 2, non-ejection has occurred with several ejection openings per plate for the conventional head, while there was none for this embodiment. When it was observed from the front, there was no ink remaining in the convex part in the ejection opening during the ejection.

TABLE 2

| | Ink surface tension (dyn/cm) | | | |
|---|---|---|---|---|
| Ejection opening | 30 | 35 | 40 | 45 |
| Square | 14 | 11 | 11 | 12 |
| Circular | 7 | 4 | 5 | 4 |
| 3rd Embodiment | 0 | 0 | 0 | 0 |

Figure 55:
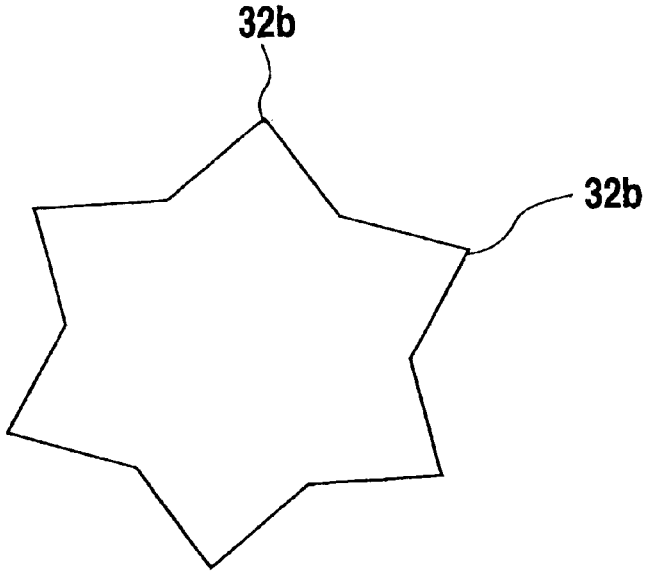
FIG. 55 is a enlarged front view for illustrating a variation of the ejection opening shape of the liquid ejection head according to the third embodiment of the present invention.
Figure 56:
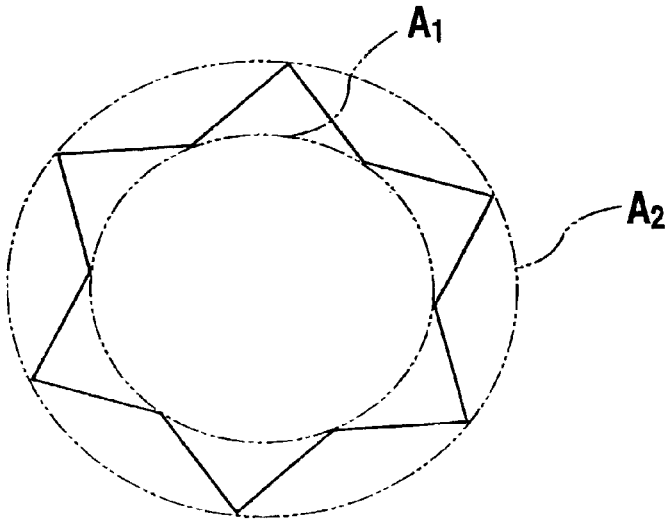
FIG. 56 is a typical view for illustrating the inscribed circle and the circumscribed circle of the ejection opening shown in FIG. 55.
Figure 57:
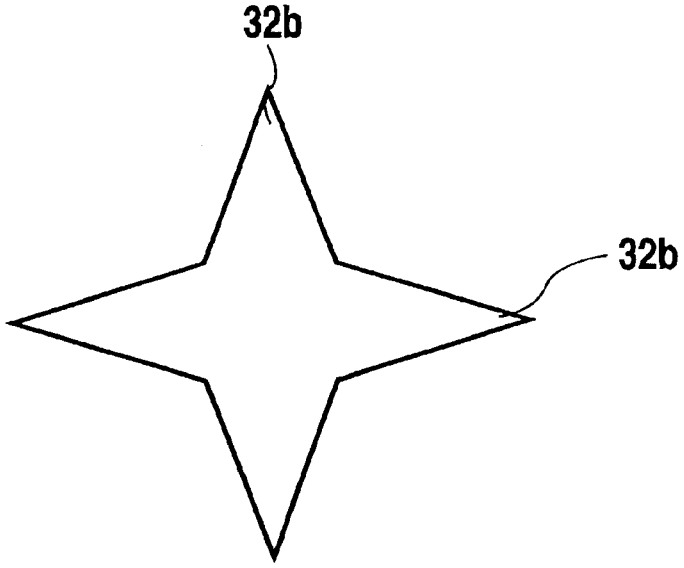
FIG. 57 is a enlarged front view for illustrating a variation of the ejection opening shape of the liquid ejection head according to the third embodiment of the present invention.
Figure 58:
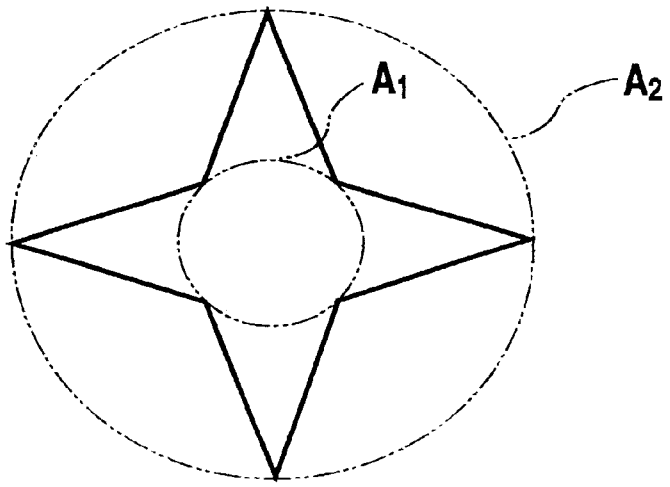
FIG. 58 is a typical view for illustrating the inscribed circle and the circumscribed circle of the ejection opening shown in FIG. 57.

FIGS. 55–58 show different shape ejection opening according to still another variation of this embodiment. FIGS. 55 and 57 are respectively typical views showing the outer configuration of the ejection opening, while FIGS. 56 and 58 are illustrative drawings showing the inscribed circle and the circumscribed circle of the ejection opening shown in FIGS. 55 and 57 (refer to the second embodiment for inscribed circle and circumscribed circle of the ejection opening). In FIG. 55, the diameter of the inscribed circle $A_1$ (FIG. 56) of the ejection opening shown in FIG. 57 is 13.4 μm, and the diameter of the inscribed circle $A_1$ (FIG. 58) of the ejection opening of FIG. 57 is 11.0 μm. The diameter of the circumscribed circle $A_2$ (FIGS. 56 and 58) of respective ejection opening is 17.8 μm for the ejection opening of FIG. 55 and 22.6 μm for the ejection opening of FIG. 57. The angle of the concave section 32*b* is the same for the six (6) ejection openings of FIG. 55, and the same for four (4) ejection openings of FIG. 57. In this variation, as in the aforementioned second embodiment, the tip of the concave section 32*b* is curved.

The occurrence of accidental non-eject was compared for the printing head according to this embodiment and the printing head of the conventional ejection opening shape. The ejection opening shape of the conventional embodiment is a circle 15 μm in diameter and a square 13.5 μm on each side. The printing pattern is 50% zigzag pattern, and 1 pass is recorded on a longitudinal printing medium of A3 size. In the results shown in Table 1, non-ejection has occurred with several ejection openings per plate for the conventional head, while there was no non-ejection for this embodiment. When it was observed from the front, there was no ink remaining in the convex part in the ejection opening during the ejection.

Concerning the hitting accuracy, in the case where the distance from the ejection opening to the paper is 1.6 mm, for the conventional printing head, the deviation from the ideal hitting position was 4.6 μm for the circular case, and 4.5 μm for the square shape case, while for this embodiment, it was reduced to 3.5 μm in the case FIG. 55, and to 3.4 μm for FIG. 57, improving the hitting accuracy. Though it depends on the ejection opening area and groove top angle, it is desirable to increase the number of grooves (for instance, 10 as in the second embodiment) to improve the hitting accuracy. To improve further the hitting accuracy, it is desirable to increase the number of grooves to 6 or more, as in the first and second embodiments or the variation shown in FIG. 55.

In the aforementioned embodiment, though the angle of the concave section 32*b*, in other words, the angle $\theta_1$, $\theta_3$ defined by the tops of the groove section is defined for each embodiment, the angle is not limited to this. From respective viewpoints of the aforementioned ejecting direction stabilization and accidental non-eject prevention effect, this angle is desirably in the range of 30 degrees or more, to less than 90 degrees (angle of the conventional square ejection opening). If the angle of an acute angular section of the concave section 32*b* is less than 30 degrees, the convex section 32*a* will overhang the opening section of the ejection opening 32, decreasing adversely the ejection function of the ejection opening 32. In light of the manufacturing method described in detail in the second embodiment, it is desirable that the angle be greater than 30 degrees, to form a groove that can generate an effective capillary force. If the angle of an acute angular section of the concave section 32*b* is more than 90 degrees, the convex section 32*b* will not be properly formed, and the synergetic effect of convex and concave sections of the present invention cannot be obtained. As for the number of grooves, it is important to create a number of break points and to increase the ejection opening circumferential length.

Figure 79:
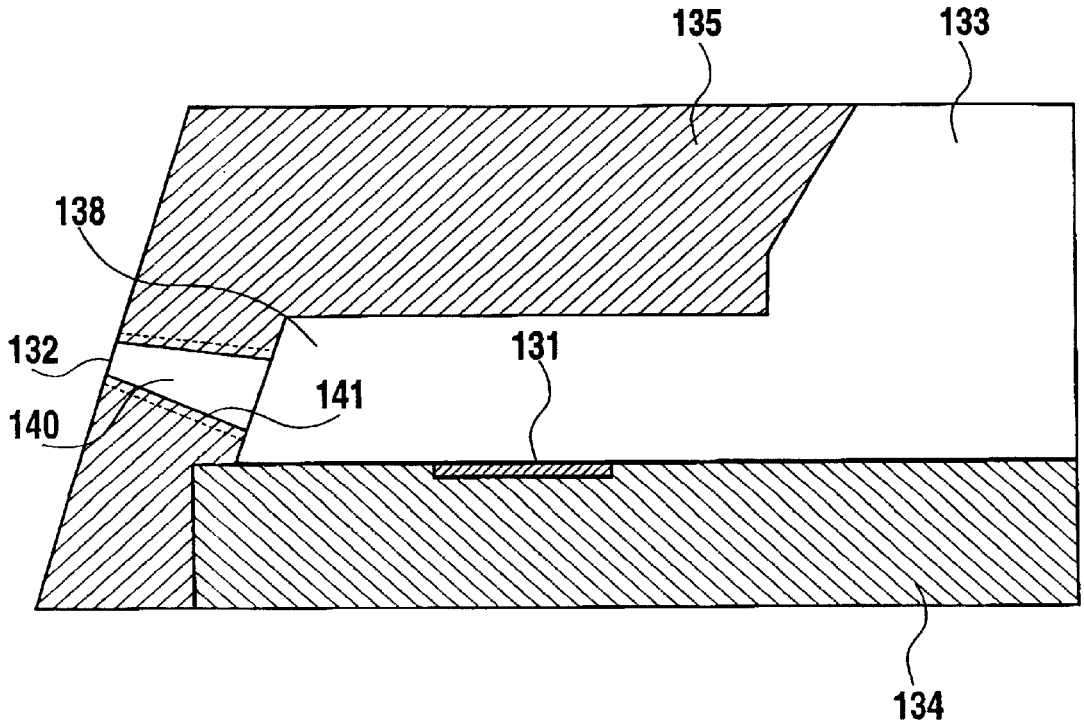
FIG. 79 is a cross section showing an embodiment of a liquid ejection head of another embodiment to which the present invention can be applied.
Figure 80:
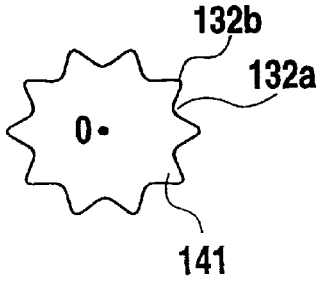
FIG. 80 is a front view of the ejection opening in the liquid ejection head shown in FIG. 79.

The effect on the accidental non-ejection is not limited to the shape of the bubble generation chamber of this embodiment, but any ink-jet printing head communicating with the atmosphere during ejection will be effective, independently of the bubble generation chamber configuration. Concerning the ejecting direction stabilizing effect, any system for ejecting a droplet during the defoaming step is effective, independently of the bubble generation chamber configuration. For instance, the present invention can be applied also to a liquid ejection head of the configuration called an "edge shooter", as shown in FIGS. 79 and 80. FIG. 79 is a section of the essential part of the liquid ejection head, and FIG. 80 is schematic illustrative view showing the ejection opening surface. In FIG. 79, reference numeral 134 is a substrate including a heater 131, and 135 is a top plate forming an ejection opening portion 140. Reference numeral 132 is an ejection opening, and a plurality of grooves 141 dispersed in respect of the ejection opening center as shown in FIG. 80 are disposed in the ejection opening portion 140. Reference numeral 138 is a liquid passage and 133 is a common liquid chamber communicating with a plurality of liquid passages 138.

Fourth Embodiment

Figure 59:
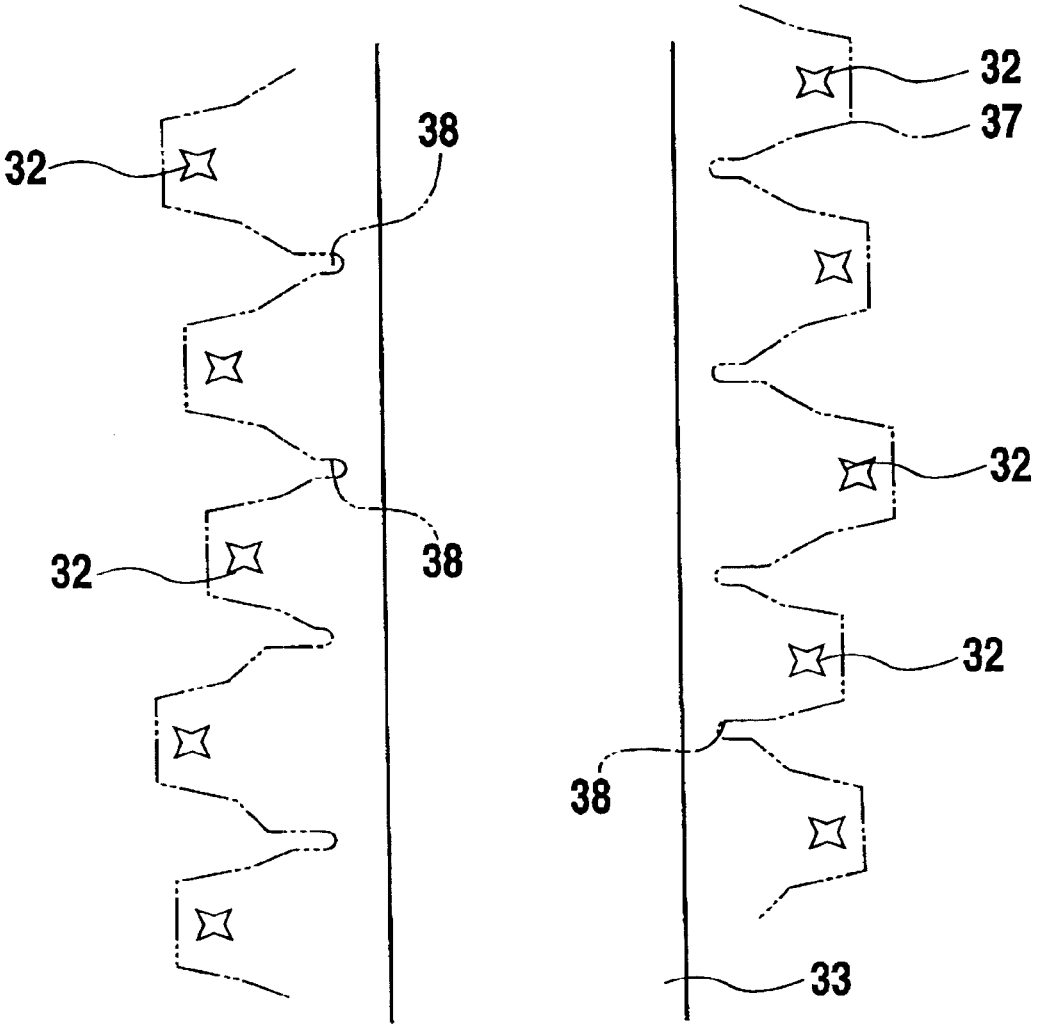
FIG. 59 is a conceptual drawing extracting and showing a part of the liquid ejection head according to a fourth embodiment of the present invention.
Figure 60:
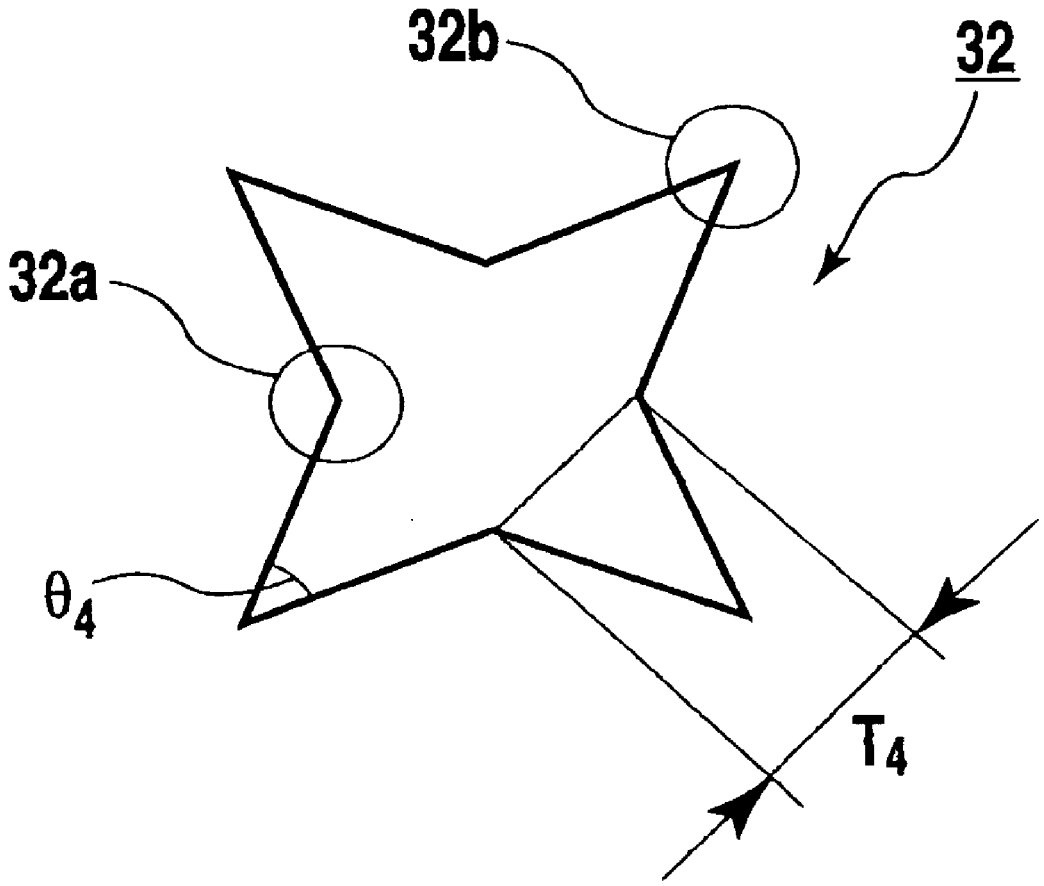
FIG. 60 is an enlarged view of the election opening shown in FIG. 59.
Figure 61A:
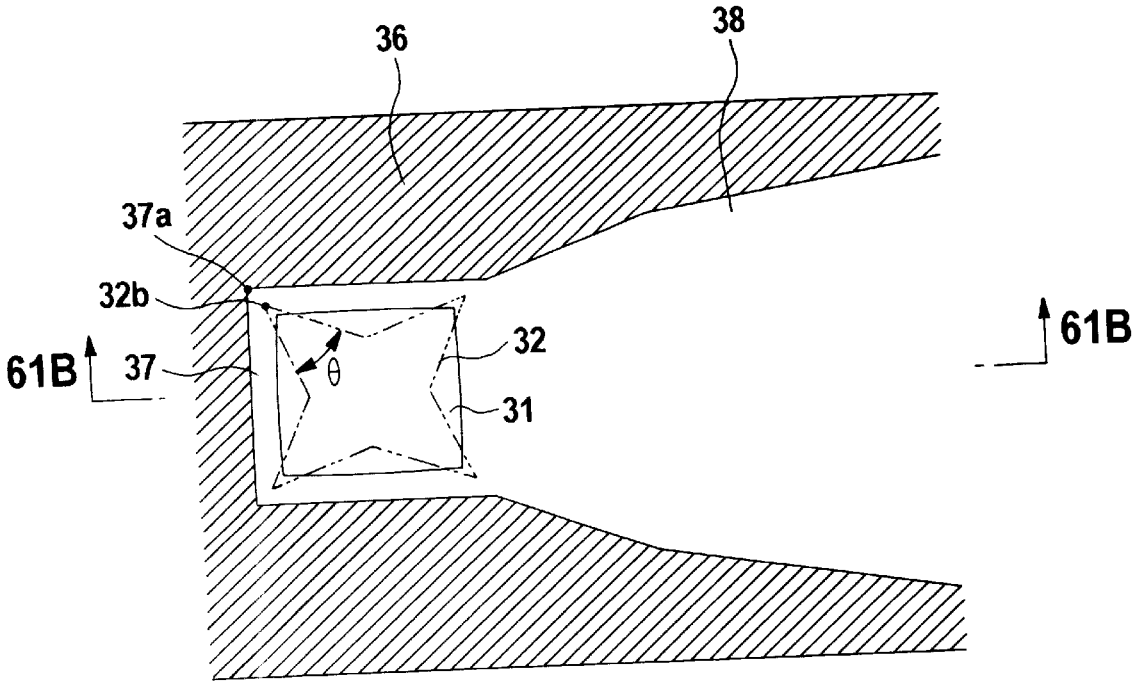
FIG. 61A is an essential part cross section showing the shape or the like of the ejection opening of the liquid ejection head according to a fourth embodiment of the present invention.
Figure 61B:
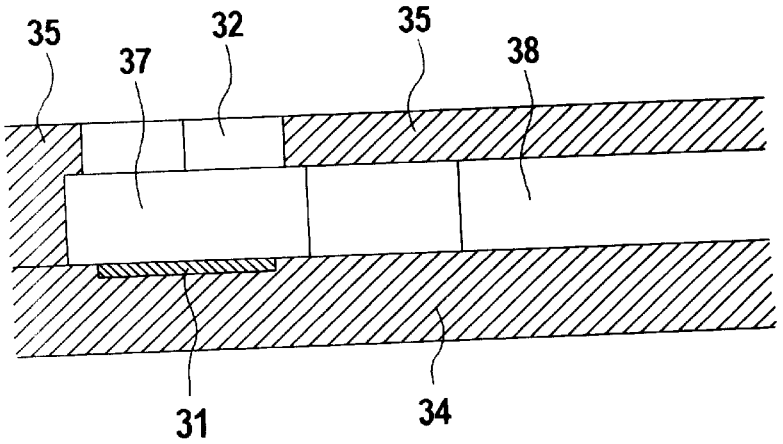
FIG. 61B shows a cross section 61B—61B thereof.

FIGS. 59–61 are illustrative drawings showing the essential part of the ejection opening of the liquid ejection head according to the fourth embodiment of the present invention. The composition of the liquid ejection printing head of this embodiment will be omitted for those portions which are similar to the aforementioned embodiments. In this embodiment, the shape of the ejection opening portion disposed on the orifice plate is different from the aforementioned first embodiment.

The composition of the liquid ejection printing head of this embodiment is the same as that of the aforementioned first embodiment, and printing ink can be used which has a viscosity of 2.5 cp and surface tension valves of 30, 35, 40, 45 dyn/cm. The shape in dimensions of the ejection opening is $T_4$=11 μm, and $\theta_4$=45 degrees (FIG. 14). The opening area at the ejection opening 32 is about 400 $\mu m^2$.

The occurrence of accidental non-ejection was examined for the printing head according to this embodiment of the aforementioned composition and the printing head of the conventional ejection opening shape.

The ejection opening shape of the conventional embodiment is a circle 22.5 μm in diameter and a square 20 μm on each side. The printing pattern is 50% zigzag pattern, and one pass is recorded on a longitudinal printing medium of size A3. In the results shown in Table 3, non-ejection has occurred with several ejection openings per plate for the conventional head, while there was none for the ejection opening shape of this embodiment. When it was observed from the front, there was no ink remaining in the convex part in the ejection opening, during the ejection.

TABLE 3

| | Ink surface tension (dyn/cm) | | | |
|---|---|---|---|---|
| Ejection opening | 30 | 35 | 40 | 45 |
| Square | 30 | 26 | 20 | 22 |
| Circular | 12 | 9 | 8 | 10 |
| 4th Embodiment | 0 | 0 | 0 | 0 |

In this embodiment, the configuration of the ejection opening 32 projected on a plane orthogonal to the droplet ejecting direction is set to have a rectangular star form, composed of eight (8) plane sections. The ejection opening portion has a pair of groove sections near a corner section 37*a* of the bubble generation chamber 37 positioned in the opposite side to the connection portion between the bubble generation chamber 37 and the liquid passage 38. The angle θ defined by concave sections 32*b* at the top of the groove section is set to an acute angle to prevent the ejection opening 32 opening area from increasing.

The disposition of grooves having their top in the direction toward the bubble generation chamber corner sections 37*a* allows regular evacuation of bubbles remaining in the bubble generation chamber 37 corner sections 37*a*, through the arc section.

Fifth Embodiment

FIG. 62 is an illustrative drawing showing the essential parts of the ejection opening of the liquid ejection head according to the fifth embodiment of the present invention. The composition of the liquid ejection printing head will be omitted for those parts which are similar to those of the aforementioned first and second embodiments. In this embodiment, the shape of the ejection opening portion disposed on the orifice plate is different from the aforementioned first embodiment.

The liquid ejection head of this embodiment is not expected to have the liquid ejection stabilizing effect as in the aforementioned first to fourth embodiment where it is applied to a liquid ejection head that ejects liquid during the defoaming step, because its ejection opening has a triangular shape. However, the composition wherein grooves having their top in the direction toward the bubble generation chamber corner section are provided (in this embodiment, the "groove" includes the ejection opening angular section), disclosed in respective embodiment, and the composition wherein the ejection opening top is positioned in the direction toward the liquid chamber (ink supply port) will be included.

Figure 62A:
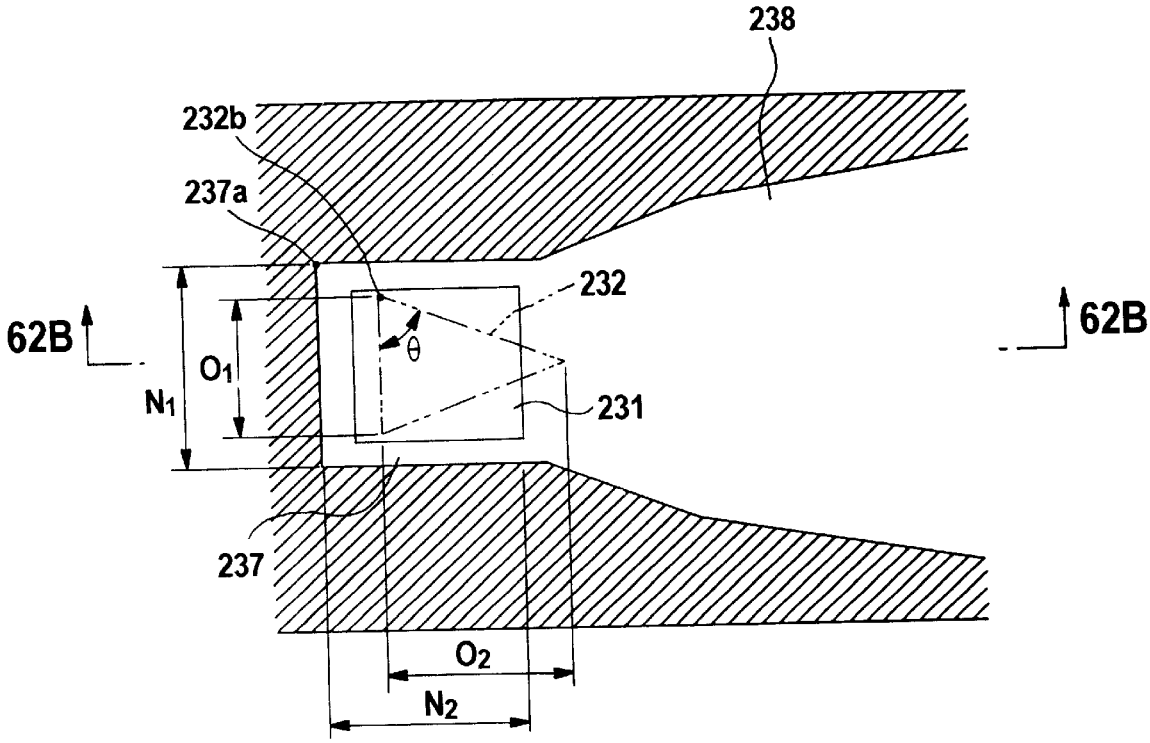
FIG. 62A is an essential part cross section showing the shape or the like of the ejection opening of the liquid ejection head according to a fifth embodiment of the present invention.
Figure 62B:
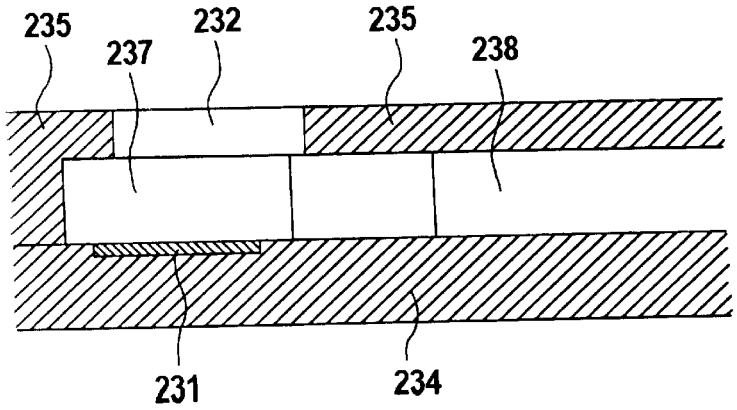
FIG. 62B shows a cross section 62B—62B thereof.

As shown in FIG. 62A, giving an enlarged view of a single bubble generation chamber 237 and its following liquid passage 238, and in FIG. 62B, representing its sectional structure along 62B—62B, the bubble generation chamber 237 according to this embodiment has a width $N_1$ of 33 μm and a length $N_2$ of 35 μm, the shape of the ejection opening 232 projected on a plane orthogonal to the droplet ejecting direction (upward in FIG. 62B) is an isosceles triangle (opening area of about 246 $\mu m^2$), having a width $0_1$ of 25 μm and a length $0_2$ of 27.75 μm, surrounded by three (3) plane sections, and the ejection opening 232 opening area is prevented from increasing by making acute the angle θ formed by the plane section composing the base of this isosceles triangle and the plane section composing the oblique side. The distance between the corner section 237*a* of the bubble generation chamber 237 positioned at the side opposite to the connection portion between the bubble generation chamber 237 and the liquid passage 238, and the angular section 232*b* of the plane section composing the base of the isosceles triangle of the ejection opening 232 in the proximity thereof is 4.0 μm along the ejection opening 237 width direction (vertical direction in FIG. 62A), about 8.4 μm along its length direction (horizontal direction in FIG. 62A), its straight distance being about 9.3 μm.

In this embodiment, the gravity center of the contour of the electrothermal converting element 231 and the gravity center of the contour of the ejection opening 232 respectively projected on a plane orthogonal to the droplet ejecting direction agree with each other. In this embodiment, ink that is 30 dyn/cm in surface tension, and 2.5 cp in viscosity is adopted as liquid to be ejected from the ejection opening 232.

Figure 69A:
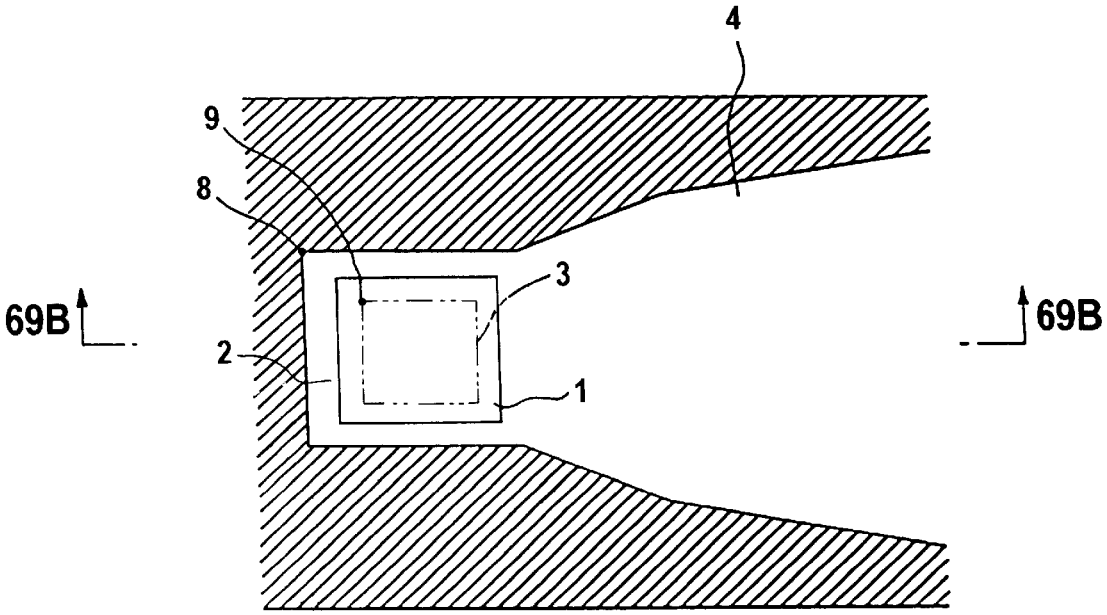
FIG. 69A is an essential part cross section of a liquid ejection head constituting a comparative embodiment of the ejection opening of the present invention.
Figure 69B:
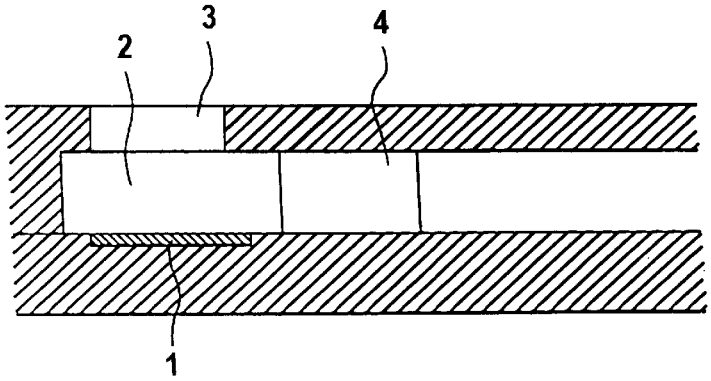
FIG. 69B shows a cross section 69B—69B thereof.
Figure 70A:
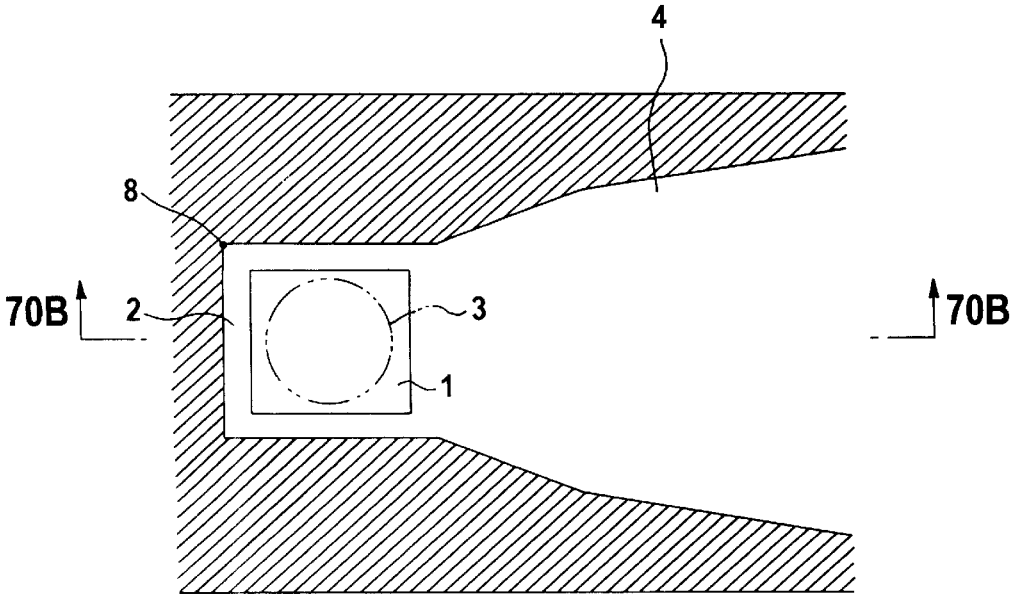
FIG. 70A is an essential part cross section of a liquid ejection head constituting a comparative embodiment of the ejection opening of the present invention.
Figure 70B:
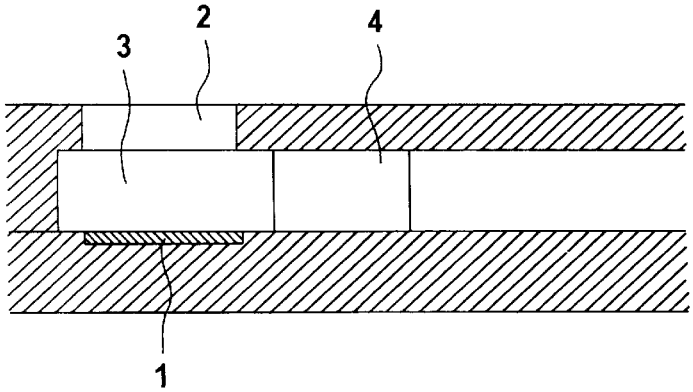
FIG. 70B shows a cross section 70B—70B thereof.

The remaining bubble state of such an ink-jet head, ink droplet ejection speed, and the volume of ink droplet are measured and compared to those of the conventional ink-jet head shown in FIGS. 69A and 70A (FIGS. 69B and 70B are respectively the cross sections of the essential parts of FIGS. 69A and 70A) and the results are represented in Table 1. In this case, the ejection opening 3 of the conventional ink-jet head shown in FIG. 69A is a square 18.5 μm an each side (opening area of about 342 $\mu m^2$), and the distance between the corner section 8 of the bubble generation chamber 2 positioned in the opposite side to the connection portion between the bubble generation chamber 2 and the liquid passage 4, and the angular section 9 of the ejection opening 3 in the proximity thereof is 7.25 μm respectively along the ejection opening width direction (vertical direction in FIG. 69A), and along its length direction (horizontal direction in FIG. 69A), its straight distance being about 10.25 μm. Moreover, the ejection opening 3 of the conventional ink-jet head shown in FIG. 70A is a circle 21.0 μm in diameter (opening area of about 346 $\mu m^2$), and the shortest distance between the corner section 8 of the bubble generation chamber 2 positioned in the opposite side to the connection portion between the bubble generation chamber 2 and the liquid passage 4, and the ejection opening 3 in the proximity thereof is about 12.8 μm. In both embodiments, the gravity center of the contour of the electrothermal converting element 1 and the gravity center of the contour of the ejection opening 3 respectively projected on a plane orthogonal to the droplet ejecting direction agree with each other.

TABLE 4

| Ejection opening configuration | Present embodiment | Rectangular | Circular |
|---|---|---|---|
| First ink droplet ejection speed (m/s) | 19 | 19 | 19 |
| Continuous ejection speed (m/s) | 17 | 15 | 13 |
| Ejection speed fluctuation (m/s) | 1 | 2.5 | 3.5 |
| Ejection volume (pl) | 9 | 8.6 | 7.8 |

According to the aforementioned, it was found that the bubble size remaining in the corners 237*a* and 8 of the bubble generation chambers 237 and 2 increases according to the shape of the ejection openings 232 and 3 in the order of this embodiment (isosceles triangle)<rectangular (square)<circle. As shown in Table 4, the first ink droplet speed was measured, to measure the inherent ink droplet ejection speed, because there is no remaining bubble in the corners 237*a* and 8 of the bubble generation chambers 237 and 2, during the first ink droplet ejection.

As is evident from Table 4, the first ink droplet speed is always 19 m/s independently of the shape of the ejection openings 232 and 2, along the accumulation of remaining bubbles in the corners 237*a* and 8 of the bubble generation chambers 237 and 2, whereas during continuous ejection, the ink droplet ejection speed tends to decrease; however, in this embodiment, the ejection speed fluctuation is small, and the ejection is stable. The ejection speed fluctuation is known to cause deterioration of the deposition position accuracy of ink droplets deposited on a print medium. As the areas of ejection openings 232 of the three (3) ink-jet heads are substantially equal, the ejection volume should be the same, but in the conventional ones other than this embodiment, the ejection volume decreases notably.

A bubble remaining in the corner section 237*a* of the bubble generation chamber 237 is evacuated more easily from the angular section 232*b* of the ejection opening 232 by reducing the distance between the corner section 237*a* of the bubble generation chamber 237 and the angular section 232*b* of the ejection opening 232 in the proximity thereof. The angle θ defined by a pair of plane sections defining respectively the angular section 232*b* of the ejection opening 232 is respectively set to an acute angle to prevent the ejection opening 232 opening area from increasing, stabilize the ink droplet ejection, and mitigate print quality deterioration due to a lower ink density on a print medium or a lower hitting accuracy.

A defective droplet ejection due to the state shown in FIGS. 23–26 can be suppressed, because the liquid passage side end section of the ejection opening 232 is positioned at the liquid passage 238 side rather than near the electrothermal converting element 231.

In the conventional ink-jet head shown in FIG. 69A, the distance between the center of the electrothermal converting element 1 projected on a plane vertical to the ink droplet ejecting direction from the ejection opening 3 and the liquid passage 4 side end section of the ejection opening 3 is 7.75 μm, and it takes about 33 μs to refill the ejection opening 3 with ink in the liquid passage 4; in the conventional shown in FIG. 70B, the distance between the center of the electrothermal converting element 1 from the ejection opening 3 and the liquid passage 4 side end section of the ejection opening 3 is 8.75 μm, and it takes about 30 μs to refill the ejection opening 3 with ink in the liquid passage 4; while in this embodiment, it was confirmed that an adequate distance between the center of the electrothermal converting element 231 and the liquid passage 238 side end section of the ejection opening 232 is 17 μm, and it takes about 20 μs for ink to refill the liquid passage 238 up to the ejection opening 232.

In this embodiment, air in the bubble generation chamber 237 is evacuated easily from the ejection opening 232, by rapidly refilling up to the end section 237 of the ejection opening 232 with liquid in the liquid passage 238, preventing defective ejecting from occurring.

The variation of this embodiment will now be explained referring to FIGS. 63–68.

Figure 63A:
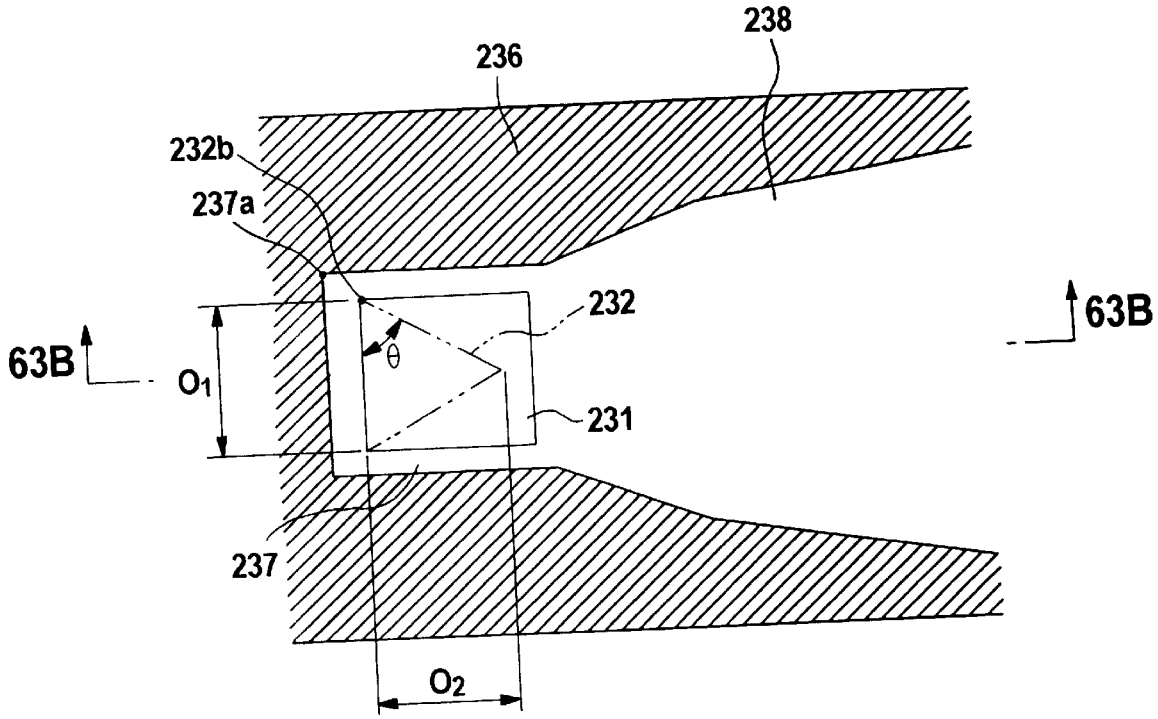
FIG. 63A is an essential part cross section showing a variation of the liquid ejection head according to the fifth embodiment of the present invention with FIGS. 64–68.
Figure 63B:
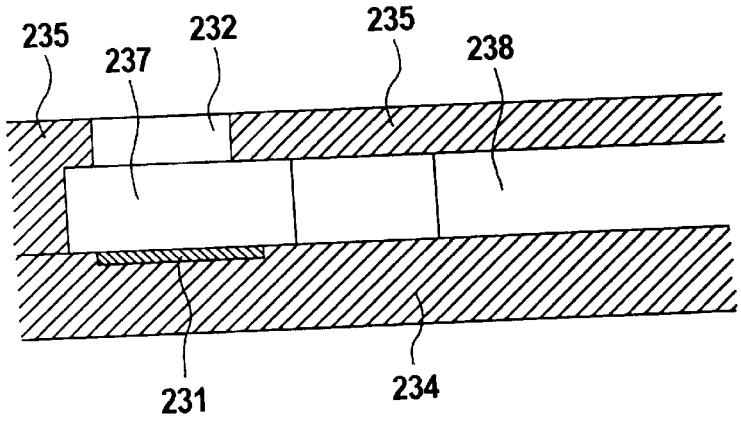
FIG. 63B shows a cross section 63B—63B thereof.

In the aforementioned embodiment, the gravity center of the contour of these electrothermal converting elements 231 and the gravity center of the contour of the ejection opening 232 projected on a plane orthogonal to the droplet ejecting direction were made to agree with each other; however, these gravity centers may be offset to each other. Such variation is shown in FIGS. 63A and 63B. In this variation, in respect of the gravity center of the contour of the electrothermal converting element 231 projected on a plane orthogonal to the droplet ejecting direction, the gravity center of the contour of the ejection opening 232 is offset to a position remote from the connection portion between the bubble generation chamber 237 and the liquid passage 238. Besides, the shape of the ejection opening 232 projected on a plane orthogonal to the droplet ejecting direction (upward in FIG. 63A) is an isosceles triangle (opening area of about 345 $\mu m^2$), having a width $0_1$ of 30 μm and a length $0_2$ of 23 μm, surrounded by three (3) plane sections, and the ejection opening 232 opening area is prevented from increasing by making acute the angle θ formed by the plane section composing the base of this isosceles triangle and the plane section composing the oblique side. The distance between the corner section 237*a* of the bubble generation chamber 237 positioned in the opposite side to the connection portion between the bubble generation chamber 237 and the liquid passage 238, and the angular section 232*b* of the plane section composing the base of the isosceles triangle of the ejection opening 232 in the proximity thereof is 1.5 μm respectively along the ejection opening 237 width direction and length direction, its straight distance is 9.3 μm, while the other composition is basically identical to that of the previous embodiments.

Figure 71A:
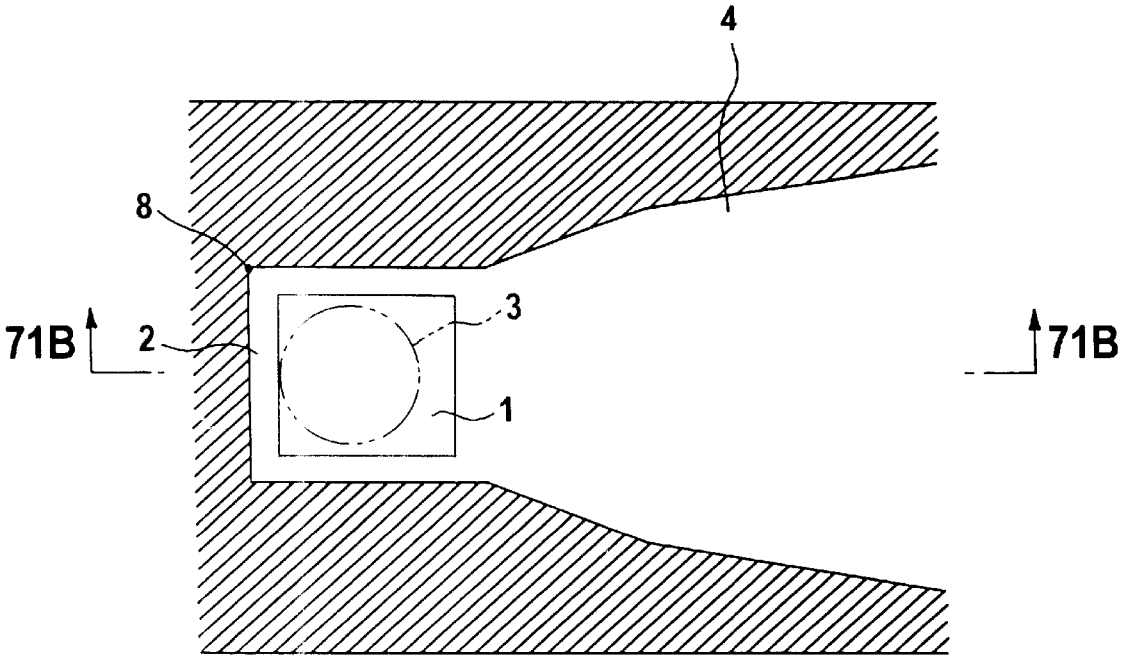
FIG. 71A is an essential part cross section of a liquid ejection head constituting a comparative embodiment of the ejection opening of the present invention.
Figure 71B:
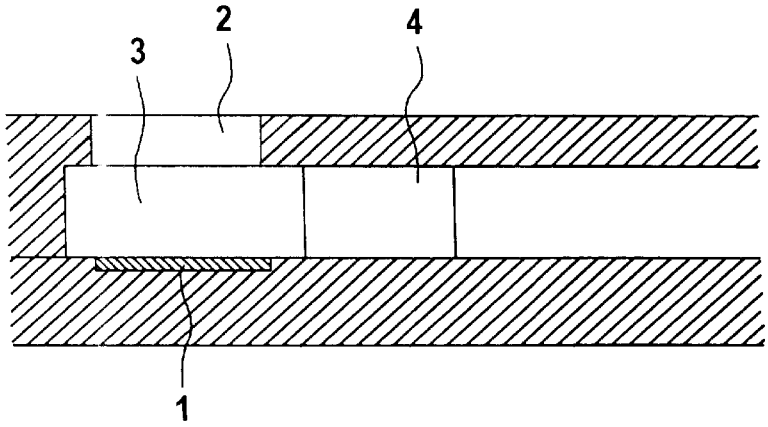
FIG. 71B shows a cross section 71B—71B thereof.
Figure 72A:
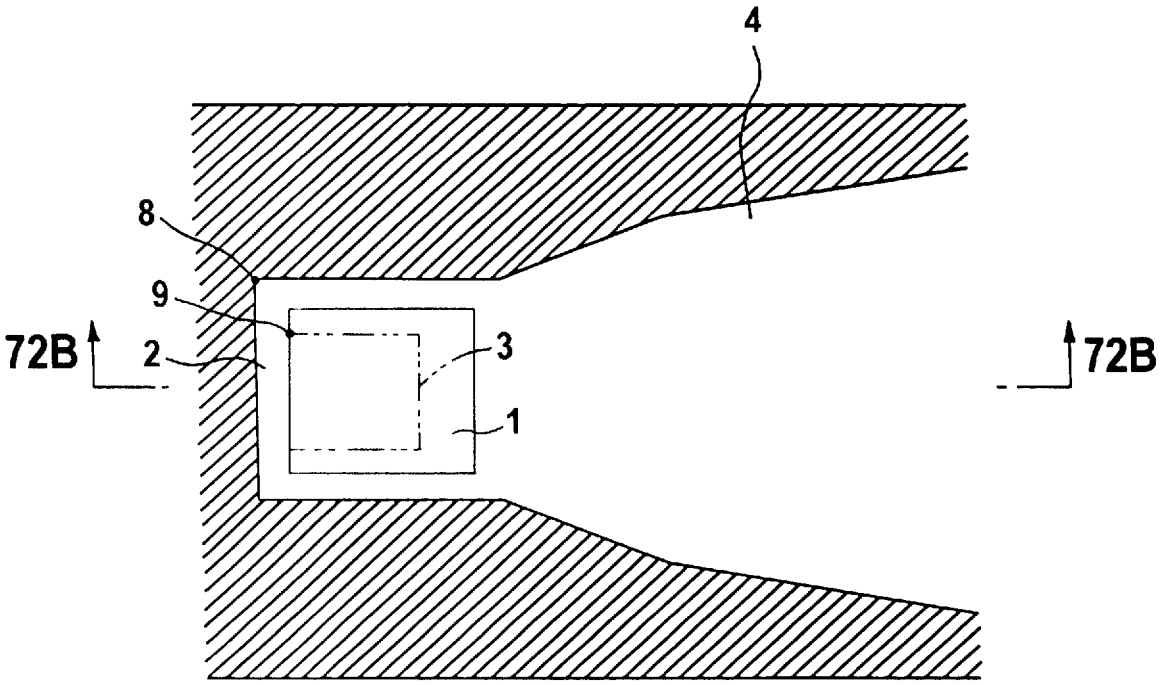
FIG. 72A is an essential part cross section of a liquid ejection head constituting a comparative embodiment of the ejection opening of the present invention.
Figure 72B:
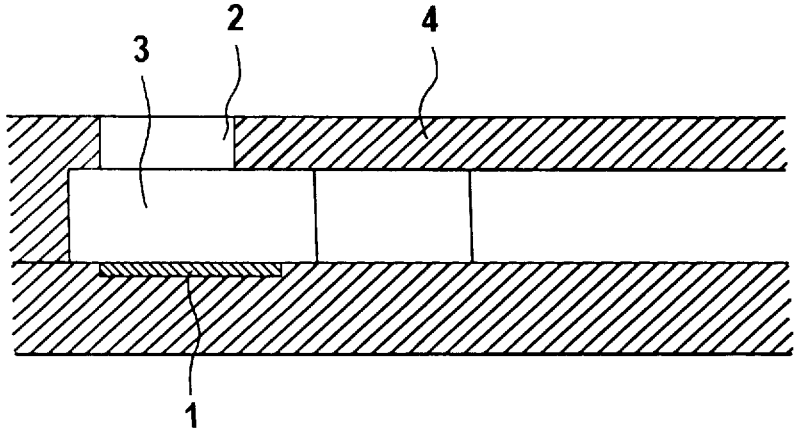
FIG. 72B shows a cross section 72B—72B thereof.

The remaining bubble state of such an ink-jet head, ink droplet eject speed, and the volume of an ink droplet are measured, and compared to those of the conventional ink-jet head shown in FIGS. 71 and 72, and the results thereof are represented in Table 3. In this case, the ejection opening 3 of the conventional ink-jet head shown in FIG. 71A is a square 18.5 μm on each side (opening area of about 342 $\mu m^2$), and the distance between the corner section 8 of the bubble generation chamber 2 positioned in the opposite side to the connection portion between the bubble generation chamber 2 and the liquid passage 4, and the angular section 9 of the ejection opening 3 in the proximity thereof is 7.25 μm and 1.5 μm respectively along the ejection opening width direction (vertical direction in FIG. 71A), and along its length direction (horizontal direction in FIG. 71A), its straight distance being 7.4 μm. The ejection opening 3 of the conventional ink-jet head shown in FIGS. 72A and 72B is a circle 21.0 μm in diameter (opening area of about 346 $\mu m^2$), and the shortest distance between the corner section 8 of the bubble generation chamber 2 positioned in the opposite side to the connection portion between the bubble generation chamber 2 and the liquid passage 4, and the ejection opening 3 in the proximity thereof is about 9.9 μm.

In both of these conventional ink-jet heads, the gravity center of the contour of the electrothermal converting element 1 and the gravity center of the contour of the ejection opening 3 respectively projected on a plane orthogonal to the droplet ejecting direction do not agree with each other. In FIGS. 71 and 72 parts having the same function as those of the embodiment shown in FIGS. 69 and 70 described above have the same symbol.

TABLE 5

| Ejection opening configuration | Present embodiment | Rectangular | Circular |
|---|---|---|---|
| First ink droplet ejection speed (m/s) | 19 | 19 | 19 |
| Continuous ejection speed (m/s) | 19 | 17.5 | 15 |
| Ejection speed fluctuation (m/s) | 0.5 | 1 | 2.5 |
| Ejection volume (pl) | 9 | 9 | 8.6 |

According to the aforementioned experiment results, it was found that the bubble size remaining in the corner 8 of the bubble generation chamber 2 increases by the shape of the ejection openings 232 and 3 in the order of this embodiment (isosceles triangle)<rectangular (square)<circle; however, remaining bubbles hardly ever observed in this embodiment.

As it is evident from Table 5, it was found that a bubble remaining in the corner section 237*a* of the bubble generation chamber 237 is evacuated more easily from the angular section 232*b* of the ejection opening 232, by offsetting the gravity center of the contour of the ejection opening 232 projected on a plane orthogonal to the droplet ejecting direction, to a position remote from the connection portion between the bubble generation chamber 237 and the liquid passage 238 with respect to the gravity center of the contour of the electrothermal converting element 231.

Figure 64A:
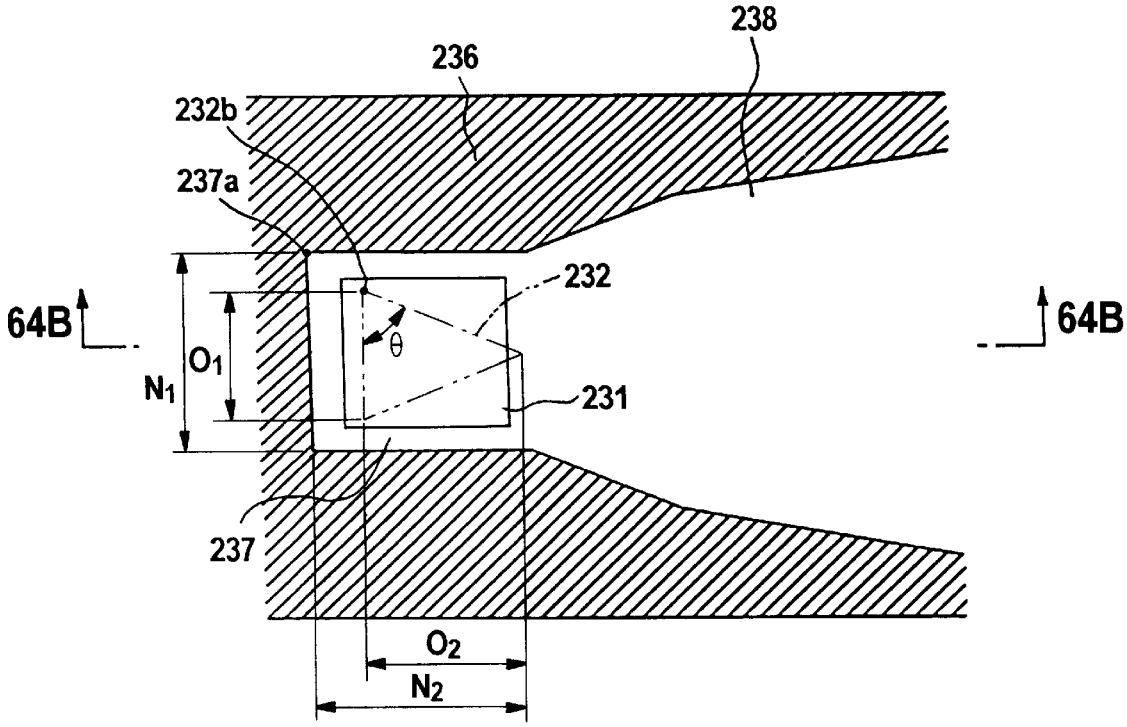
FIG. 64A is an essential part cross section showing a variation of the liquid ejection head according to the fifth embodiment of the present invention with FIGS. 63 and 65–68.
Figure 64B:
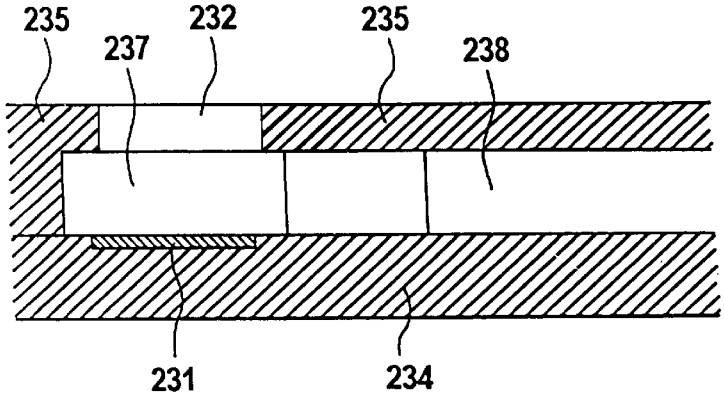
FIG. 64B shows a cross section 64B—64B thereof.

In the aforementioned embodiment, the density of ejection openings 232 arranged in a row is set to 300 dpi; however, by setting it to 600 dpi for instance, and adopting the same arrangement as shown in FIG. 3, it is possible to set the apparent density of the ink-jet head ejection opening 232 to 1200 dpi. Such variation is shown in FIGS. 64A and 64B. In this variation, the coating resin layer 235 is 13 $\mu$m in thickness, and the thickness of the partition 236 isolating the adjacent bubble generation chamber 237 is set to 10.5 $\mu$m. The dimensions of the bubble generation chamber 237 in this embodiment is 29 $\mu$m in width $N_1$ and 31 $\mu$m in length $N_2$, while the configuration of the ejection opening 232 projected on a plane orthogonal to the droplet ejecting direction (upward in FIG. 64B) is an isosceles triangle (opening area of about 240 $\mu m^2$) having a width $0_1$ of 20 $\mu$m and a length $0_2$ of 24 $\mu$m, surrounded by three (3) plane sections, and the ejection opening 232 opening area is prevented from increasing by making acute the angle θ formed by the plane section composing the base of this isosceles triangle and the plane section composing the oblique side. The distance between the corner section 237*a* of the bubble generation chamber 237 positioned in the opposite side to the connection portion between the bubble generation chamber 237 and the liquid passage 238, and the angular section 232*b* of the plane section composing the base of the isosceles triangle of the ejection opening 232 in the proximity thereof is 4.5 $\mu$m along the ejection opening 237 width direction (vertical direction in FIG. 64B), about 7.5 $\mu$m along its length direction (horizontal direction in FIG. 64A), its straight distance being about 8.7 $\mu$m. The electrothermal converting element 231 forms a square of 26 $\mu$m each side, has a resistance value of 53 Ω, is connected to a driver (not shown) through a wiring (not shown), and is driven by a driving voltage of 9.5V, the other arrangement being basically identical to the aforementioned embodiment shown in FIG. 17.

Even when the ejection opening 232 density is doubled, results presenting the same trend as the embodiment shown in Table 4 can be obtained.

In the variation shown in FIGS. 63A and 63B, the plane section composing the base of the isosceles triangle of the ejection opening 232 projected on a plane orthogonal to the droplet ejecting direction is superposed on the periphery of the electrothermal converting element 231 positioned in the opposite side to the connection portion between the bubble generation chamber 237 and the liquid passage 238; however, it may well agree with the partition of the bubble generation chamber 237 situated in the opposite side with respect to the connection portion between the bubble generation chamber 237 and the liquid passage 238.

Figure 65A:
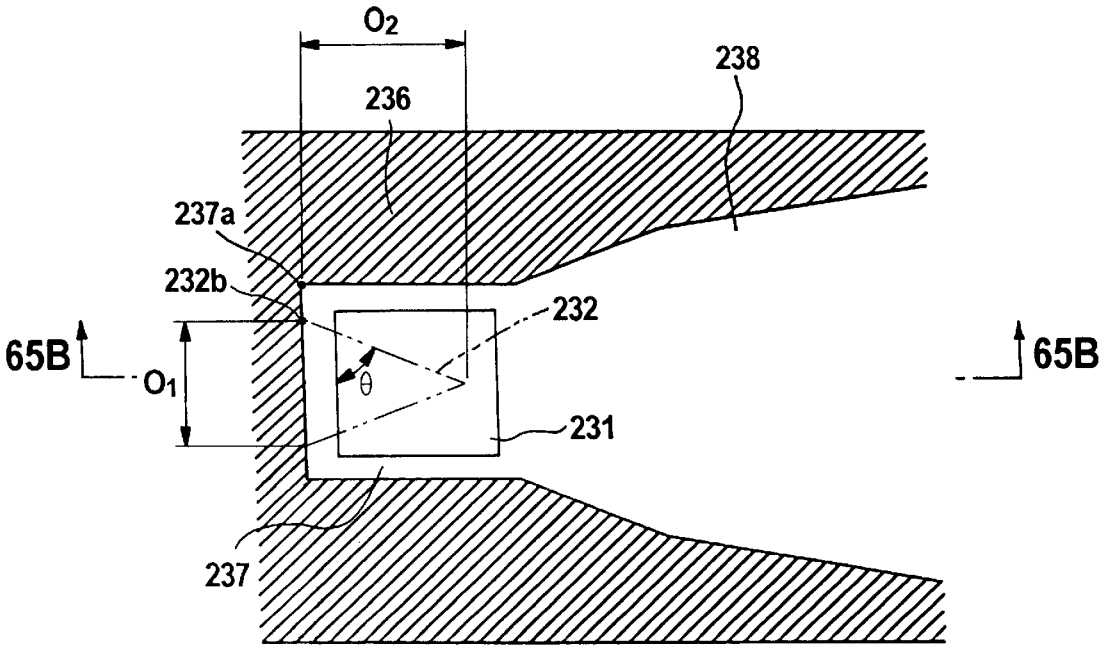
FIG. 65A is an essential part cross section showing a variation of the liquid ejection head according to the fifth embodiment of the present invention with FIGS. 63, 64 and 66–68.
Figure 65B:
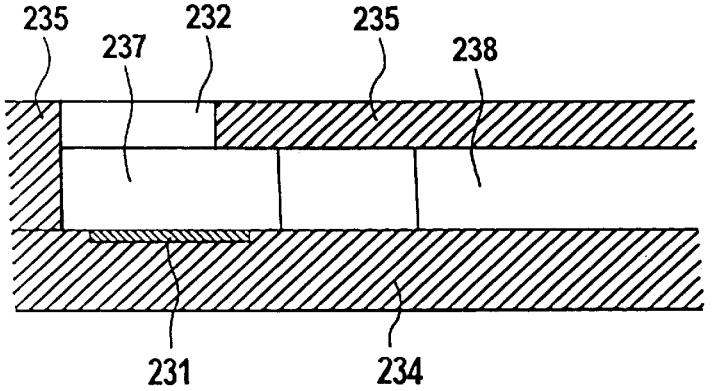
FIG. 65B shows a cross section 65B—65B thereof.

Still another variation of a liquid ejection head according to this embodiment is shown in FIGS. 65A and 65B. In this embodiment, parts of the same function as those of the above-described embodiment have the same symbol, and their redundant description will be omitted.

In this embodiment, the plane section composing the base of the isosceles triangle of the ejection opening 232 projected on a plane orthogonal to the droplet ejecting direction is positioned in the same plane as the partition of the bubble generation chamber 237 situated in the opposite side with respect to the connection portion between the bubble generation chamber 237 and the liquid passage 238, while the configuration of the ejection opening 232 is an isosceles triangle, having a width $0_1$ of 25 $\mu$m and a length $0_2$ of 27.75 $\mu$m, surrounded by three (3) plane sections, and the angle θ formed by the plane section composing the base of this isosceles triangle and the plane section composing the oblique side is made acute. The distance between the corner section 237*a* of the bubble generation chamber 237 positioned in the opposite side to the connection portion between the bubble generation chamber 237 and the liquid passage 238, and the angular section 232*b* of the plane section composing the base of the isosceles triangle of the ejection opening 232 in the proximity thereof is set to 4 $\mu$m, allowing a further reduction in the number of bubbles remaining in corner section 237*a* of the bubble generation chamber 237.

Figure 66A:
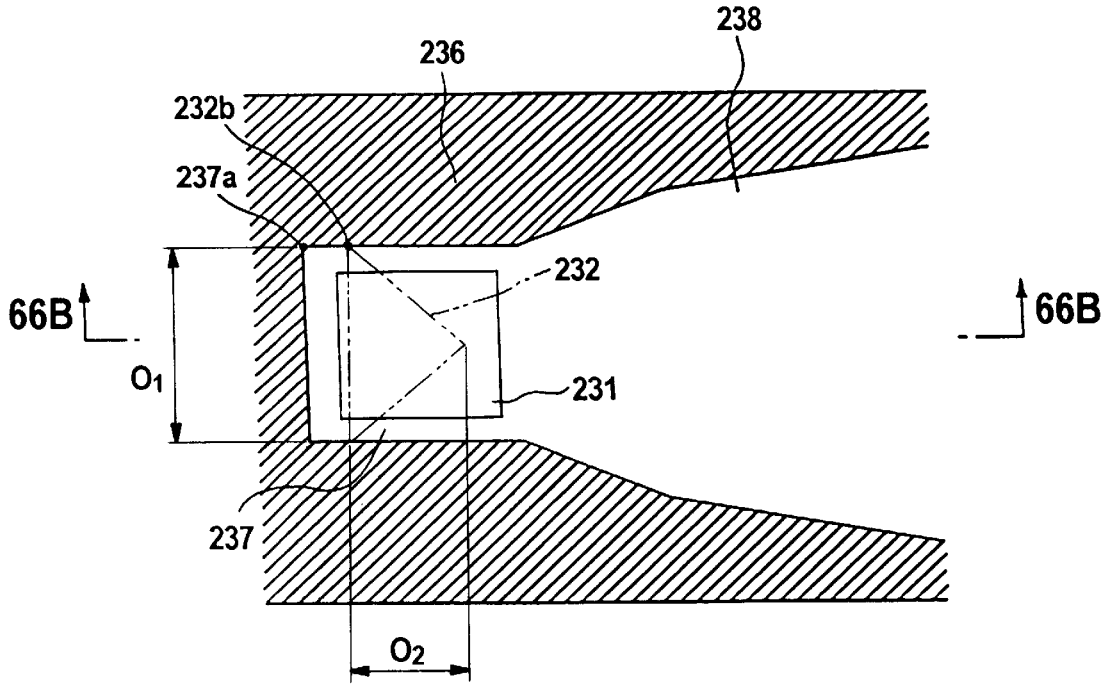
FIG. 66A is an essential part cross section showing a variation of the liquid ejection head according to the fifth embodiment of the present invention with FIGS. 63–65, 67 and 68.
Figure 66B:
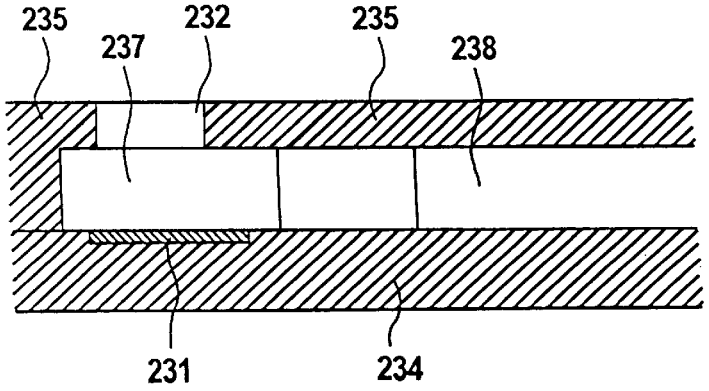
FIG. 66B shows a cross section 66B—66B thereof.
Figure 67A:
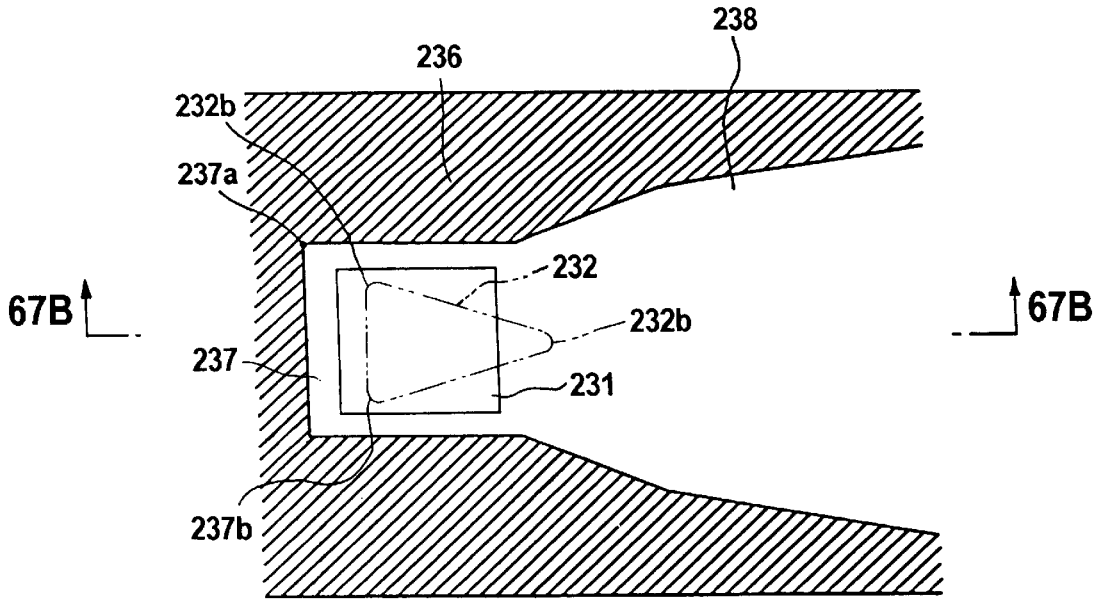
FIG. 67A is an essential part cross section showing a variation of the liquid ejection head according to the fifth embodiment of the present invention with FIGS. 63–66 and 68.
Figure 67B:
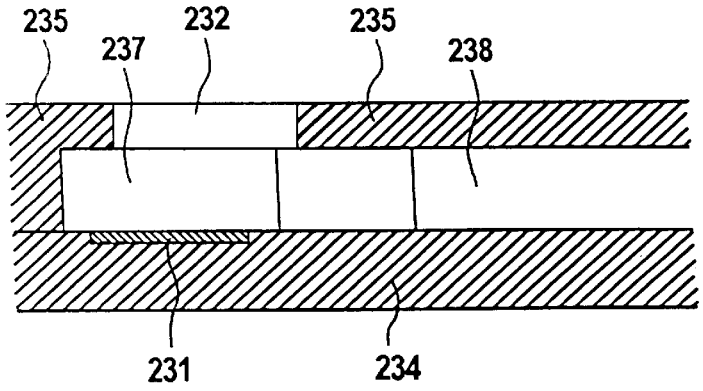
FIG. 67B shows a cross section 67B—67B thereof.

In a variation shown in FIGS. 66A and 66B, the distance between the corner section 237*a* of the bubble generation chamber 237 positioned in the opposite side to the connection portion between the bubble generation chamber 237 and the liquid passage 238, and the angular section 232*b* of the ejection opening 232 in the proximity thereof is reduced by making the width of the ejection opening 232 equal to the width of the bubble generation chamber 237. In this variation, the ejection opening 232 width $0_1$ agrees with the bubble generation chamber 237 width $N_1$, and the configuration is an isosceles triangle having the ejection opening 232 width $0_1$, namely bubble generation chamber 237 width $N_1$ set to 33 $\mu$m, the length $0_2$ to 21 $\mu$m, surrounded by three (3) plane sections, and the angle θ formed by the plane section composing the base of this isosceles triangle and the plane section composing the oblique side is made acute. Moreover, the distance between the corner section 237*a* of the bubble generation chamber 237 positioned in the opposite side to the connection portion between the bubble generation chamber 237 and the liquid passage 238, and the angular section 232*b* of the plane section composing the base of the isosceles triangle of the ejection opening 232 in the proximity thereof is set to 6 μm, allowing a reduction in the number of bubbles remaining in the corner section 237*a* of the bubble generation chamber 237.

Figure 68A:
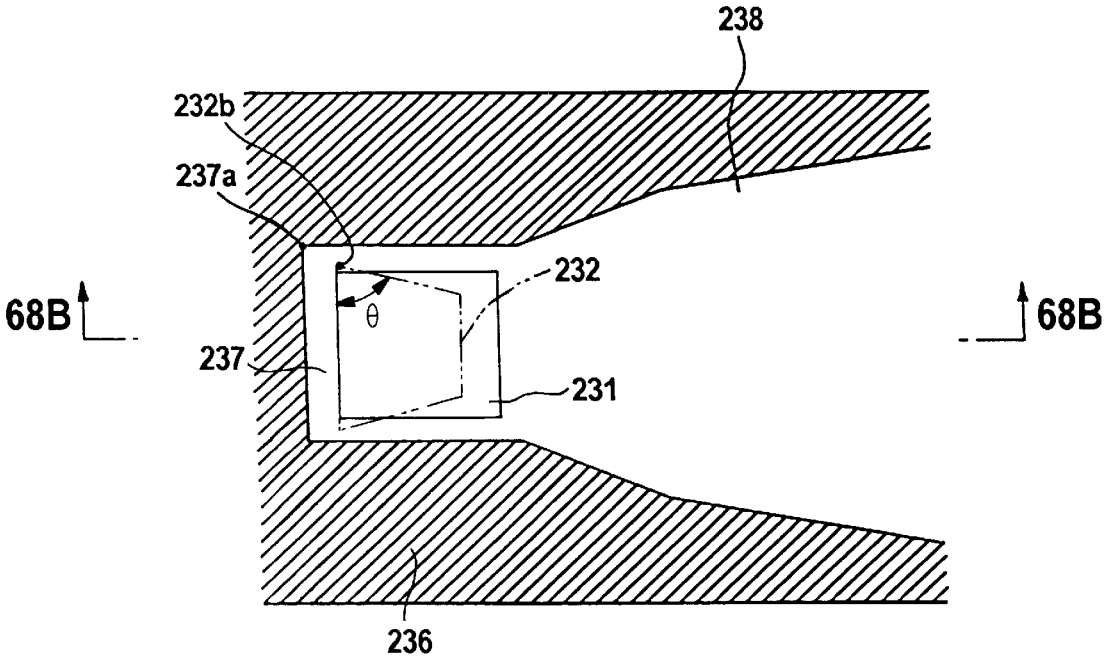
FIG. 68A is an essential part cross section showing still another variation of the liquid ejection head according to the fifth embodiment of the present invention with FIGS. 63–67.
Figure 68B:
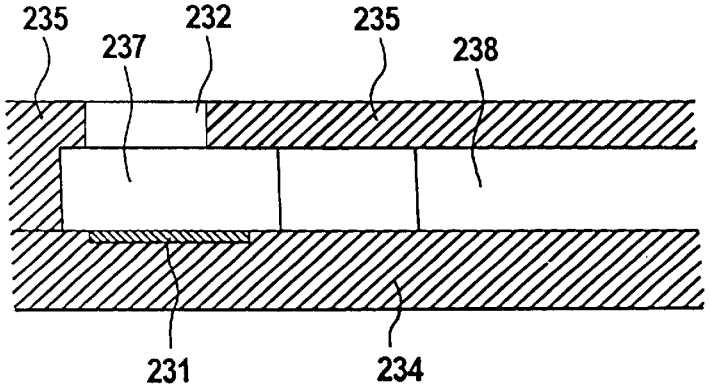
FIG. 68B shows a cross section 68B—68B thereof.

The variation shown in FIGS. 68A and 68B facilitate the evacuation of bubbles by importing to the angular section of the adjacent plane section an arcuate surface.

In the aforementioned variation, all ejection opening 232 are made of isosceles triangles; however, they may well be rectangular or have other polygonal shapes. FIGS. 68A and 68B show an outline configuration of still another embodiment of a liquid ejection head according to this embodiment. In this variation, the ejection opening 232 projected on a plane orthogonal to the droplet ejecting direction is configured to an equilateral trapezoid, composed of four (4) plane sections. The angle θ is defined by a pair of plane sections defining respectively a pair of angular sections 232*b* in the proximity of the corner section 237*a* of the bubble generation chamber 237 positioned in the opposite side to the connection portion between the bubble generation chamber 237 and the liquid passage 238 to prevent the ejection opening 232 opening area from increasing.

Other Embodiments

The present invention achieves a distinct effect when applied to a printing head or a printing apparatus which has means for generating thermal energy such as electrothermal transducers or laser beams, and which causes changes in ink by the thermal energy so as to eject ink. This is because such a system can achieve a high density and high-resolution printing.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink-jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces a sudden temperature rise that exceeds the nucleate boiling point so as to cause film boiling on the heating portions of the printing head; and third, bubbles are grown in the liquid (ink) corresponding to the drive signals. By using the growth and collapse of the bubbles, the ink is expelled from at least one of the ink ejection orifices of the head to form one or more ink droplets. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

The present invention can also be applied to a so-called full-line type printing head whose length equals the maximum length across a printing medium. Such a printing head may consist of a plurality of printing heads combined together, or one integrally arranged printing head.

In addition, the present invention can be applied to a serial type printing head fixed to the main assembly of a printing apparatus.

It is further preferable to add a recovery system, or a preliminary auxiliary system for a printing head as a constituent of the printing apparatus so as to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can also be changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing. In this case, it is also effective to eject onto a print medium through a specialized liquid ejection head treatment liquid (printing improvement liquid) to adjust the ink printability according to the nature of the print medium or the printing mode.

Furthermore, although the above-described embodiments use liquid ink, inks that are liquid when the printing signal is applied can be used: for example, inks can be employed that solidify at a temperature lower than the room temperature and are softened or liquefied at room temperature. This is because in the ink-jet system, the ink is generally temperature-adjusted in a range of 30° C. –70° C. so that the viscosity of the ink is maintained at such a value that the ink can be ejected reliably.

In addition, the present invention can be applied to an apparatus where the ink is liquefied just before the ejection by the thermal energy so that the ink is expelled from the orifices in the liquid state, and then begins to solidify on hitting the printing medium, thereby preventing ink evaporation: the ink is transformed from solid to liquid state by utilizing the thermal energy which would otherwise cause a temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application laid-open Nos. 54-56847 (1979) or 60-71260 (1985). The present invention is most effective when it uses the film-boiling phenomenon to expel the ink.

Furthermore, the ink-jet printing apparatus of the present invention can be employed not only as an image output terminal of an information processing device such as a computer, but also as an output device of a copying machine including a reader, and as an output device of a facsimile apparatus having a transmission and receiving function. Print media include a sheet or web of paper or cloth; plate-shaped wood, resin, glass, or metal; or three-dimensional structures.

The present invention has been described in on detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid ejection head which applies thermal energy to change a state of a liquid to generate a bubble, the liquid being ejected by the pressure of the generated bubble, comprising:

an ejection opening portion having a grooved ejection opening through which the liquid is ejected, the ejection opening having a plurality of grooves distributed about a center of said ejection opening and extending along the ejection direction of the liquid, each of said grooves being shaped by a pair of walls which are connected in a V-shape and which meet at an acute angle;

a liquid passage in fluid communication with said ejection opening portion for conducting the liquid to said ejection opening portion, and a heat resistance element disposed by the liquid passage which generates thermal energy to eject the liquid from said ejection opening, wherein the liquid is ejected as the bubble's volume decreases after the bubble has reached its maximum volume.

2. The liquid ejection head of claim 1, wherein the liquid is ejected as the bubble's volume decreases while the bubble communicates with the atmosphere.

3. The liquid ejection head of claim 1, wherein a gravity center of a polygon defined by connecting center portions of mutually adjacent ones of said grooves corresponds approximately to a gravity center of a polygon defined by connecting bases of mutually adjacent ones of said grooves.

4. The liquid ejection head of claim 1, comprising at least six of said grooves.

5. The liquid ejection head of claim 1, further comprising:

a liquid chamber which supplies the liquid to said liquid passage, and wherein said ejection opening is disposed at a position opposed to said heat resistance element, and the liquid passage between said ejection opening and the heat resistance element is surrounded by wall surfaces defining sidewalls of the passage except for the direction toward said liquid chamber.

6. The liquid ejection head of clam 5, wherein a top of at least one of said grooves is disposed in the direction toward a corner portion of a volume surrounded by the wall surfaces defining said passage sidewall.

7. The liquid ejection head of claim 5, wherein said grooves are disposed substantially symmetrically with respect to a line passing through said liquid chamber and through a center of said ejection opening.

8. The liquid ejection head of claim 1, wherein a top of at least one of said grooves is disposed in the direction toward a liquid chamber.

9. The liquid ejection head of claim 1, wherein tops and bases of said grooves are curved surfaces.

10. The liquid ejection head of claim 1, wherein an angle defining said groove top is between 30 and 90 degrees, inclusive.

11. A liquid ejection head, comprising:

an ejection opening portion having a grooved ejection opening through which a liquid is ejected, the ejection opening portion having a plurality of grooves extending in a liquid ejecting direction which prevent droplets of the liquid deposited on a face of said ejection opening portion from obstructing the ejection opening;

a liquid passage in fluid communication with the ejection opening portion to supply the liquid to said ejection opening portion; and an ejector element disposed at the liquid passage to eject the liquid from said ejection opening, wherein said ejection opening portion is at least 7 $\mu$m thick, and the sectional area of each said groove at said ejection opening surface is not more than 30 $\mu m^2$.

12. The liquid ejection head of claim 11, wherein said plurality of grooves are arranged around a center of said ejection opening.

13. The liquid ejection head of claim 12, wherein a gravity center of a polygon defined by connecting center portions of mutually adjacent ones of said grooves corresponds approximately to a gravity center of a polygon defined by connecting bases of mutually adjacent ones of said grooves.

14. The liquid ejection head of claim 12, wherein said ejector is a heat resistance element for generating thermal energy to change a state of the liquid to form a bubble, and eject the liquid as a result of the pressure caused by the bubble, the liquid being ejected after the bubble's volume has reached its maximum.

15. The liquid ejection head of claim 11, wherein tops and bases of said groove are curved surfaces.

16. The liquid ejection head of claim 11, wherein an angle defining said groove top is between 30 and 90 degrees, inclusive.

17. A liquid ejection head, comprising:

an ejection opening portion having a grooved ejection opening through which a liquid is ejected, the ejection opening having a plurality of grooves extending in a liquid ejecting direction, the grooves being dimensioned and disposed to generate a capillary force in the liquid which exceeds an adhesive force due to the surface tension of a droplet of the liquid attached to an ejection opening surface, each of said grooves being shaped by a pair of walls which are connected in a V-shape and which meet at an acute angle;

a liquid passage in fluid communication with the ejection opening portion for providing the liquid to said ejection opening portion; and an ejector element disposed by the liquid passage for ejecting the liquid from said ejection opening.

18. The liquid ejection head of claim 17, wherein each said groove includes a liquid retaining area which temporarily retains the liquid.

19. The liquid ejection head of claim 17, wherein said grooves are arranged around a center of said ejection opening.

20. The liquid ejection head of claim 19, wherein a gravity center of a polygon defined by connecting center portions of mutually adjacent ones of said grooves corresponds approximately to a gravity center of a polygon defined by connecting bases of mutually adjacent ones of said grooves.

21. The liquid ejection head of claim 17, wherein said ejector element is a heat resistance element for generating thermal energy to change a state of the liquid to form a bubble, and eject the liquid through pressure caused by the bubble, the liquid being ejected after the bubble's volume has reached its maximum.

22. A liquid ejection head, comprising:

an ejection opening portion having a grooved ejection opening through which a liquid is ejected, the ejection opening having a plurality of grooves extending in a liquid ejecting direction, each of said groves being shaped by a pair of walls which are connected in a V-shape and which meet at an acute angle;

a liquid passage in fluid communication with the ejection opening portion for providing the liquid to said ejection opening portion; and an ejector element disposed in the liquid passage which ejects the liquid from said ejection opening;

wherein the area near the top of the groove is relatively convex in the liquid ejecting direction as compared to other areas of an ejection opening surface.

23. The liquid ejection head of claim 22, wherein each said groove has a liquid retaining area which temporarily retains the liquid.

24. The liquid ejection head of claim 22, wherein said grooves are arranged about a center of said ejection opening.

25. The liquid ejection head of claim 24, wherein said ejector element is a heat resistance element which generates thermal energy to change a state of the liquid to form a bubble, and eject the liquid through pressure caused by the bubble, the liquid being ejected after the bubble's volume has reached its maximum.

26. The liquid ejection head of claim 22, wherein a gravity center of a polygon defined by connecting center portions of mutually adjacent ones of said grooves corresponds approximately to a gravity center of a polygon defined by connecting bases of mutually adjacent ones of said grooves.

27. The liquid ejection head of claim 22, wherein the ejection opening portion is at least 7 $\mu$m thick, and the sectional area of each said groove at said ejection opening surface is not more than 30 $\mu m^2$.

28. The liquid election head of claim 22, wherein the liquid adheres more strongly to the surface over which said groves of the ejection opening portion extend than to a face forming said ejection opening.

29. A method for preventing accidental non-ejection by a liquid ejection head due to a liquid deposited by a grooved ejection opening of the head, the head having an ejection opening portion having a face having the ejection opening through which the liquid is ejected, the ejection opening having a plurality of grooves extending in a liquid ejecting direction, a liquid passage in fluid communication with the ejection opening portion for providing the liquid to said ejection opening portion, and an ejector element disposed by the liquid passage to eject the liquid from said ejection opening:

comprising the steps of:

sucking the liquid in said liquid passage into at least one said groove, after the liquid has been ejected from said ejection opening portion by said ejector element;

drawing the liquid deposited on the face having said ejection opening into at least one said groove; and moving the liquid deposited on the face toward said liquid passage side so as not to obstruct said ejection opening, through contact, in said groove, of the liquid in said liquid passage and the liquid deposited on the face defining said ejection opening.

30. The method according to claim 29, wherein each said groove has a liquid retaining area which temporarily retains the liquid, and further comprising the step of temporarily retaining the liquid in said liquid retaining area.

31. The method according to claim 29, wherein said grooves are arranged about a center of said ejection opening.

32. A liquid ejection head, comprising:

an ejection opening potion having a grooved ejection opening through which a liquid is ejected, the ejection opening portion having a plurality of grooves extending in a liquid ejecting direction, each of said grooves being shaped by a pair of walls which are connected in a V-shape and which meet at an acute angle;

a liquid passage in fluid communication with the ejection opening portion for providing the liquid to said ejection opening portion; and an ejector element disposed by the liquid passage to eject the liquid from said ejection opening; wherein said ejection opening portion is formed by etching.

33. The liquid ejection head of claim 32, wherein the ejection opening portion is at least 7 $\mu$m thick, and the sectional area of each said groove at said ejection opening surface is not more than 30 $\mu m^2$.

34. The liquid ejection head of claim 32, further comprising a protrusion in the liquid passage side of at least one said grove and extending from a top of said at least one groove toward its base.

35. The liquid ejection head of claim 32, wherein said grooves are tapered, so that the opening sectional area of a section along a face having said ejection opening increases from said ejection opening side towards said liquid passage side.

36. The liquid ejection head of claim 32, wherein tops and bases of said grooves are curved surfaces.

37. The liquid ejection head of claim 32, wherein in said ejection opening side end section of each said groove, an area near a top of the groove is relatively convex to the liquid ejecting direction, compared to other areas of said ejection opening surface.

38. A liquid ejection head, comprising:

an ejection opening portion having a grooved ejection opening through which a liquid is ejected, and having a plurality of grooves extending in a liquid ejecting direction, each of said grooves being shaped by a pair of walls which are connected in a V-shape and which meet at an acute angle;

a liquid passage in fluid communication with said ejection opening portion for providing the liquid to said ejection opening portion;

an ejector element disposed by the liquid passage to eject the liquid from said ejection opening; and a liquid chamber which supplies said liquid passage with the liquid, wherein a state of the liquid is changed when thermal energy is applied to the liquid by the ejector element to generate a bubble, the liquid being ejected through pressure caused by the bubble, and the liquid passage between said ejection opening and the heat resistance element is surrounded by wall surfaces defining a sidewall of the passage except for the direction toward said liquid clamber.

39. A liquid ejection head, comprising:

an ejection opening portion having a grooved ejection opening through which a liquid is ejected;

a liquid passage in fluid communication with the ejection opening portion for providing the liquid to said ejection opening portion;

an ejector element disposed by the liquid passage to eject the liquid from said ejection opening; and a liquid chamber which supplies said liquid passage with the liquid, wherein a state of the liquid is changed when thermal energy is applied to the liquid by the ejector element to generate a bubble, the liquid being ejected through the pressure caused by the bubble, the liquid passage between said ejection opening and the ejector element being surrounded by wall surfaces defining a sidewall of the passage except in a direction toward said liquid chamber, and grooves having tops which are positioned in a direction towards a corner portion of a volume surrounded by wall surfaces defining the sidewall of said passage, each of said grooves being shaped by a pair of walls which are connected in a V-shape and which meet at an acute angle.

40. An ink jet recording head, comprising:

an orifice plate having both a plate surface and a grooved orifice therein, the orifice having a plurality of convex and concave portions which together define a plurality of grooves that intersect the plate surface, each of said grooves being shaped by a pair of walls which are connected in a V-shape and which meet at an acute angle;

a liquid passage in fluid communication with said orifice; and an ejector element disposed by said liquid passage and which applies energy to liquid in said liquid passage to generate a bubble which ejects the liquid through the orifice, wherein adhesion of the liquid to the plate surface is controlled by the grooves of said grooved orifice.

41. A liquid jet recording head according to claim 40, wherein said grooves are dimensioned and disposed such that at least some of a residual droplet of the liquid on the plate surface is drawn back into said grooved orifice along at least one said groove.

42. A liquid jet cartridge, comprising:

an ink tank containing a liquid; and an ink jet recording head having an orifice plate having both a plate surface and a grooved orifice therein, the orifice having a plurality of convex and concave portions which together define a plurality of grooves that intersect the plate surface, each of said grooves being shaped by a pair of walls which are connected in a V-shape and which meet at an acute angle, a liquid passage in fluid communication with said orifice, and an ejector element disposed by said liquid passage and which applies energy to liquid in said liquid passage to generate a bubble which ejects the liquid through the orifice, wherein adhesion of the liquid to the orifice plate surface is controlled by the grooves of said grooved orifice; and a liquid conductor which guides the liquid from the ink tank to the ink jet head.

43. A liquid jet cartridge according to claim 42, wherein said grooves are dimensioned and disposed such that at least some of a residual droplet of the liquid on the plate surface is drawn back into said grooved orifice along at least one said groove.

44. A liquid jet recording apparatus, comprising:

an ink jet recording head having an orifice plate having both a plate surface and a grooved orifice therein, the orifice having a plurality of convex and concave portions which together define a plurality of grooves that intersect the plate surface, each of said grooves being shaped by a pair of walls which are connected in a V-shape and which meet at an acute angle, a liquid passage in fluid communication with said orifice, and an ejector element disposed by said liquid passage and which applies energy to liquid in said liquid passage to generate a bubble which ejects the liquid through the orifice, wherein adhesion of the liquid to the orifice plate surface is controlled by the grooves of said grooved orifice;

a conveyor which conveys a recording medium past the ink jet recording head; and a controller which receives input recording data and which, as a result, causes the ink jet recording head to record on the recording medium.

45. A liquid jet recording apparatus according to claim 44, wherein said grooves are dimensioned and disposed such that at least some of a residual droplet of the liquid on the plate surface is drawn back into said grooved orifice along at least one said groove.

* * * * *

UNITED STATES PATENT AND TRADEMARK OFFICE

CERTIFICATE OF CORRECTION

PATENT NO. : 6,520,626 B1
DATED : February 18, 2003
INVENTOR(S) : Shuichi Murakami It is certified that error appears in the above-identified patent and that said Letters Patent is hereby corrected as shown below:

Title page,
Item [57], ABSTRACT,
Line 3, “variation” (first occurrence) should read -- variations --.

Column 2,
Line 10, “Applicant” should read -- applicant --; and
Line 38, “a” (first occurrence) should read -- an --.

Column 3,
Line 10, “Inventors” should read -- inventors --.

Column 16,
Line 6, “a” should read -- an --; and
Line 55, “form” should read -- from --.

Column 20,
Line 27, “facilitate” should read -- facilitates --.

Column 21,
Line 5, “respect” should read -- with respect --.

Column 22,
Line 48, “dissolved” should read -- dissolve --; and
Line 59, “occur.” should read -- occurs. --.

Column 25,
Line 17, “a taper” should read -- tapers --;
Line 23, “taper” should read -- tapers --;
Line 25, “This taper 44a, 44b is” should read -- These tapers 44a, 44b are --;
Line 37, “is” should read -- are --; “a” should be deleted; and “section” should read -- sections --; and
Line 57, “such” should read -- such a --.

Column 26,
Line 41, “add into” should read -- along the same section lines as are --.

Column 28,
Line 58, “part” should read -- part of --

Column 31,
Line 60, “embodiment” should read -- embodiments --; and
Line 64, “top” should read -- tops --.

UNITED STATES PATENT AND TRADEMARK OFFICE

CERTIFICATE OF CORRECTION

PATENT NO. : 6,520,626 B1
DATED : February 18, 2003
INVENTOR(S) : Shuichi Murakami It is certified that error appears in the above-identified patent and that said Letters Patent is hereby corrected as shown below:

Column 32,
Line 46, “an” should read -- on --.

Column 34,
Line 44, “state” should read -- states --.

Column 35,
Line 25, “bubbles” should read -- bubbles are --.

Column 36,
Line 2, “each” should read -- on each --.

Column 37,
Line 5, “facilitate” should read -- facilitates --; and
Line 9, “opening” should read -- openings --.

Column 38,
Line 64, “on” should be deleted.

Column 39,
Line 39, “and” should be deleted.

Column 41,
Line 45, “opening:” should read -- opening, --; and
Line 66, “potion” should read -- portion --.

Signed and Sealed this

Twenty-first Day of October, 2003

JAMES E. ROGAN
*Director of the United States Patent and Trademark Office*